US010854983B2

(12) United States Patent
Zou et al.

(10) Patent No.: US 10,854,983 B2
(45) Date of Patent: Dec. 1, 2020

(54) ANTENNA WITH ANTI-INTERFERENCE ARRANGEMENT AND ITS MANUFACTURING METHOD

(71) Applicant: Gaodi Zou, Shenzhen (CN)

(72) Inventors: Gaodi Zou, Shenzhen (CN); Xin Zou, Shenzhen (CN)

(73) Assignee: Gaodi Zou, Shenzhen (CN)

( * ) Notice: Subject to any disclaimer, the term of this patent is extended or adjusted under 35 U.S.C. 154(b) by 74 days.

(21) Appl. No.: 16/237,737

(22) Filed: Jan. 1, 2019

(65) Prior Publication Data

US 2019/0379124 A1 Dec. 12, 2019

Related U.S. Application Data

(63) Continuation-in-part of application No. 16/035,689, filed on Jul. 15, 2018, now Pat. No. 10,680,320.

(30) Foreign Application Priority Data

Jun. 11, 2018 (CN) ..... 2018 1 0595979
Nov. 16, 2018 (CN) ..... 2018 1 1368719
Dec. 4, 2018 (CN) ..... 2018 1 1473009

(51) Int. Cl.
*H01Q 9/06* (2006.01)
*H01Q 1/38* (2006.01)

(52) U.S. Cl.
CPC ..... *H01Q 9/065* (2013.01); *H01Q 1/38* (2013.01)

(58) Field of Classification Search
CPC ..... H01Q 9/065; H01Q 9/0407; H01Q 9/16; H01Q 1/38; H01Q 1/48; H01Q 1/521; H01Q 5/328
See application file for complete search history.

(56) References Cited

U.S. PATENT DOCUMENTS 9,531,056 B2 * 12/2016 Liu ..... H01Q 9/0421

* cited by examiner

*Primary Examiner* — Hoang V Nguyen
(74) *Attorney, Agent, or Firm* — Raymond Y. Chan; David and Raymond Patent Firm

(57) ABSTRACT

An antenna includes a reference ground and at least a radiating source spacedly disposed at the reference ground to define a radiating clearance between the radiating source and the reference ground, wherein the radiating source is electrically connected to the reference ground to ground the radiating source so as to narrow a bandwidth of the antenna. When a electromagnetic excitation signal is received at a feed point of the radiating source, the bandwidth of the antenna is narrowed down to prevent any interference of the electromagnetic wave signal received or generated by the antenna in response to nearby electromagnetic radiation frequency or stray radiation frequency of the adjacent frequency bands.

19 Claims, 31 Drawing Sheets

ANTENNA WITH ANTI-INTERFERENCE ARRANGEMENT AND ITS MANUFACTURING METHOD

CROSS REFERENCE OF RELATED APPLICATION

This is a Continuation-In-Part application that claims the benefit of priority under 35 U.S.C. § 120 to a non-provisional application, application number Ser. No. 16/035,689, filed Jul. 15, 2018, which is a non-provisional application that claims which claims priority under 35 U.S.C. 119(a-d) to Chinese application number 201810595979.X, filed Jun. 11, 2018. The afore-mentioned patent application is hereby incorporated by reference in its entirety.

This application, also claimed priority to Chinese application number CN2018113687195, filed Nov. 16, 2018 and Chinese application number CN2018114730099, filed Dec. 4, 2018.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to an antenna, and more particularly to an antenna with an anti-interference arrangement, wherein the anti-interference arrangement prevents electromagnetic wave signals received or generated by the antenna from being interfered by the nearby electromagnetic radiation frequency or the stray radiation frequency, so as to enhance the anti-interference ability of the antenna.

Description of Related Arts

In recent years, microwave detection technologies have been widely used in the field of smart home application, wherein microwave detection is configured to collect user actions and to subsequently predict the user's intention, in order to intelligently control the home products. Generally, the microwave signal for detecting the user's motion are transmitted by a microwave antenna, wherein the microwave antenna is needed to comply with a predetermined transmission power for the microwave transmission. Accordingly, the transmission power of the microwave antenna is required to be lower than 1 W, to minimize any interference to other frequency bands.

Antenna are configured to transmit and/or receive electromagnetic waves for energy and/or signal transmission and are widely used in field of wireless communication, radar system, navigation system, television, radio, etc. For example, a conventional microwave detector comprises an antenna to emit a microwave at a predetermined frequency to detect a motion of an object within a target area. Moreover, the electromagnetic wave radiated by the antenna further serves as the carrier of the signal to transmit information, which is the key to complete the microwave detection.

An improved antenna has a configuration for improving an anti-interference ability of the antenna, wherein the antenna has a radiation source being electrically grounded by electrically connecting the radiation source to a reference ground to lower an impedance of the antenna. Therefore, the bandwidth of the antenna is narrowed down to effectively improve the anti-interference ability of the antenna. Specifically, the radiation source of the antenna has a feed point and a center point, wherein the feed point of the radiation source and the center point are spaced apart from each other. Accordingly, the feed point is electrically connected to a circuit to obtain an electromagnetic wave excitation signal, wherein the center point of the radiation source is directly connected to the reference ground by soldering in order to electrically connect the radiation source with the reference ground. As a result, such configuration is able to lower the impedance of the antenna so as to narrow down the bandwidth of the antenna for improving the anti-interference ability of the antenna. However, during the manufacturing process of the conventional antenna, since the locations of the feed point and the center point are relatively close to each other, the soldering material is initially applied at a predetermined position of the reference ground. Then, the center point of the radiation source is set corresponding to the soldering material in order to electrically connect to the reference ground. In other words, the position of the soldering material is set to be the center point of the radiation source to electrically connect to the reference ground, such that the radiation source can be held at one side of the reference ground. As it is mentioned above that the distance between the feed point and the center point is relatively small, and the area of the center point is relatively small. Through the soldering process via the soldering material, the feed point of the radiation source may accidentally connect to the center point in a direct connecting manner. At the same time, the center point of the radiation source may have a poor contact with the reference ground to affect the signal output stability of the antenna when the electromagnetic wave is outwardly radiated thereby. Seriously, the antenna may be malfunctioned via the defect of soldering process. In addition, through the conventional manufacturing process of the antenna, since the area of the center point is relatively small, it is time consuming to set the center point of the radiation source corresponding to the preset location of the reference ground. It not only extends the production cycle of the antenna but also requires high precision skill of the operator. Furthermore, once the radiation source is fixedly connected to one side of the reference source to form a defect of the antenna, the center point of the radiation source will not be electrically connected to the reference ground. As a result, the radiation source cannot be electrically grounded, such that the anti-interference ability of the antenna will be lowered. The product yield of the antenna is relatively low, and the maintenance cost of the antenna will be relatively high due to the refurbishment works of the antenna.

Industrial Scientific and Medical (ISM) Bands are designated by ITU-R (ITU Radio-communication Sector) and are unlicensed radio bands reserved internationally for the use of radio frequency (RF) telecommunications by institutions such as industry, science, and medicine institutions. During the use of these bands, the transmission power thereof must be restricted (usually lower than 1 W) and must not be interfere with other frequency bands. Nowadays, these ITU-R opened frequency bands being used for microwave detection are mainly set at 2.4 GHz, 5.8 GHz, 10.52 GHz, and 24.125 GHz. In recent years, new frequency bands are frequently utilized for the application of microwave detection. For example, the application of 5G technology will cause a new frequency band being used for microwave detection in addition to the existing frequency bands being already used for microwave detection. It is known that there will be a mutual interference when two or more frequency bands are used closely. For the microwave detection as an example, when the 5.8 GHz of frequency band is used for human or object motion detection, such 5.8 GHz of frequency band will be inevitably interfered by the application of 5G technology. As a result, the interference of the application of 5G technology will cause the inaccuracy of the detection result from the 5.8 GHz of frequency band. As the 5G technology is rapidly well-developed recently, the 5G system will be more open and the application thereof will be widely used. It can be foreseen that the large-scale application of 5G technology will inevitably form a high speed based on 5G data network and will continuously expand more frequency bands in the future. In other words, the possibility of interference of the frequency bands for the microwave detection will be highly increased by the application of 5G technology. Therefore, it is urgent to improve the antennas with anti-interfering ability for the microwave detection. Accordingly, a conventional method for enhancing the anti-interfering ability for the microwave detection antenna is the suppression method by shielding external wireless signals, signal filtering, and software algorithm processing to suppress the interference. However, such conventional method can only provide limited anti-interfering ability for limited frequency bands. Therefore, a need exists for an antenna that enhances the anti-interfering ability to different frequency bands. It is to the provision of such an antenna that the present disclosure is primarily directed.

SUMMARY OF THE PRESENT INVENTION

The invention is advantageous in that it provides an antenna with an anti-interference arrangement and method, wherein the anti-interference arrangement enhances the anti-interference ability of the antenna.

Another advantage of the invention is to provide an antenna with an anti-interference arrangement and method, wherein the anti-interference arrangement prevents electromagnetic wave signals received or generated by the antenna from being interfered by the nearby electromagnetic radiation frequency or the stray radiation frequency.

Another advantage of the invention is to provide an antenna with an anti-interference arrangement and method, wherein the impedance of the antenna is lowered to narrow the bandwidth thereof so as to prevent electromagnetic wave signals received or generated by the antenna from being interfered by the nearby electromagnetic radiation frequency or the stray radiation frequency.

Another advantage of the invention is to provide an antenna with an anti-interference arrangement and method, wherein the impedance of the antenna is lowered to enhance the radiating energy of the primary radiating wave within its radiating wave band, so as to reduce the harmonic radiation of the antenna.

Another advantage of the invention is to provide an antenna with an anti-interference arrangement and method, wherein the anti-interference circuit has a low impedance to match with the low impedance of the antenna in order to narrow the bandwidth of the antenna so as to prevent any interference of electromagnetic wave signals received or generated by the antenna of the present invention in response to the nearby electromagnetic radiation frequency.

Another advantage of the invention is to provide an antenna with an anti-interference arrangement and method, wherein the radiating source is grounded to reduce the impedance of the antenna.

Another advantage of the invention is to provide an antenna with an anti-interference arrangement and method, wherein the radiating source is electrically connected to the reference ground to ground the radiating source.

Another advantage of the invention is to provide an antenna with an anti-interference arrangement and method, wherein the anti-interference circuit provides a relatively large excitation current to the radiating source to ensure the stable operation of the antenna.

Another advantage of the invention is to provide an antenna with an anti-interference arrangement and method, wherein the radiating source has at least a radiating connection point electrically connected to the reference ground. A distance between the periphery of radiating source and the radiating connection point thereof is preset to generate an inductance therebetween under the excitation of the microwave excitation electrical signal.

Another advantage of the invention is to provide an antenna with an anti-interference arrangement and method, wherein a distance between the feed point and the radiating connection point is greater than or equal to $\frac{1}{64}\lambda$ to generate an inductance therebetween under the excitation of the microwave excitation electrical signal.

Another advantage of the invention is to provide an antenna with an anti-interference arrangement and method, wherein by forming the radiating connection point of the radiating source at the physical center point thereof, the impedance of the antenna will be lowered under resonance state to enhance the anti-interference ability of the antenna.

Another advantage of the invention is to provide an antenna with an anti-interference arrangement and method, wherein the electrical connection element has two terminal ends electrically connecting with the radiating source and the reference ground respectively to reduce the internal impedance of the antenna under resonance state so as to enhance the anti-interference ability of the antenna.

Another advantage of the invention is to provide an antenna with an anti-interference arrangement and method, wherein the radiating connection point is overlapped with the feed point to electrically connect the feed point with the reference ground for reducing the internal impedance of the antenna under resonance state so as to enhance the anti-interference ability of the antenna.

Additional advantages and features of the invention will become apparent from the description which follows, and may be realized by means of the instrumentalities and combinations particular point out in the appended claims.

According to the present invention, the foregoing and other objects and advantages are attained by an antenna, comprising:

a reference ground; and at least a radiating source spacedly disposed at the reference ground to define a radiating clearance between the radiating source and the reference ground, wherein the radiating source is electrically connected to the reference ground to ground the radiating source so as to narrow a bandwidth of the antenna.

In accordance with another aspect of the invention, the present invention comprises a method of manufacturing an antenna which comprises at least a radiating source and a reference ground, comprising the following steps.

(A) Spacedly dispose the radiating source at the reference ground to define a radiation clearance between the radiating source and the reference ground.

(B) Electrically connect the radiating source to the reference ground to ground the radiating source so as to narrow a bandwidth of the antenna.

In accordance with another aspect of the invention, the present invention comprises a method of enhancing an anti-interference ability of an antenna which comprises at least a radiating source and a reference ground, comprising the following steps.

(1) Form a radiating clearance between the radiating source and the reference ground.

(2) Ground the radiating source by electrically connecting the radiating source to the reference ground to reduce an internal impedance of the antenna, such that when a electromagnetic excitation signal is received at a feed point of the radiating source, a bandwidth of the antenna is narrowed down to prevent any interference of the electromagnetic wave signal received or generated by the antenna in response to nearby electromagnetic radiation frequency or stray radiation frequency of the adjacent frequency bands.

Another advantage of the invention is to provide a microwave driving circuit, method and application thereof, wherein an impedance of the antenna is reduced to increase the resistance of the antenna by narrowing the bandwidth of the antenna so as to enhance a performance of the anti-interference.

Another advantage of the invention is to provide a microwave driving circuit, method and application thereof, wherein the antenna provides a reference ground and at least one radiating source electrically connected to the reference ground, wherein the radiating source is grounded to reduce the impedance of the antenna.

Another advantage of the invention is to provide a microwave driving circuit, method and application thereof, wherein the antenna provides a low impedance microwave driving circuit to match the low impedance of the antenna, thereby facilitating the reduction impedance of the antenna, and the requirements of power transmission of the antenna.

Another advantage of the invention is to provide a microwave driving circuit, method and application thereof, wherein the microwave driving circuit can directly supply a microwave excitation current to the radiating source to reduce the impedance of the antenna, and lower the requirements of power transmission of the antenna.

Another advantage of the invention is to provide a microwave driving circuit, method and application thereof, which comprises an oscillation circuit module and a coupler having a first coupling member, wherein two ends of the first coupling member of the coupler are electrically connected to the oscillation circuit module and a feeding point of the radiating source in a direct connecting manner. Therefore, the microwave driving circuit is able to directly supply the microwave excitation current to the radiating source through the oscillation circuit module and the first coupling member of the coupler.

Another advantage of the invention is to provide a microwave driving circuit, method and application thereof, which comprises a mixing detection circuit module electrically connected to a second coupling member of the coupler, wherein the second coupling member of the coupler is inducted and connected with the first coupling member to obtain a change in microwave excitation current supplied to the radiating source through the first coupling member, so as to subsequently obtain a detection signal via the mixing detection circuit module.

According to the present invention, the foregoing and other objects and advantages are attained by a microwave driving circuit for an antenna, comprising:

an oscillation circuit module configured to generate a microwave excitation current;

a mixing detection circuit module having a signal output terminal; and a coupler having a first coupling member and a second coupling member inducted and connected to the first coupling member, wherein one end of the first coupling member is electrically connected to the oscillation circuit module while another end of the first coupling member is electrically connected to a feed point of the antenna, such that the microwave excitation current generated by the oscillation circuit module is adapted to pass through the first coupling member to the feed portion directly, wherein the mixing detection circuit module is electrically connected to the second coupling member, wherein the signal output terminal of the mixing detection circuit module is set to extend to the second coupling member.

According to the embodiment, the first coupling member and the second coupling member are embodied as impedance lines respectively, wherein the first coupling member and the second coupling member are extended adjacently and parallel with each other.

In one embodiment, the first coupling member and the second coupling member are embodied as bent micro-strip lines respectively.

In one embodiment, the first coupling member and the second coupling member are embodied as saw-tooth micro-strip lines respectively.

In one embodiment, the first coupling member and the second coupling member are embodied as square micro-strip lines respectively.

According to the embodiment, the coupler further comprises a plurality of first row extending micro-strip lines and a plurality of second row extending micro-strip lines. Each of the first row extending micro-strip lines is electrically connected to the first coupling member and is extended from the first coupling member to the second coupling member. Each of the second row extending micro-strip lines is electrically connected to the second coupling member and is extended from the second coupling member to the first coupling member. The first row extending micro-strip lines and the second row extending micro-strip lines are inducted and connected with each other.

In one embodiment, at least one of the second row extending micro-strip lines is disposed between any two of the adjacent first row extending micro-strip lines, correspondingly, wherein at least one of the first row extending micro-strip lines is disposed between any two of the adjacent second row extending micro-strip lines.

In one embodiment, the first coupling member is embodied as an impedance line and the second coupling member is embodied as a metal foil that surrounds a half circumference of the first coupling member.

In one embodiment, the mixing detection circuit module comprises a first diode and a second diode, wherein one end of the first diode and one end of the second diode are electrically connected to two ends of the second coupling member respectively.

In one embodiment, the mixing detection circuit module comprises a first diode and a second diode, wherein one end of the first diode and one end of the second diode are electrically connected to the second coupling member at the same location.

In one embodiment, the mixing detection circuit module comprises a first diode and a second diode, wherein one end of the first diode and one end of the second diode are electrically connected to a middle section of the second coupling member.

In one embodiment, the mixing detection circuit module comprises a first diode and a second diode, wherein one end of the first diode and one end of the second diode are electrically connected to the second coupling member.

According to the embodiment, the oscillation circuit module comprises a triode circuit processor, a bias resistor, a first capacitor, a second capacitor, and a third capacitor. The triode circuit processor has a first connection terminal, a second connection terminal, and a third connection terminal, wherein two ends of the bias resistor are electrically connected to the first and second connection terminals of the triode circuit processor respectively. Two ends of the first capacitor are electrically connected to the second connection terminal of the triode circuit processor and one end of the second capacitor respectively. Another end of the second capacitor is electrically grounded as a grounded end thereof. Two ends of the third capacitor are electrically connected to the first connection terminal of the triode circuit processor and the grounded end of the second capacitor. The third connection terminal of the triode circuit processor is electrically connected to the first coupling member of the coupler.

In one embodiment, the triode circuit processor is embodied as a semiconductor MOS transistor, wherein the third connection terminal of the triode circuit processor is a source terminal of the semiconductor MOS transistor.

In one embodiment, the triode circuit processor is embodied as a semiconductor transistor, wherein the third connection terminal of the triode circuit processor is an emitter of the semiconductor transistor.

In one embodiment, the oscillation circuit module further comprises an inductor, wherein one end of the inductor is electrically connected to the first connection terminal of the triode circuit processor while another end of the inductor is electrically connected to a power source.

In accordance with another aspect of the invention, the present invention comprises a microwave driving circuit for being used in a microwave antenna which has a feed point, wherein the microwave driving circuit comprises:

an oscillation circuit module configured to generate a microwave excitation current;

a mixing detection circuit module having a signal output terminal; and a coupler which comprises a coupling member and two capacitors, wherein one end of the coupling member is electrically connected to the oscillation circuit module while another end of the coupling member is electrically connected to the feed point of the antenna, such that the microwave excitation current is adapted to pass to the feed point via the coupling member, wherein two ends of the coupling member are electrically connected to one of the capacitors and one end of another capacitor, wherein other two ends of the two capacitors are electrically connected to the mixing detection circuit module, wherein the signal output terminal of the mixing detection circuit module is set between the coupler and any one of the capacitors.

In one embodiment, the mixing detection circuit module further comprises a first diode and a second diode, wherein one end of the first diode and one end of the second diode are electrically connected to the capacitors respectively.

In one embodiment, the coupling member of the coupler is embodied as a micro-strip line.

In one embodiment, the oscillation circuit module comprises a triode circuit processor, a bias resistor, a first capacitor, a second capacitor, and a third capacitor. The triode circuit processor has a first connection terminal, a second connection terminal, and a third connection terminal, wherein two ends of the bias resistor are electrically connected to the first and second connection terminals of the triode circuit processor respectively. Two ends of the first capacitor are electrically connected to the second connection terminal of the triode circuit processor and one end of the second capacitor respectively. Another end of the second capacitor is electrically grounded as a grounded end thereof. Two ends of the third capacitor are electrically connected to the first connection terminal of the triode circuit processor and the grounded end of the second capacitor. The third connection terminal of the triode circuit processor is electrically connected to the coupling member of the coupler.

In accordance with another aspect of the invention, the present invention comprises a microwave driving circuit for being used in a microwave antenna which has a feed point, wherein the microwave driving circuit comprises:

an oscillation circuit module configured to generate a microwave excitation current, wherein the oscillation circuit module is electrically connected to the feed point of the antenna, such that the microwave excitation current is adapted to directly flow to the feed point;

a mixing detection circuit module; and a coupler having one end electrically connected to the oscillation circuit module and the feed point of the antenna, and another end electrically connected to the mixing detection circuit module.

In one embodiment, the coupler is embodied as a capacitor.

In one embodiment, the mixing detection circuit module comprises a first diode and a second diode, wherein one end of the first diode and one end of the second diode are electrically connected to the one end as a common end of the coupler.

In one embodiment, the oscillation circuit module comprises a triode circuit processor, a bias resistor, a first capacitor, a second capacitor, and a third capacitor. The triode circuit processor has a first connection terminal, a second connection terminal, and a third connection terminal, wherein two ends of the bias resistor are electrically connected to the first and second connection terminals of the triode circuit processor respectively. Two ends of the first capacitor are electrically connected to the second connection terminal of the triode circuit processor and one end of the second capacitor respectively. Another end of the second capacitor is electrically grounded as a grounded end thereof. Two ends of the third capacitor are electrically connected to the first connection terminal of the triode circuit processor and the grounded end of the second capacitor. The third connection terminal of the triode circuit processor is electrically connected to the feed point of the antenna.

In accordance with another aspect of the invention, the present invention comprises an antenna, which comprises:

a reference ground;

at least a radiating source having a feed point, wherein the radiating source is spacedly disposed at the reference ground to define a radiating clearance between the radiating source and the reference ground, wherein the radiating source is grounded; and a microwave driving circuit electrically connected to the feed point of the radiating source to supply a microwave excitation current to the radiating source through the feed point thereof, wherein the microwave driving circuit comprises:

an oscillation circuit module configured to generate the microwave excitation current;

a mixing detection circuit module having a signal output terminal; and a coupler having a first coupling member and a second coupling member inducted and connected to the first coupling member, wherein one end of the first coupling member is electrically connected to the oscillation circuit module while another end of the first coupling member is electrically connected to the feed point of the antenna, such that the microwave excitation current generated by the oscillation circuit module is adapted to pass through the first coupling member to the feed portion of the radiating source directly, wherein the mixing detection circuit module is electrically connected to the second coupling member, wherein the signal output terminal of the mixing detection circuit module is set to extend to the second coupling member.

In accordance with another aspect of the invention, the present invention comprises an antenna, which comprises:

a reference ground;

at least a radiating source having a feed point, wherein the radiating source is spacedly disposed at the reference ground to define a radiating clearance between the radiating source and the reference ground, wherein the radiating source is grounded; and a microwave driving circuit electrically connected to the feed point of the radiating source to supply a microwave excitation current to the radiating source through the feed point thereof, wherein the microwave driving circuit comprises:

an oscillation circuit module configured to generate the microwave excitation current;

a mixing detection circuit module having a signal output terminal; and a coupler which comprises a coupling member and two capacitors, wherein one end of the coupling member is electrically connected to the oscillation circuit module while another end of the coupling member is electrically connected to the feed point of the antenna, such that the microwave excitation current is adapted to pass to the feed point via the coupling member, wherein two ends of the coupling member are electrically connected to one end of one of the capacitors and one end of another capacitor, wherein other two ends of the two capacitors are electrically connected to the mixing detection circuit module, wherein the signal output terminal of the mixing detection circuit module is set between the coupler and any one of the capacitors.

In accordance with another aspect of the invention, the present invention comprises an antenna, which comprises:

a reference ground;

at least a radiating source having a feed point, wherein the radiating source is spacedly disposed at the reference ground to define a radiating clearance between the radiating source and the reference ground, wherein the radiating source is grounded; and a microwave driving circuit electrically connected to the feed point of the radiating source to supply a microwave excitation current to the radiating source through the feed point thereof, wherein the microwave driving circuit comprises:

an oscillation circuit module configured to generate the microwave excitation current, wherein the oscillation circuit module is electrically connected to the feed point of the antenna;

a mixing detection circuit module; and a coupler, wherein one end of the coupler is electrically connected to the oscillation circuit module and the feed point of the antenna, such that the microwave excitation current is adapted to directly flow to the feed point, wherein another end of the coupler is electrically connected to the mixing detection circuit module.

Another advantage of the invention is to provide an anti-interference antenna and its manufacturing method thereof, wherein the antenna has an enhanced anti-interference ability and an enhanced stability of electromagnetic wave transmission.

Another advantage of the invention is to provide an anti-interference antenna and its manufacturing method thereof, wherein the antenna is configured that the radiating source is stably held on one side of the reference to electrically ground the radiating source. In addition, the manufacturing method of the antenna is optimized to enhance the anti-interference ability of the antenna.

Another advantage of the invention is to provide an anti-interference antenna and its manufacturing method thereof, wherein the antenna is grounded by indirectly connecting the radiating source to the reference ground to facilitate grounding of the radiating source so as to improve the manufacturing yield of the antenna.

Another advantage of the invention is to provide an anti-interference antenna and its manufacturing method thereof, wherein that the radiating source is stably held on one side of the reference ground via a connection module to electrically ground the radiating source so as to enhance the stabilization of the antenna and improve the performance of the antenna.

Another advantage of the invention is to provide an anti-interference antenna and its manufacturing method thereof, wherein the connection module comprises at least a first connecting member and at least a second connecting member. The first connecting member is electrically connected to the radiating source and the second connecting member is electrically connected to the reference ground, such that when the first connecting member and the second connecting member are electrically connected with each other, the radiating source is stably held on one side of the reference ground to electrically ground the radiating source. As a result, the stabilization of the antenna will be enhanced and the performance and reliability of the antenna will be improved.

Another advantage of the invention is to provide an anti-interference antenna and its manufacturing method thereof, wherein each of the first connecting member and the second connecting member has an enlarged contacting area to allow the operator to easily and rapidly connect the radiating source with the reference ground so as to facilitate the manufacturing process of the antenna and to enhance the manufacturing efficiency of the antenna.

Another advantage of the invention is to provide an anti-interference antenna and its manufacturing method thereof, wherein the enlarged contacting area of each of the first connecting member and the second connecting member can enhance the electrical connection area to enhance the connectively stabilization of the antenna and to ensure the antenna stably generating and receiving the output electromagnetic waves.

Another advantage of the invention is to provide an anti-interference antenna and its manufacturing method thereof, wherein the radiation source can be stably electrically connected to the reference ground when the first connecting member is stably connected to the second connecting member to further ensure the stability and reliability of the antenna.

Another advantage of the invention is to provide an anti-interference antenna and its manufacturing method thereof, wherein the first connecting member is directly connected to the second connecting member, such that the first connecting member is electrically connected to the ground point of the radiating source to electrically connect to the reference ground, and at the same time, to lower the ground impedance between the ground point and the reference ground, so as to further reduce the impedance of the antenna and improve the anti-interference ability of the antenna.

Another advantage of the invention is to provide an anti-interference antenna and its manufacturing method thereof, wherein the first connecting member is entirely connected to the second connecting member, such that the first connecting member is electrically connected to the ground point of the radiating source to electrically connect to the reference ground, to improve the consistency and stabilization of the antenna.

Another advantage of the invention is to provide an anti-interference antenna and its manufacturing method thereof, which comprises a retention member for coupling a first substrate to a second substrate in an adhering manner to connect the first connecting member with the second connecting member, so as to electrically connect the first connecting member at the ground point of the radiating source with the reference ground for improving the anti-interference ability of the antenna.

According to the present invention, the foregoing and other objects and advantages are attained by an antenna, comprising:

a reference ground;

a radiating source spacedly disposed at the reference ground to define a radiating clearance between the radiating source and the reference ground, wherein the radiating source has a feed point and at least a ground point;

a connection module which comprises at least a first connecting member and at least a second connecting member, wherein the first connecting member is electrically connected to the ground point of the radiating source, wherein the second connecting member is electrically connected to the reference ground, wherein at least a portion of the first connecting member is electrically connected to at least a portion of the second connecting member.

According to the present invention, the antenna further comprises a first substrate and a second substrate, wherein the radiating source and the first connecting member are coupled, preferably by adhering, at two sides of the first substrate, wherein the second connecting member is coupled, preferably by adhering, at one side of the second substrate.

In one embodiment, the antenna further comprises a first insulating layer coupled at the first connecting member, wherein at least a portion of the first connecting member is defined as a first exposing portion to electrically connect to the second connecting member.

In one embodiment, the first insulating layer has a first indention, wherein the first insulating layer is coupled at a bottom side of the first connecting member to form the first exposing portion thereof through the first indention of the first insulating layer.

In one embodiment, the first insulating layer is coupled at the bottom side of the first connecting member, wherein an area of the first insulating layer is smaller than an area of the bottom side of the first connecting member.

In one embodiment, the first insulating layer is adhered at the bottom side of the first connecting member.

In one embodiment, the first insulating layer is coated at the bottom side of the first connecting member.

In one embodiment, the antenna further comprises a second insulating layer coupled at the second connecting member, wherein at least a portion of the second connecting member is defined as a second exposing portion to electrically connect to the first connecting member.

In one embodiment, the second insulating layer has a second indention, wherein the second insulating layer is coupled at an upper side of the second connecting member to form the second exposing portion thereof through the second indention of the second insulating layer.

In one embodiment, the second insulating layer is coupled at the upper side of the second connecting member, wherein an area of the second insulating layer is smaller than an area of the upper side of the second connecting member.

In one embodiment, the second insulating layer is adhered at the upper side of the second connecting member.

In one embodiment, the second insulating layer is coated at the upper side of the second connecting member.

In one embodiment, the antenna further comprises at least a fourth conductive member and at least a fifth conductive member, wherein the fourth conductive member is electrically connected to the first connecting member while the fifth conductive member is electrically connected to the second connecting member. The fourth conductive member is extended through the first substrate and the first insulating layer. The fifth conductive member is extended through the second insulating layer, the second connecting member and the second substrate. The fourth conductive member is electrically connected to the fifth conductive member.

In one embodiment, a fourth through slot is correspondingly formed at each of the first substrate, the first connecting member, the first insulating layer, the second insulating layer, the second connecting member, and the second substrate. Through the metallization slot process, the fourth conductive member is formed at the fourth through slot of the first substrate, and inner slot walls of the fourth through slots of the first connecting member and the first insulating layer. Through the metallization slot process, the fifth conductive member is formed at the fourth through slot of the second substrate, and inner slot walls of the fourth through slots of the second connecting member and the second insulating layer.

In one embodiment, the first connecting member is directly coupled at the second connecting member by adhesive to electrically connect the first connecting member with the second connecting member.

In one embodiment, the antenna further comprises a retention member, wherein the retention member is extended from the first substrate to the second substrate in order to couple the first substrate to the second substrate preferably by adhering the first connecting member with the second connecting member.

In one embodiment, a fourth through slot is correspondingly formed at each of the first substrate, the first connecting member, the second connecting member, and the second substrate. The retention member is set at the fourth through slots of the first substrate, the first connecting member, the second connecting member, and the second substrate.

In one embodiment, a soldering material is filed into the fourth through slots of the first substrate, the first connecting member, the second connecting member, and the second substrate to form the retention member at the fourth through slots of the first substrate, the first connecting member, the second connecting member, and the second substrate.

In one embodiment, each of the fourth through slots of the first substrate, the first connecting member, the second connecting member, and the second substrate has an inner threaded portion, wherein the retention member has an outer threaded portion correspondingly engaged with the inner threaded portions to affixedly couple the first substrate with the second substrate.

In one embodiment, the retention member has an engaging portion and two limiting portions opposedly extended from two ends of the engaging portion respectively, wherein each of the limiting portions has a predetermined elasticity. When the limiting portions are deformed, a retention cavity is formed between the limiting portions and around the engaging portion, such that the first substrate and the second substrate are affixed and retained at the retention cavity.

In one embodiment, the area of the radiating source is smaller than the area of the first substrate. The first substrate has at least a retention area. The radiating source has two long edges and two short edges. The radiating source is located close to one of the long edges. The retention area is a portion formed at an outer side of the short edge of the radiating source corresponding to the first substrate. The retention area and the radiating source are spaced apart from each other. The retention member is coupled at the retention area.

In one embodiment, the first connecting member is press-fitted to couple to the second connecting member.

In one embodiment, the antenna further comprises a first conductive member, wherein two ends of the first conductive member are electrically connected to the ground point of the radiating source and the first connecting member.

In one embodiment, a first through slot is correspondingly formed at each of the radiating source, the first substrate, the first connecting member and the insulating layer. Through the metallization slot process, the first conductive member is formed at inner slot walls of the first through slots of the radiating source, the first substrate, the first connecting member and the insulating layer.

In one embodiment, the antenna further comprises a second conductive member and an oscillation circuit, wherein the second conductive member is electrically connected to the radiating source. The second conductive member is extended from the feed point of the radiating source to the bottom side of the first insulating layer while the second conductive member is electrically connected to the oscillation circuit.

In one embodiment, the antenna further comprises a third conductive member, wherein the third conductive member is electrically connected to the oscillation circuit. The third conductive member is extended from the oscillation circuit to the upper side of the second insulating layer while the third conductive member is electrically connected to the second conductive member.

In one embodiment, the first connecting member has a first insulating notch and the second connecting member has a second insulating notch, wherein the first insulating notch and the second insulating notch are through notches extended through the first connecting member and the second connecting member respectively. The first insulating notch and the second insulating notch are extended to encirclingly surround the second conductive member and the third conductive member respectively.

In one embodiment, the ground point of the radiating source is overlapped with the feed point thereof, such that the ground point and the feed point are located at the same point.

In one embodiment, a horizontal distance between a left side edge of the radiating source and a left side edge of the reference ground is greater than $1/64\ \lambda$. A horizontal distance between the left side edge of the radiating source and the left side edge of the reference ground is smaller than $\lambda$.

In one embodiment, a horizontal distance between a right side edge of the radiating source and a right side edge of the reference ground is greater than $1/64\ \lambda$. A horizontal distance between the right side edge of the radiating source and the right side edge of the reference ground is smaller than $1/4\ \lambda$.

According to the present invention, the foregoing and other objects and advantages are attained by a manufacturing method of the antenna, comprising the following steps.

(a) Provide a first antenna assembly and a second antenna assembly.

(b) Electrically connect a first connecting to a ground point of a radiating source of the first antenna assembly via a first conductive member.

(c) Electrically connect at least a portion of the first connecting member of the first antenna assembly with at least a portion of the second connecting member of the second antenna assembly to form a reference ground.

In step (b), the first conductive member is formed by metallization slot process.

In one embodiment, the method further comprises a step (d) of electrically connecting a feed point of the radiating source to an oscillation circuit via a second conductive member and a third conductive member.

In one embodiment, before the step (d), the method further comprises a step of (e) forming the second conductive member and the third conductive member by metallization slot process.

In one embodiment, before the step (d), the method further comprises a step of (f) encircling the second conductive member and the third conductive member around a first insulating notch and a second insulating notch of the first connecting member and the second connecting member respectively.

In one embodiment, the method further comprises a step of (g) coupling a first insulating layer at the first connecting member.

In one embodiment, in the step (g), the first insulating layer, having at least one first insulating notch, is adhered at the bottom side of the first connecting member.

In one embodiment, in the step (g), an insulating material is applied, preferably by spraying, on a predetermined location of the first connecting member to form the first insulating layer, wherein at least a portion of the first connecting member is exposed without the insulating material.

In one embodiment, the step (g) further comprises the following steps.

(g.1) Apply the insulating material to the first connecting member to entirely cover the insulating material on the bottom side of the first connecting member.

(g.2) Form the first insulating notch on the first insulating layer by scraping or etching the insulating material on the bottom side of the first connecting member.

In one embodiment, the method further comprises a step of (h) coupling a second insulating layer at the second connecting member.

In one embodiment, in the step (h), the second insulating layer, having at least one second insulating notch, is adhered at the upper side of the second connecting member.

In one embodiment, in the step (h), an insulating material is applied, preferably by spraying, on a predetermined location of the second connecting member to form the second insulating layer, wherein at least a portion of the second connecting member is exposed without the insulating material.

In one embodiment, the step (h) further comprises the following steps.

(h.1) Apply the insulating material to the second connecting member to entirely cover the insulating material on the upper side of the second connecting member.

(h.2) Form the second insulating notch on the second insulating layer by scraping or etching the insulating material on the upper side of the second connecting member.

In one embodiment, after the step (h), the method further comprises a step of (i) connecting the first connecting member with the second connecting member via a fourth conductive member.

In one embodiment, in the step (i), the fourth conductive member is formed by metallization slot process and is extended from the upper side of the first substrate to the bottom side of the second substrate.

In one embodiment, in the step (c), the first connecting member is directly adhered on the second connecting member to electrically connect the first connecting member with the second connecting member.

In one embodiment, a retention member is extended from the first antenna assembly to the second antenna assembly in order to retain the first antenna assembly at one side of the second antenna assembly.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

It is appreciated that the terms "longitudinal", "transverse", "upper", "lower", "front", "rear", "left", "right", vertical", "horizontal", "top", "bottom", "exterior", and "interior" in the following description refer to the orientation or positioning relationship in the accompanying drawings for easy understanding of the present invention without limiting the actual location or orientation of the present invention. Therefore, the above terms should not be an actual location limitation of the elements of the present invention.

It is appreciated that the terms "one", "a", and "an" in the following description refer to "at least one" or "one or more" in the embodiment. In particular, the term "a" in one embodiment may refer to "one" while in another embodiment may refer to "more than one". Therefore, the above terms should not be an actual numerical limitation of the elements of the present invention.

Figure 1:
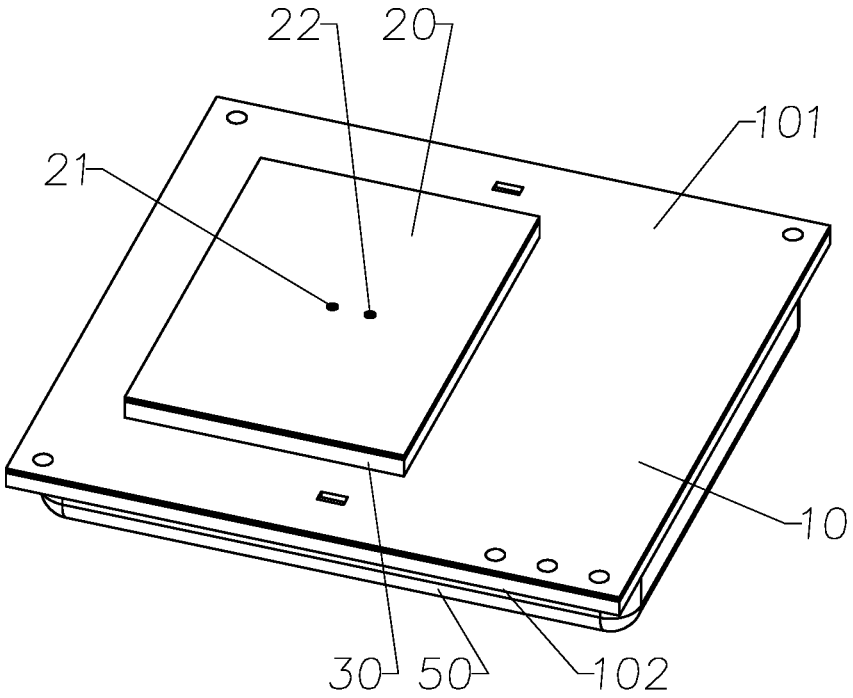
FIG. 1 is a perspective view of an antenna with an anti-interference arrangement according to a first preferred embodiment of the present invention.
Figure 2:
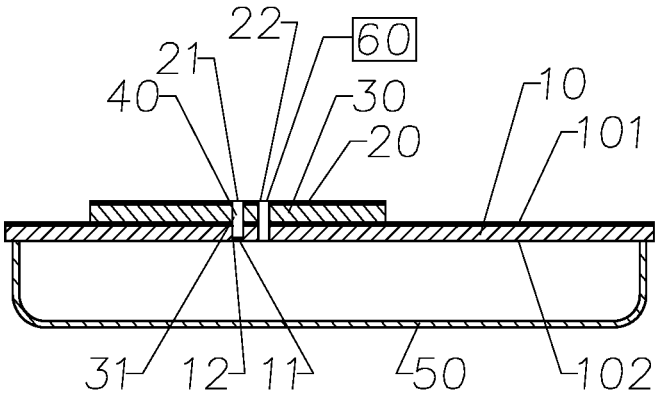
FIG. 2 is a sectional view of the antenna according to the above first preferred embodiment of the present invention.

Referring to FIGS. 1 and 2 of the drawings, an antenna according to a preferred embodiment of the present invention is illustrated, wherein the antenna comprises a reference ground 10 and at least a radiating source 20 spacedly disposed at the reference ground 10 on a first side 101 thereof to form an antenna body. Accordingly, the antenna further comprises an oscillating circuit electrically coupled to the antenna body.

It is worth mentioning that the radiating source 20 of the present invention is spaced apart from the reference ground 10 that there is not direct contact between the reference ground 10 and the radiating source 20. In particular, a space is formed between the reference ground 10 and the radiating source 20 as a radiating clearance 30 therebetween.

Figure 7A:
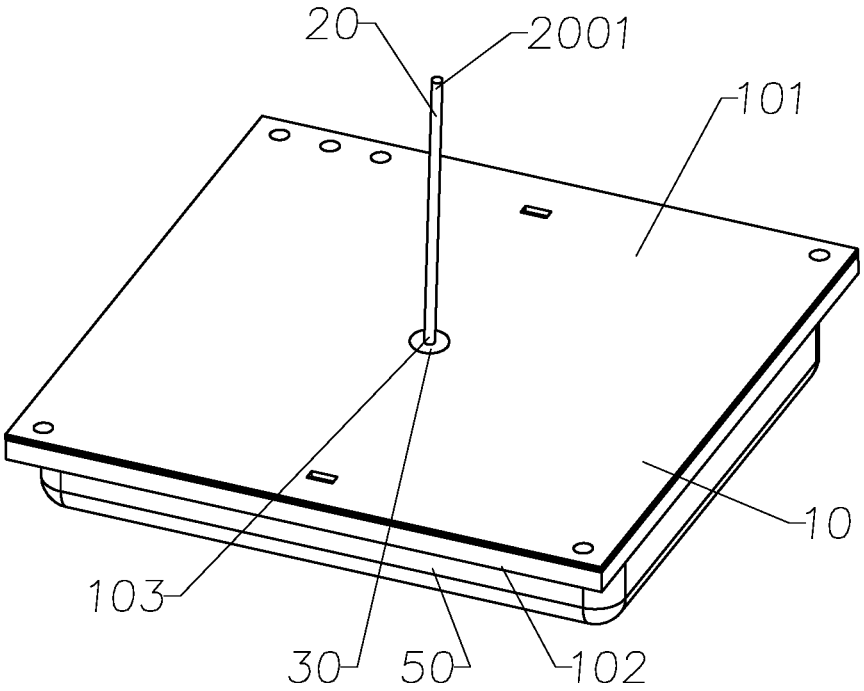
FIG. 7A illustrates a fourth alternative mode of the antenna according to the above first preferred embodiment of the present invention.
Figure 7B:
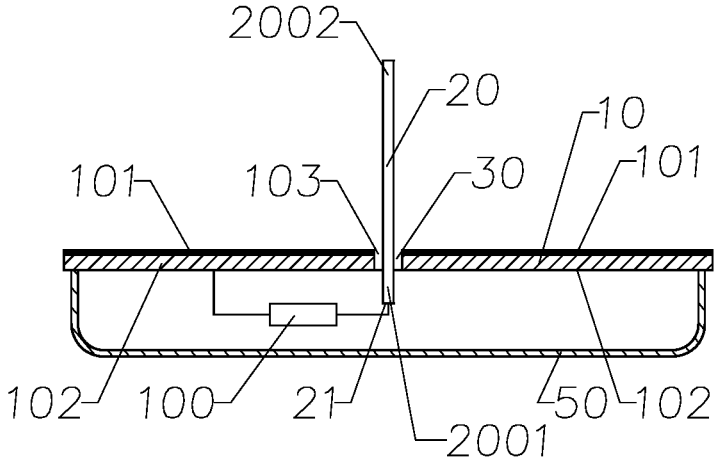
FIG. 7B is a sectional view of the fourth alternative mode of the antenna according to the above first preferred embodiment of the present invention.

Furthermore, the radiating clearance 30 defined between the reference ground 10 and the radiating source 20 refers a surface difference between a surface of the reference ground 10 and a surface of the radiating source 20. In one embodiment, the radiating clearance 30 defined between the reference ground 10 and the radiating source 20 is a height difference between the first side 101 of the reference ground 10 and an outer surface of the radiating source 20, as shown in FIGS. 1 and 2. In another embodiment, the radiating clearance 30 defined between the reference ground 10 and the radiating source 20 is a gap between the first side 101 of the reference ground 10 and a circumferential surface of the radiating source 20, as shown in FIGS. 7A and 7B. Therefore, the formation of the radiating clearance 30 between the reference ground 10 and the radiating source 20 should not be limited by only two designated surfaces thereof.

As shown in FIGS. 1 and 2, the radiating source 20 is electrically connected to the reference ground 10, wherein the radiating source 20 is grounded. It is worth mentioning that the configuration of the conventional antenna is that the radiating source is not grounded and is not electrically connected to the reference ground. By grounding the radiating source 20, an impedance of the antenna of the present invention can be substantially reduced to narrow down a bandwidth of the antenna, so as to avoid any interference of electromagnetic wave signals received or generated by the antenna of the present invention by electromagnetic radiation frequency or stray radiation frequency of the adjacent frequency bands.

As shown in FIGS. 1 and 2, the radiating source 20 has at least a radiating connection point 21 and a feed point 22. The reference ground 10 further has at least a reference ground connection point 11. The radiating connection point 21 of the radiating source 20 is electrically connected to the reference ground connection point 11 of the reference ground 10, such that the radiating source 20 is grounded. In addition, the feed point 22 of the radiating source 20 is arranged to be connected to an excitation current. Accordingly, the oscillating circuit is connected to the feed point 22 of the antenna body to generate the electromagnetic wave signal (microwave excitation electrical signal). Once the excitation current is received by the feed point 22 of the radiating source 20, the antenna will initialize at a polarization direction that the radiating source 20 will generate radiate energy at a radial and outward direction. As it is mentioned, the radiating source 20 is electrically connected to the reference ground 10 to ground the radiating source 20. Once the excitation current is received by the feed point 22 of the radiating source 20, a predetermined impedance is generated between the radiating connection point 21 and the feed point 22 of the radiating source due to the inductance characteristics therebetween. As a result, the antenna will be excited and initialized at a polarization direction to generate radiate energy at the radiating source 20 at a radial and outward direction. At the same time, the impedance will be lowered between the radiating connection point 21 and the feed point 22 of the radiating source due to the inductance characteristics therebetween, so as to narrow down the bandwidth of the antenna. By narrowing the bandwidth of the antenna, any interference of electromagnetic wave signals received or generated by the antenna of the present invention will be substantially reduce in response to the electromagnetic radiation frequency or stray radiation frequency of the adjacent frequency bands. It is worth mentioning that the feed point 22 of the radiating source 20 must be deviated from a physical center point thereof, so that it is easily excited by the excitation current. In addition, there must be an impedance between the radiating source 20 and the reference ground 10 in order to excite the radiating source 20. Even though the radiating connection point 21 of the radiating source 20 is grounded, the impedance will be generated between the radiating connection point 21 and the feed point 22 in response to the inductance characteristics therebetween under the high frequency excitation signal. It is worth mentioning that even the impedance is generated, such impedance is relatively low.

It is worth mentioning that the impedance of the antenna is lowered to enhance the radiating energy of the primary radiating wave within its radiating wave band, so as to reduce the harmonic radiation of the antenna. Accordingly, the antenna not only generates the electromagnetic waves in its radiation frequency band but also generates harmonic wave at frequency multiplication of its radiation frequency band, which is stray radiation.

Preferably, a distance between the radiating connection point 21 and the feed point 22 of the radiating source 20 is greater than or equal to $1/64\lambda$, where $\lambda$ is the wavelength of the electromagnetic wave signal received or generated by the antenna. Under the excitation of the excitation electrical signal, the electromagnetic wave signal will generate the inductance characteristics between the radiating connection point 21 and the feed point 22 of the radiating source 20. Since the feed point 22 of the radiating source 20 is deviated from the physical center point thereof, the intensity required for the excitation current of the antenna to the electromagnetic wave signal will be substantially reduced. As a result, once the excitation current is received by the feed point 22 of the radiating source 20, the antenna is easily initialized at a polarization direction.

As shown in FIGS. 1 and 2, the radiating connection point 21 of the radiating source 20 is preferably defined as the physical center point thereof. In other words, the physical center point of the radiating source 20 is electrically connected to the reference ground 10 to ground the radiating source 20. Therefore, by forming the radiating connection point 21 of the radiating source 20 at the physical center point thereof, the antenna can evenly and stably generate the radiate energy via the radiating source 20 in a radial and outward direction after the initial polarization direction is generated. It should be understood by a person who skilled in the art that the inductance is generated between the periphery of the radiating source 20 and the feed point 22 thereof under the excitation of the excitation current, and the resonant circuit of the antenna with a distributed capacitance is generated between the radiating source 20 and the reference ground 10 for receiving or generating the electromagnetic wave signal.

Figure 3:
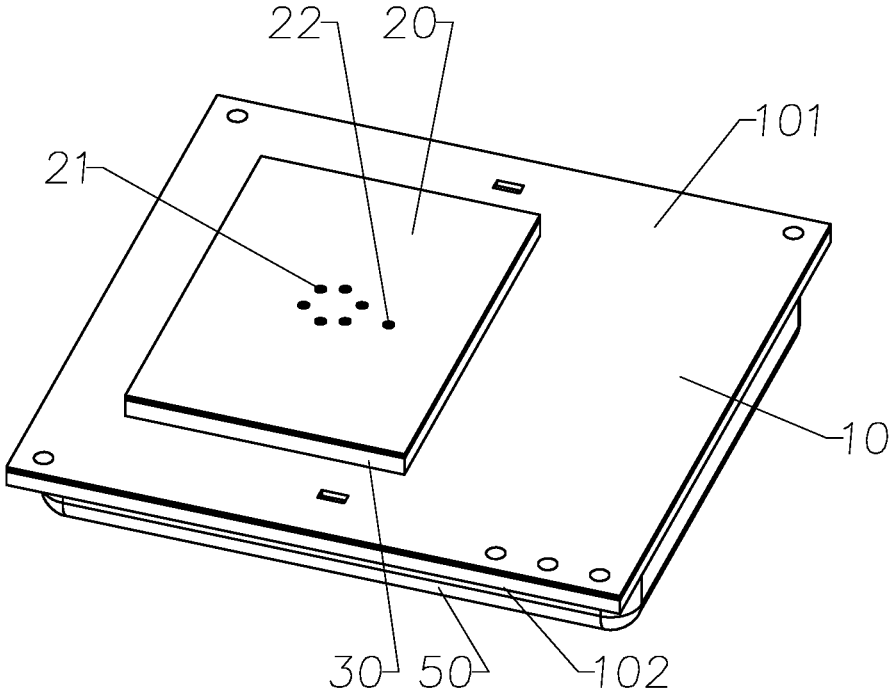
FIG. 3 illustrates a first alternative mode of the antenna according to the above first preferred embodiment of the present invention.

As shown in FIGS. 1 and 2, there is one radiating connection point 21 of the radiating source 20. In another embodiment as shown in FIG. 3, there are two or more radiating connection points 21 of the radiating source 20, wherein the physical center point of the radiating source 20 is surrounded by the radiating connection points 21 of the radiating source 20. In addition, a distance between the periphery of radiating source 20 and the radiating connection points 21 thereof is preset. Under the excitation of the electromagnetic wave signal, the inductance characteristics will be generated between the radiating connection point 21 and the feed point 22 of the radiating source 20. Then, when the excitation current is received by the feed point 22 of the radiating source 20, the impedance of the antenna is lowered to narrow down the bandwidth thereof. In addition, a distance between the feed point 22 and any one of the radiating connection points 21 is greater than or equal to $1/64\lambda$, as shown in FIG. 3.

As shown in FIGS. 1 and 2, the antenna further comprises an electrical connection element 40 having two terminal ends electrically connecting with the radiating connection point 21 of the radiating source 20 and the reference ground connection point 11 of the reference ground 10 respectively. Therefore, the electrical connection element 40 forms an electrical connection media to electrically connect the radiating source 20 and the reference ground 10 with each other so as to ground the radiating source 20.

As shown in FIGS. 1 and 2, the radiating connection point 21 of the radiating source 20 is preferably aligned with the reference ground connection point 11 of the reference ground 10. In other words, the extension direction between the radiating connection point 21 of the radiating source 20 and the reference ground connection point 11 of the reference ground 10 is perpendicular to the first side of reference ground 10.

It is worth mentioning that the electrical connection element 40 is preferably coupled between the radiating source 20 and the reference ground 10, such that the terminal ends of the electrical connection element 40 can be electrically connected to the radiating connection point 21 of the radiating source 20 and the reference ground connection point 11 of the reference ground 10 respectively, so as to electrically connect the radiating source 20 with the reference ground 10. According to the preferred embodiment as one of the examples, the radiating source 20 is initially retained adjacent to the first side 101 of the reference ground 10 to form the radiating clearance 30 between the reference ground 10 and the radiating source 20. Then, a reference ground slot 12 is formed at an opposed second side 102 of the reference ground 10, wherein the reference ground slot 12 is extended corresponding to the radiating source 20. It should be understood that the radiating clearance 30 between the radiating source 20 and the reference ground 10 is a solid media, as shown in FIGS. 1 and 2. In other words, at the same time when the reference ground slot 12 is formed, a clearance slit 31 is also formed within the radiating clearance 30, wherein the reference ground slot 12 of the reference ground 10 is communicated with and extended through the clearance slit 31 of the radiating clearance 30. The radiating connection point 21 of the radiating source 20 is set corresponding to the reference ground slot 12 of the reference ground 10 and the clearance slit 31 of the radiating clearance 30. Next, a molding element is sequentially extended to the reference ground slot 12 of the reference ground 10 and the clearance slit 31 of the radiating clearance 30 in order to connect the molding element to the radiating connection point 21 of the radiating source 20 and to connect the molding element to the reference ground 10. Therefore, the molding element is configured as the electrical connection element 40 to electrically connect the radiating source 20 and the reference ground 10 with each other. In addition, the connection point between the molding element and the reference ground 10 becomes the reference ground connection point 11 thereof.

It is worth mentioning that the molding element can be, but not limited to, a gold wire, silver wire or other conducive wires according to the preferred embodiment. When the molding element is used as the connection wire, the connection wire is extended from the reference ground slot 12 of the reference ground 10 and the clearance slit 31 of the radiating clearance 30 to the radiating connection point 21 of the radiating source 20 and to connect to the reference ground 10, so as to form the electrical connection element 40 to electrically connect the radiating source 20 and the reference ground 10 with each other. Alternatively, one end of the connection wire is initially connected to the radiating connection point 21 of the radiating source 20. Then, the radiating source 20 is retained close to the first side 101 of the reference ground 10, wherein the connection wire is extended through the reference ground slot 12 of the reference ground 10 to connect with the reference ground 10, so as to form the electrical connection element 40 to electrically connect the radiating source 20 and the reference ground 10 with each other. In one embodiment, the molding element can be, but not limit to, fluid material, wherein the molding element is filled into the reference ground slot 12 of the reference ground 10 and the clearance slit 31 of the radiating clearance 30. Once the molding element is solidified, the molding element forms the electrical connection element 40 to electrically connect the radiating source 20 and the reference ground 10 with each other.

As shown in FIGS. 1 and 2, the antenna further comprises a shield member 50 coupled at the reference ground 10 at the second side 102 thereof.

Figure 4:
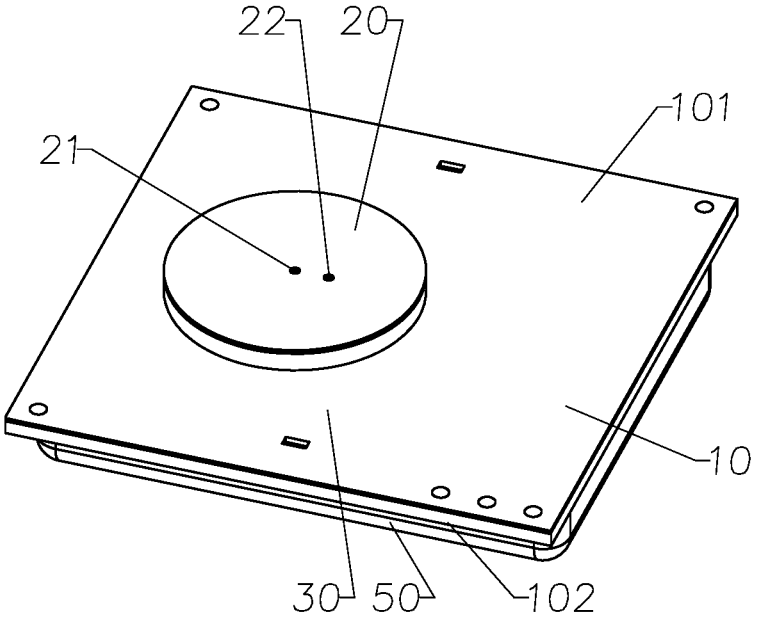
FIG. 4 illustrates a second alternative mode of the antenna according to the above first preferred embodiment of the present invention.
Figure 5:
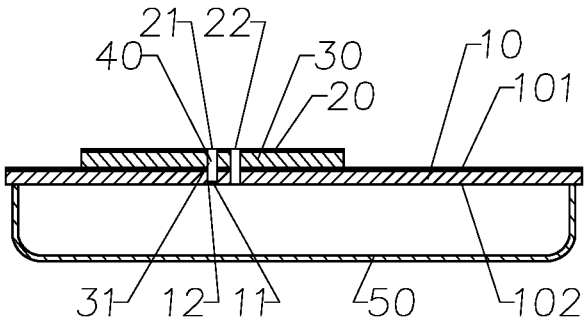
FIG. 5 is a sectional view of the second alternative mode of the antenna according to the above first preferred embodiment of the present invention.
Figure 6:
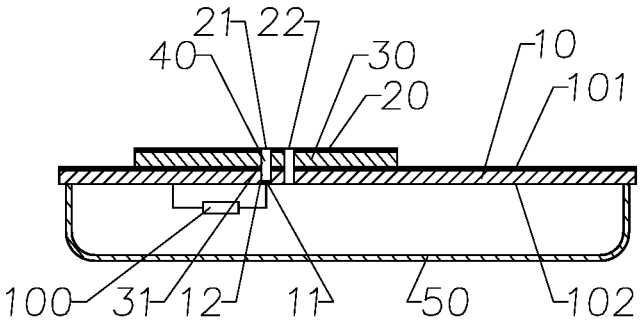
FIG. 6 illustrates a third alternative mode of the antenna according to the above first preferred embodiment of the present invention.

Accordingly, the shape of the radiating source 20 of the antenna should not be limited. For example, the radiating source 20 can be configured to have a rectangular shape as shown in FIGS. 1 to 3. It could be configured to have a square shape as well. Likewise, the radiating source 20 can be configured to have a circular shape or oval shape as shown in FIGS. 4 and 5. In other word, the extension direction of the radiating source 20 is the same as that of the reference ground 10, i.e. the radiating source 20 is parallel to the reference ground 10, to form a flat panel antenna. In other embodiment as shown in FIGS. 7A and 7B, the extension direction of the radiating source 20 is the perpendicular to that of the reference ground 10, i.e. the radiating source 20 is perpendicular to the reference ground 10, to form a column type antenna. As shown in FIGS. 7A and 7B, the antenna further comprises at least a supplement inductor 100, wherein one end of the supplement inductor 100 is electrically connected to the radiating connection point 21 of the radiating source 20 while another end of the supplement inductor 100 is grounded. As shown in FIG. 6, the radiating source 20 is formed as part of the flat panel antenna with the supplement inductor 100, wherein one end of the supplement inductor 100 is electrically connected to the radiating connection point 21 of the radiating source 20 while another end of the supplement inductor 100 is grounded.

Figure 8:
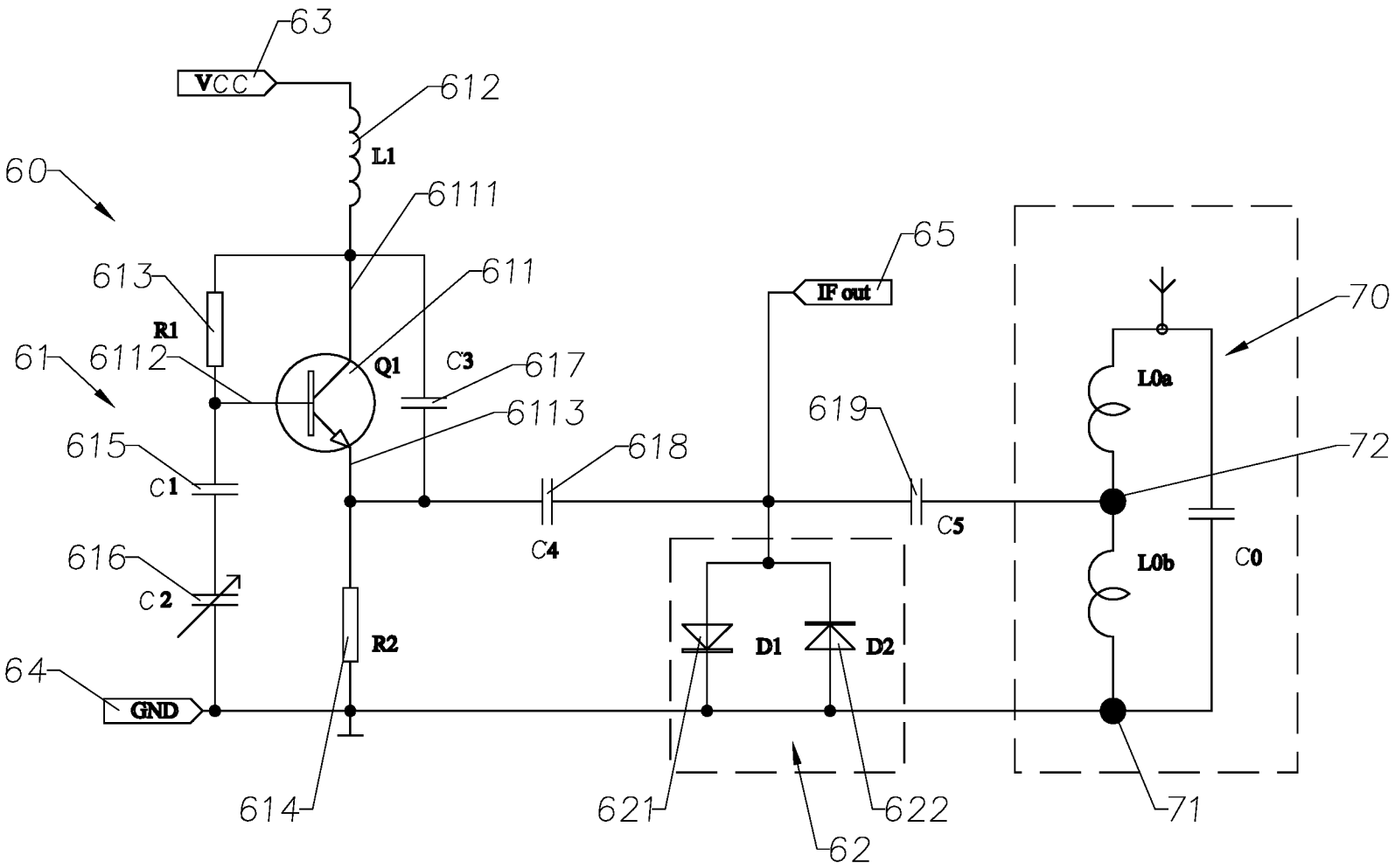
FIG. 8 is an anti-interference circuit diagram of the antenna according to the above first preferred embodiment of the present invention.

As shown in FIG. 8, the antenna further comprises an anti-interference circuit 60 electrically connected to the feed point 22 of the radiating source 20 to enable the excitation current passing through the anti-interference circuit 60 to the feed point 22 of the radiating source 20. The anti-interference circuit 60 has a low impedance to provide the excitation current to match with the low impedance of the antenna so as to enable the antenna generating the initial polarization direction. As a result, the impedance of the antenna will be reduced and the bandwidth of the antenna will be narrowed down such that any interference of electromagnetic wave signals received or generated by the antenna of the present invention will be substantially reduced in response to the nearby electromagnetic radiation frequency or stray radiation frequency of the adjacent frequency bands.

As shown in FIG. 8, the antenna further comprises an analog circuit 70 electrically connected with the radiating source 20 and the reference ground 10 for being excited by the excitation current. As shown in FIG. 8, the analog circuit 70 comprises a first analog point 71 analogously representing to the radiating connection point 21 of the radiating source 20 and a second analog point 72 analogously representing to the feed point 22 of the radiating source 20. It is worth mentioning that the antenna body is excited by the excitation current from the oscillating circuit, it performs as the analog circuit 70 to be excited.

In particular, the anti-interference circuit 60 comprises an oscillation circuit module 61 (i.e. the oscillating circuit) and a mixing detection circuit module 62 electrically connected to the oscillation circuit module 61. Accordingly, the second analog point 72 of the analog circuit 70 is electrically connected to the oscillation circuit module 61 of the anti-interference circuit 60. The mixing detection circuit module 62 is located and retained between the oscillation circuit module 61 and the radiating source 20. The mixing detection circuit module 62 adapts the low-impedance output of the oscillation circuit module 61 and the low impedance of the antenna to be grounded, so as to ensure the stability and reliability of the operation of the antenna. In other words, the feed point 22 f the radiating source 20 is electrically connected to the oscillation circuit module 61 of the anti-interference circuit 60.

Accordingly, once the impedance of the antenna is lowered, its bandwidth will be narrowed to enhance the anti-interference ability. The impedance of the existing antenna can be configured as low as 50 ohms. However, the impedance of the existing antenna cannot be further lowered below 50 ohms because of the conventional oscillating circuit. On the other hand, the oscillation circuit module 61 of the present invention is configured to match with the low impedance antenna in order to further reduce the impedance of the antenna. In other words, the strength of the excitation current for the low impedance antenna will be greater. However, under the emission power regulation of the antenna, the conventional oscillating circuit cannot provide such great excitation current. Therefore, the oscillation circuit module 61 of the present invention must have a low impedance to match with the low impedance antenna.

Accordingly, the anti-interference circuit 60 can be set in the reference ground 10. For example, the anti-interference circuit 60 can be printed or coated on the reference ground 10 or can be etched on the reference ground 10. In other words, the method of forming the anti-interference circuit 60 on the reference ground 10 should not be limited in the present invention.

Preferably, the connection between the oscillation circuit module 61 and the mixing detection circuit module 62 of the anti-interference circuit 60, and the connection between the mixing detection circuit module 62 and the feed point 22 of the radiating source 20 can be the capacitive coupling connections. So, the mixing detection circuit module 62 adapts the low-impedance output of the oscillation circuit module 61 and the low impedance of the antenna to be grounded, to effectively suppress the differential interference from coupling and the common interference from the reception of the antenna, so as to enhance the anti-interference ability of the antenna. It is worth mentioning that the antenna is used for human body movement detection. Due to the Doppler effect, there will be a difference in the wavelengths between the received and transmitted electromagnetic waves. Therefore, it is necessary to distinguish the received and transmitted electromagnetic waves by the mixing detection circuit module 62 to obtain a differential value for the calculation of the related movement data. In other words, the mixing detection circuit module 62 can be disabled when the antenna is used for data transmission.

As shown in FIG. 8, the anti-interference circuit 60 has a low impedance and a relatively large excitation current, that matches with the low impedance of the antenna, to the feed point 22 of the radiating source 20. In particular, the oscillation circuit module 61 of the anti-interference circuit 60 comprises a triode circuit processor 611, an inductor 612, a first resistor 613, a second resistor 614, a first capacitor 615, a second capacitor 616, a third capacitor 617, a fourth capacitor 618 and a fifth capacitor 619. The triode circuit processor 611 comprises a first connection terminal 6111, a second connection terminal 6112, and a third connection terminal 6113. One end of the inductor 612 is electrically connected to a power source VCC 63 while another end of the inductor 612 is electrically connected to the first connection terminal 6111 of the triode circuit processor 611. In other words, the first connection terminal 6111 of the triode circuit processor 611 is electrically connected to a power source VCC 63 through the inductor 612. One end of the first resistor 613 is electrically connected to the first connection terminal 6111 of the triode circuit processor 611 while another end of the first resistor 613 is electrically connected to the second connection terminal 6112 of the triode circuit processor 611. One end of the first capacitor 615 is electrically connected to the second connection terminal 6112 of the triode circuit processor 611 while another end of the first capacitor 615 is electrically connected to one end of the second capacitor 616. Another end of the second capacitor 616 is electrically connected to a ground point 64, such that the second connection terminal 6112 is grounded. In other words, the second connection terminal 6112 of the triode circuit processor 611 is grounded. One end of the third capacitor 617 is electrically connected to the first connection terminal 6111 of the triode circuit processor 611 while another end of the third capacitor 617 is electrically connected to the third connection terminal 6113 of the triode circuit processor 611. One end of the second resistor 614 is electrically connected to the third connection terminal 6113 of the triode circuit processor 611 while another end of the second resistor 614 is electrically connected to the ground point 64. One end of the fourth capacitor 618 is electrically connected to the third connection terminal 6113 of the triode circuit processor 611 while another end of the fourth capacitor 618 is electrically connected to one end of the fifth capacitor 619. Another end of the fifth capacitor 619 is electrically connected to the feed point 22 of the radiating source 20. In other words, the feed point 22 of the radiating source 20 is directly and electrically connected to the third connection terminal 6113 of the triode circuit processor 611. Accordingly, when the reference ground 10 is grounded (i.e. the oscillation circuit module 61 has the zero reference potential), and when the feed point 22 is electrically connected to the oscillation circuit module 61, the antenna body can receive the excitation current to generate the electromagnetic wave signal. Accordingly, the third connection terminal 6113 forms a junction terminal of the triode circuit processor 611D as a port for collectively merging the current.

Accordingly, the third connection terminal 6113 is not directly connected to the feed point 22. Particularly, the third connection terminal 6113 is connected to the feed point 22 through the fourth and fifth capacitors 618, 619, wherein the fourth and fifth capacitors 618, 619 cut off the physical connection between the third connection terminal 6113 and the feed point 22. Through the induction by the capacitors to generate the current for outputting to the feed point 22, the mixing detection circuit module 62 will output the current change signal via the fourth and fifth capacitors 618, 619.

Accordingly, comparing with the conventional oscillation circuit, the first terminal of the triode circuit provides the excitation electrical signal to the feed point 22 of the radiating source 20. As the current is weak, it is difficult to match with the low impendence of the antenna, so that the conventional antenna cannot be excited. It is worth mentioning that the triode circuit processor 611 of the present invention can be a MOS transistor, wherein the third connection terminal 6113 of the triode circuit processor 611 can be the electrode source of the MOS transistor. In other words, the feed point 22 of the radiating source 20 is directly and electrically connected to the electrode source (source terminal) of the MOS transistor. Therefore, the anti-interference circuit 60 can provide a relatively large excitation current to the feed point 22 of the radiating source 20 and to lower the low impedance of the antenna. In another embodiment, the triode circuit processor 611 can be a triode or semiconductor transistor, wherein the third connection terminal 6113 of the triode circuit processor 611 can be the emitter of the triode. In other words, the feed point 22 of the radiating source 20 is directly and electrically connected to the emitter of the triode. Therefore, the anti-interference circuit 60 can provide a relatively large excitation current to the feed point 22 of the radiating source 20 and to lower the low impedance of the antenna.

It should be understood that the present invention provides the excitation current to the radiating source 20 through the third connection terminal 6113 of the triode circuit processor 611. The third connection terminal 6113 of the triode circuit processor 611 is the output terminal thereof. In other words, the current is output at the third connection terminal 6113 of the triode circuit processor 611 to lower the impedance of the oscillation circuit module 61, so as to provide a relatively large excitation current to the feed point 22 of the radiating source 20 and to lower the low impedance of the antenna. Accordingly, the configuration of the anti-interference circuit 60 should not be limited in the present invention.

The mixing detection circuit module 62 comprises a first diode 621 and a second diode 622, wherein one end of the first diode 621 and one end of the second diode 622 are connected to a signal output terminal 65. Another end of the first diode 621 and another end of the second diode 622 are connected to the ground point 64.

Accordingly, the connection among the anti-interference circuit 60, the radiating source 20, and the reference ground 10 prevents any mutual affect among the direct current potentials of the oscillation circuit module 61 of the anti-interference circuit 60, the mixing detection circuit module 62 of the anti-interference circuit 60, and the analog circuit 70, so as to ensure the stability and reliability of the antenna. Thus, by configuring the anti-interference circuit 60 to configure the fifth capacitor 619 between the third capacitor 617 and the fourth capacitor 618 of the oscillation circuit module 61 and the feed point 22 of the radiating source 20, the oscillation circuit module 61, the mixing detection circuit module 62, and the feed point 22 of the radiating source 20 can be capacitive coupling with each other. Therefore, the mixing detection circuit module 62 adapts the low impedance output of the oscillation circuit module 61 and the low impedance of the antenna with respect to the ground, so as to effective suppress the differential interference from the coupling and the common interference from the reception of the antenna. In other words, the anti-interference ability of the antenna will be enhanced.

In addition, according to the antenna of the present invention, the inductor 612 is provided between the first connection terminal 6111 of the triode circuit processor 611 and the power source VCC 63 to further reduce the interference of the oscillation circuit module 61, so as to provide the suitable excitation current to match with the low impedance antenna.

According to the preferred embodiment, the radiating connection point 21 of the radiating source 20 is electrically connected to the reference ground connection point 11 of the reference ground 10 to electrically ground the radiating connection point 21 of the radiating source 20 at the ground point 64. Through such connection, after the excitation current is received at the feed point 22 of the radiating source 20, the inductance characteristics will be generated between the radiating connection point 21 and the feed point 22 of the radiating source 20 to provide a predetermined impedance, such that the antenna is easily initialized at a polarization direction to stably generate the radiate energy in a radial and outward direction. At the same time, the inductance characteristics will be generated between the radiating connection point 21 and the feed point 22 to have a relatively low impedance. Therefore, the bandwidth of the antenna will be narrowed down to prevent the electromagnetic wave signals received or generated by the antenna from being interfered by the nearby electromagnetic radiation frequency or the stray radiation frequency, so as to enhance the anti-interference ability of the antenna.

In other words, when the impedance of the antenna body is reduced, the corresponding bandwidth thereof will be narrowed, such that the frequency of the electromagnetic wave signal generated by the antenna body will be more concentrated within the bandwidth. As a result, the electromagnetic wave signal by the antenna body will prevent being interfered by the nearby electromagnetic radiation frequency or the stray radiation frequency, so as to enhance the anti-interference ability of the antenna. It is worth mentioning that when the impedance of the antenna body is reduced, the amount of the excitation current will be relatively increased. The impedance of the oscillation circuit module 61 will be further reduced to provide the excitation current to the antenna body.

Therefore, by grounding the radiating source 20 and by configuring the distance between the radiating connection point 21 and the feed point 22 of the radiating source 20 being greater than or equal to $\frac{1}{64}\lambda$, the portion between the feed point 22 of the radiating source 20 and the reference ground connection point 11 will be inducted under high frequency excitation current, i.e. the element L0b of the analog circuit 70. As a result, the impedance of the antenna body is reduced when the antenna body is excited by the excitation current to generate the electromagnetic wave signal, especially when the reference ground connection point 11 is provided at the physical center point of the radiating source 20.

It is worth mentioning that an inductor can be provided for the antenna body, wherein one end of the inductor is connected to the reference ground connection point 11 and another end of the inductor is grounded. Therefore, the distance between the radiating connection point 21 and the feed point 22 of the radiating source 20 will not be limited. Since the reference ground 10 is grounded, the ground end of the inductor can be grounded by connecting to the reference ground 10.

Figure 9:
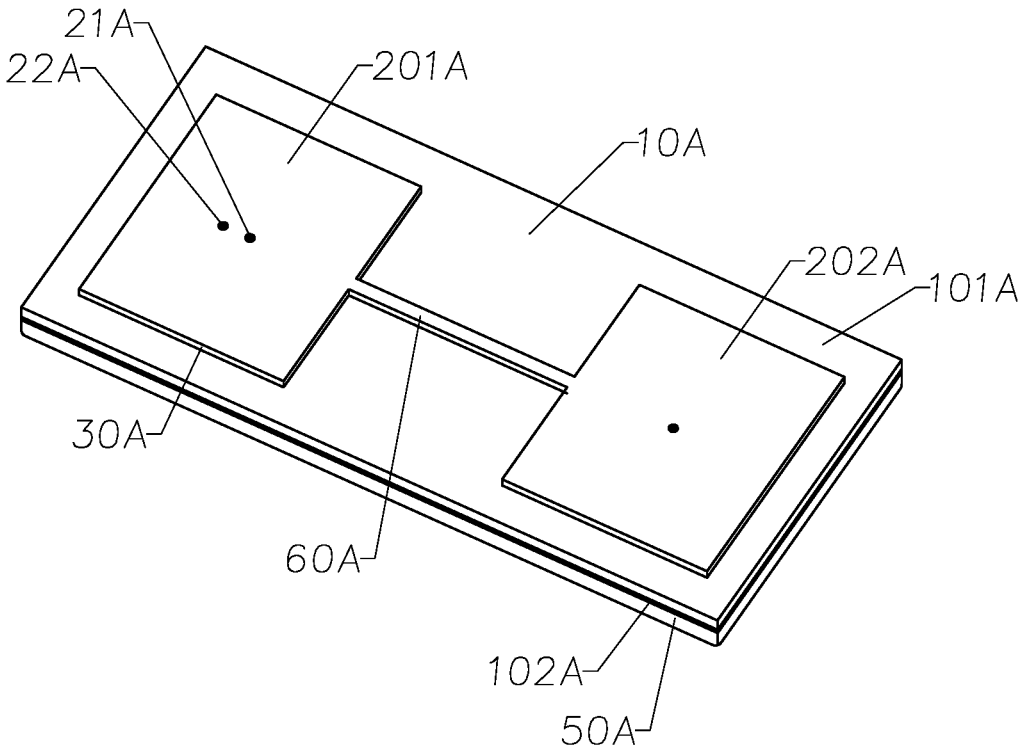
FIG. 9 is a perspective view of an antenna with an anti-interference arrangement according to a second preferred embodiment of the present invention.
Figure 10:
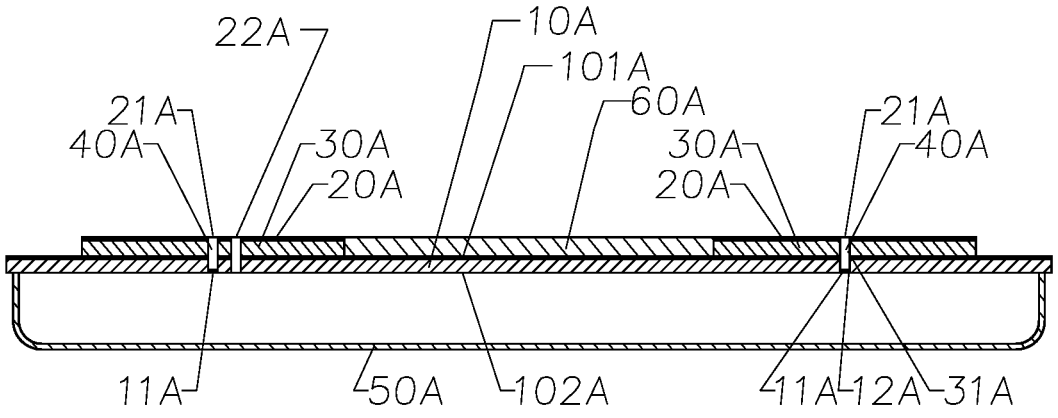
FIG. 10 is a sectional view of the antenna according to the above second preferred embodiment of the present invention.

FIGS. 9 and 10 illustrate a second embodiment of the present invention as an alternative mode thereof, wherein the antenna comprises a reference ground 10A, two radiating sources 20A, and an elongated connector 60A. The two radiating sources 20A are located adjacent to each other and are electrically connected by the elongated connector 60A. The elongated connector 60A is embodied as a micro-connection strip. A radiating clearance 30A is formed at each of the radiating sources 20A and the reference ground 10A.

Accordingly, the reference ground 10A has a first side 101A and an opposed second side 102A, wherein the radiating sources 20A are provided at the first side 101A of the reference ground 10A.

As shown in FIGS. 9 and 10, each of the radiating sources 20A has at least a radiating connection point 21A. The reference ground 10A has at least two reference ground connection points 11A. The radiating connection points 21A of the radiating sources 20A are electrically connected to the reference ground connection points 11A of the reference ground 10A respectively. One of the radiating sources 20A has a feed point 22A while another radiating source 20A does not contain any feed point. For easy understanding, the radiating source 20A with the feed point 22A becomes a primary radiating source 201A and the radiating source 20A without the feed point 22A becomes a secondary radiating source 202A as shown in FIGS. 9 and 10. In other words, the primary radiating source 201A and the secondary radiating source 202A are located adjacent to each other. The radiating clearance 30A is formed between the reference ground 10A and each of the primary radiating source 201A and the secondary radiating source 202A. Two ends of the elongated connector 60A are electrically connected to the primary radiating source 201A and the secondary radiating source 202A respectively.

The excitation current is received at the feed point 22A of the primary radiating source 201A. After the excitation current is received at the feed point 22A of the primary radiating source 201A, the excitation current passes through the elongated connector 60A to the secondary radiating source 202A. At this time, the antenna is initialized at a polarization direction to stably generate the radiate energy in a radial and outward direction through the radiating clearance 30A. Since the primary radiating source 201A and the secondary radiating source 202A are electrically connected with the reference ground 10A, the inductance characteristics will be generated between the radiating connection point 21 and the feed point 22 to provide a predetermined impedance after the excitation current is received at the feed point 22A of the primary radiating source 201A and is sent to the secondary radiating source 202A through the elongated connector 60A. Therefore, the bandwidth of the antenna will be narrowed down to prevent the electromagnetic wave signals received or generated by the antenna from being interfered by the nearby electromagnetic radiation frequency or the stray radiation frequency, so as to enhance the anti-interference ability of the antenna.

Preferably, a distance between the feed point 22A and the radiating connection point 21A of the primary radiating source 201A is greater than or equal to $\frac{1}{64}\lambda$, where $\lambda$ is the wavelength of the electromagnetic wave signal received or generated by the antenna. Under the excitation of the electromagnetic wave signal, the electromagnetic wave signal will generate the inductance characteristics between the feed point 22A and the radiating connection point 21A of the primary radiating source 201A. Since the feed point 22A of the primary radiating source 201A is deviated from the physical center point thereof, the intensity required for the excitation current of the antenna to the electromagnetic wave signal will be substantially reduced. As a result, once the excitation current is received by the feed point 22A of the primary radiating source 201A, the antenna is easily initialized at a polarization direction.

Preferably, the radiating connection point 21A of the primary radiating source 201A is defined as the physical center point thereof. In other words, the physical center point of the primary radiating source 201A is electrically connected to the reference ground 10A to ground the primary radiating source 201A. Therefore, a distance between the periphery of primary radiating source 201A and the radiating connection point 21A thereof is preset. Correspondingly, the radiating connection point 21A of the secondary radiating source 202A is defined as the physical center point thereof, wherein the physical center point of the secondary radiating source 202A is electrically connected to the reference ground 10A, such that a distance between the periphery of secondary radiating source 202A and the radiating connection point 21A thereof is preset. Therefore, the antenna can evenly and stably generate the radiate energy via the primary radiating source 201A and the secondary radiating source 202A in a radial and outward direction after the initial polarization direction is generated. Under the excitation of the electromagnetic wave signal and through the electrical connection among the reference ground 10A and the physical center points of the primary radiating source 201A and the secondary radiating source 202A, when the excitation current is received by the feed point 22A of the primary radiating source 201A to the secondary radiating source 202A through the elongated connector 60A, the antenna can evenly and stably generate the radiate energy via the primary radiating source 201A and the secondary radiating source 202A in a radial and outward direction. At the same time, the inductance characteristics will be generated between the feed point 22A and the radiating connection point 21A of the primary radiating source 201A and the inductance characteristics will be generated between the elongated connector 60A and the radiating connection point 21A of the secondary radiating source 202A to lower the impedance of the antenna. Therefore, the bandwidth of the antenna will be narrowed down to prevent the electromagnetic wave signals received or generated by the antenna from being interfered by the nearby electromagnetic radiation frequency or the stray radiation frequency, so as to enhance the anti-interference ability of the antenna.

As shown in FIGS. 9 and 10, the antenna further comprises at least two electrical connection elements 40A, wherein one of the electrical connection elements 40A has two terminal ends electrically connecting with the radiating connection point 21A of the primary radiating source 201A and one of the reference ground connection points 11A of the reference ground 10A respectively. Therefore, the electrical connection element 40A forms an electrical connection media to electrically connect the primary radiating source 201A and the reference ground 10A with each other so as to ground the primary radiating source 201A. Another electrical connection element 40A has two terminal ends electrically connecting with the radiating connection point 21A of the secondary radiating source 202A and another reference ground connection point 11A of the reference ground 10A respectively. Therefore, the electrical connection element 40A forms an electrical connection media to electrically connect the secondary radiating source 202A and the reference ground 10A with each other so as to ground the secondary radiating source 202A.

Preferably, there are at least two radiating connection points 21A provided by at least one of the primary radiating source 201A and the secondary radiating source 202A. In one embodiment, for example, the primary radiating source 201A provides two or more radiating connection points 21A while the secondary radiating source 202A provides one radiating connection point 21A. The physical center point of the primary radiating source 201A is surrounded by the radiating connection points 21A of the primary radiating source 201A. The radiating connection point 21A of the secondary radiating source 202A is the physical center point thereof. In another embodiment, the primary radiating source 201A provides one radiating connection point 21A while the secondary radiating source 202A provides two or more radiating connection point 21A. The radiating connection point 21A of the primary radiating source 201A is the physical center point thereof. The physical center point of the secondary radiating source 202A is surrounded by the radiating connection points 21A of the secondary radiating source 202A. In another further embodiment, the primary radiating source 201A provides two or more radiating connection points 21A while the secondary radiating source 202A provides two or more radiating connection point 21A. The physical center point of the primary radiating source 201A is surrounded by the radiating connection points 21A of the primary radiating source 201A. The physical center point of the secondary radiating source 202A is surrounded by the radiating connection points 21A of the secondary radiating source 202A.

As shown in FIGS. 9 and 10, the antenna further comprises a shield member 50A coupled at the reference ground 10A at the second side 102A thereof.

Figure 11:
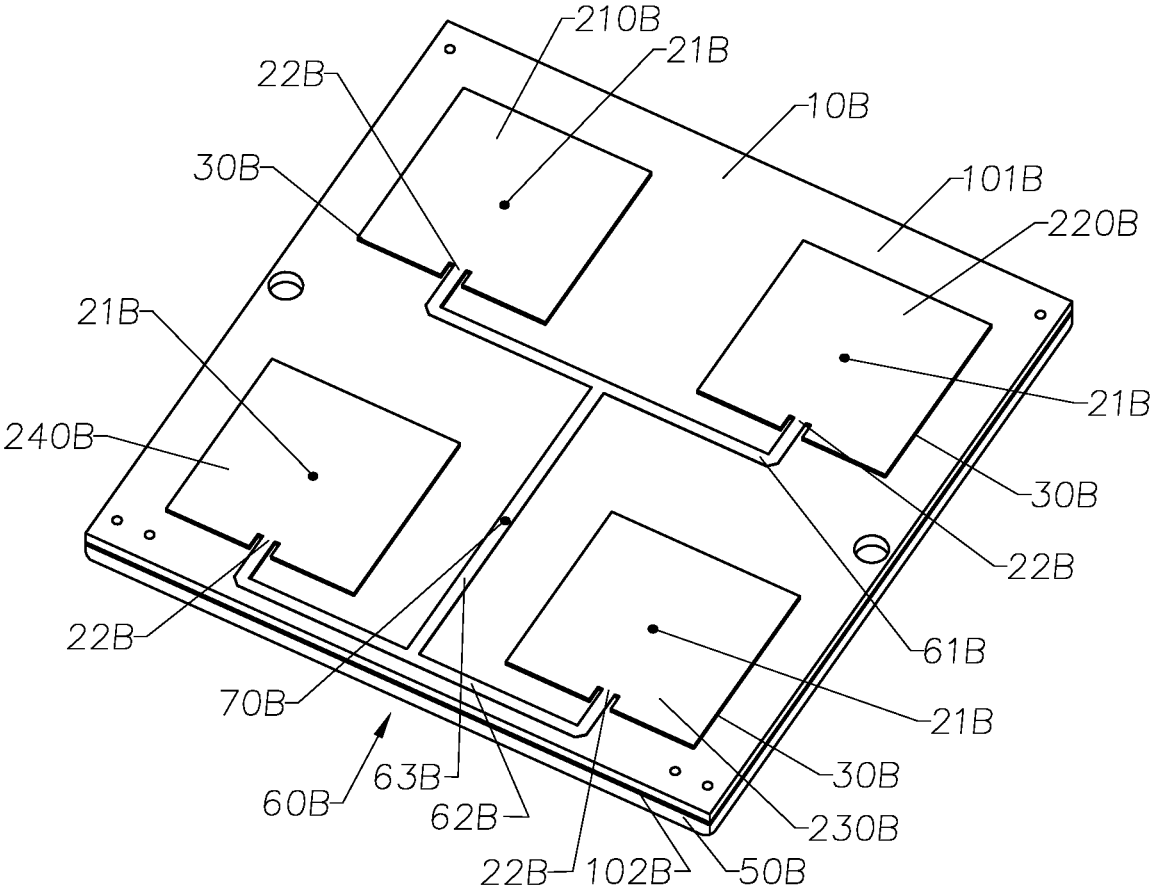
FIG. 11 is a perspective view of an antenna with an anti-interference arrangement according to a third preferred embodiment of the present invention.
Figure 12:
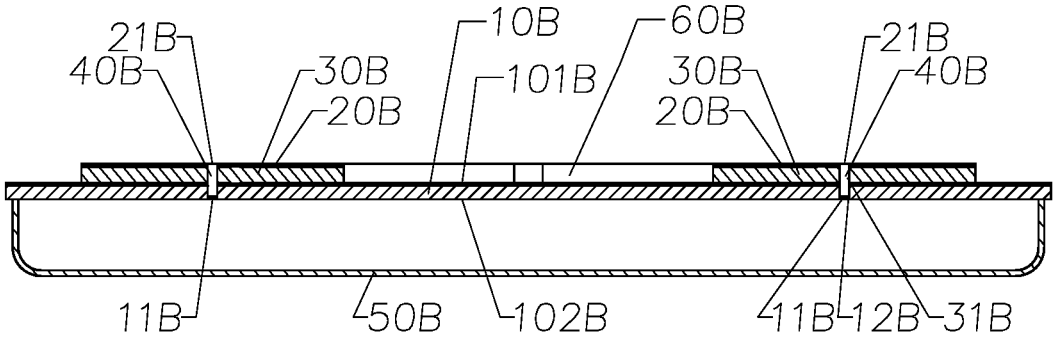
FIG. 12 is a sectional view of the antenna according to the above third preferred embodiment of the present invention.

FIGS. 11 and 12 illustrate a third embodiment of the present invention as another alternative mode thereof, wherein the antenna comprises a reference ground 10B, four radiating sources 20B, and three elongated connectors 60B. The reference ground 10B has a first side 101B and an opposed second side 102B. The four radiating sources 20B are formed in pair and are located adjacent to each other on the first side 101B of the reference ground 10B. The elongated connector 60A is embodied as a micro-connection strip. A radiating clearance 30B is formed at each of the radiating sources 20B and the reference ground 10A. The first elongated connectors 60B has two ends connecting to two adjacent radiating sources 20B in pair. The second elongated connector 60B has two ends connecting to two adjacent radiating sources 20B in another pair. The third elongated connector 60B has two ends connecting between the first and second elongated connectors 60B.

According to the preferred embodiment, the four radiating sources 20B are defined as a first radiating source 210B, a second radiating source 220B, a third radiating source 230B, and a fourth radiating source 240B. The first through fourth radiating sources 210B, 220B, 230B, 240B are orderly located in a clockwise direction. Therefore, the first radiating source 210B is located adjacent to the second and fourth radiating sources 220B, 240B. The third radiating source 230B is located adjacent to the second and fourth radiating sources 220B, 240B. The first radiating source 210B is located opposite to the third radiating source 230B. The second radiating source 220B is located opposite to the fourth radiating source 240B. In addition, the radiating clearance 30B is formed between the first radiating source 210B and the reference ground 10B. The radiating clearance 30B is also formed between the second radiating source 220B and the reference ground 10B. The radiating clearance 30B is also formed between the third radiating source 230B and the reference ground 10B. The radiating clearance 30B is also formed between the fourth radiating source 240B and the reference ground 10B. As it is mentioned above, the three elongated connectors 60B are defined as the first elongated connector 61B, the second elongated connector 62B, and the third elongated connector 63B. The two ends of the first elongated connector 61B are electrically connected to the first and second radiating sources 210B, 220B respectively. The two ends of the second elongated connector 62B are electrically connected to the third and fourth radiating sources 230B, 240B respectively. The two ends of the third elongated connector 63B are electrically connected to the first and second elongated connectors 61B, 62B.

As shown in FIGS. 11 and 12, the first through fourth radiating sources 210B, 220B, 230B, 240B are correspondingly connected to the reference ground 10B, wherein when the excitation current is received by the first through fourth radiating sources 210B, 220B, 230B, 240B, the antenna is initialized at a polarization direction to enable the electromagnetic wave signals received or generated by the antenna.

As shown in FIGS. 11 and 12, each of the first through fourth radiating sources 210B, 220B, 230B, 240B has at least a radiating connection point 21B. The reference ground 10B has at least four reference ground connection points 11A electrically connected to the first through fourth radiating sources 210B, 220B, 230B, 240B respectively.

Each of the first through fourth radiating sources 210B, 220B, 230B, 240B has a feed point 22B to receive the excitation current. Preferably, a distance between the feed point 22B and the radiating connection point 21B of any one of the first through fourth radiating sources 210B, 220B, 230B, 240B is greater than or equal to $\frac{1}{64}\lambda$, where $\lambda$ is the wavelength of the electromagnetic wave signal received or generated by the antenna. Under the excitation of the electromagnetic wave signal, the electromagnetic wave signal will generate the inductance characteristics between the feed point 22B and the radiating connection point 21B of one of the first through fourth radiating sources 210B, 220B, 230B, 240B to provide a predetermine of impedance. The antenna is initialized at a polarization direction to stably generate the radiate energy in a radial and outward direction. At the same time, the inductance characteristics will be generated between the feed point 22B and the radiating connection point 21B and the inductance characteristics will be generated between the elongated connector 60A to lower the impedance of the antenna. Therefore, the bandwidth of the antenna will be narrowed down to prevent the electromagnetic wave signals received or generated by the antenna from being interfered by the nearby electromagnetic radiation frequency or the stray radiation frequency, so as to enhance the anti-interference ability of the antenna.

Furthermore, the feed point 22B of the corresponding radiating source 20B is deviated from a physical center point thereof to lower the amount or intensity of the excitation current for the antenna. In addition, when the excitation current is received by the feed point 22B of the first radiating source 210B, the feed point 22B of the second radiating source 220B, the feed point 22B of the third radiating source 230B, and the feed point 22B of the fourth radiating source 240B, the antenna is easily initialized at a polarization direction.

Preferably, the feed point 22B of the first radiating source 210B is the connection point to connect to the first elongated connector 61B. The feed point 22B of the second radiating source 220B is the connection point to connect to the first elongated connector 61B. The feed point 22B of the third radiating source 230B is the connection point to connect to the second elongated connector 62B. The feed point 22B of the fourth radiating source 240B is the connection point to connect to the second elongated connector 62B.

Furthermore, the antenna further comprises an antenna feed point 70B electrically connected to the third elongated connector 63B. When the excitation current is received at the antenna feed point 70B of the antenna, it passes through the third elongated connector 63B to the feed points 22B of the first through fourth radiating sources 210B, 220B, 230B, 240B via the first and second elongated connectors 61B, 62B. Therefore, the bandwidth of the antenna will be narrowed down to prevent the electromagnetic wave signals received or generated by the antenna from being interfered by the nearby electromagnetic radiation frequency or the stray radiation frequency, so as to enhance the anti-interference ability of the antenna.

In addition, when the first radiating source 210B has one radiating connection point 21B, the radiating connection point 21B of the first radiating source 210B is defined as the physical center point thereof. When the first radiating source 210B has two or more radiating connection points 21B, the physical center point of the first radiating source 210B is surrounded by the radiating connection points 21B thereof. When the second radiating source 220B has one radiating connection point 21B, the radiating connection point 21B of the second radiating source 220B is defined as the physical center point thereof. When the second radiating source 220B has two or more radiating connection points 21B, the physical center point of the second radiating source 220B is surrounded by the radiating connection points 21B thereof. When the third radiating source 230B has one radiating connection point 21B, the radiating connection point 21B of the third radiating source 230B is defined as the physical center point thereof. When the third radiating source 230B has two or more radiating connection points 21B, the physical center point of the third radiating source 230B is surrounded by the radiating connection points 21B thereof. When the fourth radiating source 240B has one radiating connection point 21B, the radiating connection point 21B of the fourth radiating source 240B is defined as the physical center point thereof. When the fourth radiating source 240B has two or more radiating connection points 21B, the physical center point of the fourth radiating source 240B is surrounded by the radiating connection points 21B thereof.

As shown in FIGS. 11 and 12, the antenna further comprises at least four electrical connection elements 40B, wherein at least one of the electrical connection elements 40B has two terminal ends electrically connecting with the radiating connection point 21B of the first radiating source 210B and the reference ground connection point 11B of the reference ground 10B respectively, so as to electrically connect the first radiating source 210B with the reference ground 10B. At least one of the electrical connection elements 40B has two terminal ends electrically connecting with the radiating connection point 21B of the second radiating source 220B and the reference ground connection point 11B of the reference ground 10B respectively, so as to electrically connect the second radiating source 220B with the reference ground 10B. At least one of the electrical connection elements 40B has two terminal ends electrically connecting with the radiating connection point 21B of the third radiating source 230B and the reference ground connection point 11B of the reference ground 10B respectively, so as to electrically connect the third radiating source 230B with the reference ground 10B. At least one of the electrical connection elements 40B has two terminal ends electrically connecting with the radiating connection point 21B of the fourth radiating source 240B and the reference ground connection point 11B of the reference ground 10B respectively, so as to electrically connect the fourth radiating source 240B with the reference ground 10B.

As shown in FIGS. 11 and 12, the antenna further comprises a shield member 50B coupled at the reference ground 10B at the second side 102B thereof.

It is appreciated that different components (elements) as described in the above first, second, third and fourth naming elements should not have any distinguish between different parts, elements, and structures of the present invention. Unless it is specified otherwise, the order or the number of the component should not be limited. Specifically, in this specific example of the antenna shown in FIGS. 11 and 12, the first radiating source 210B, the second radiating source 220B, the third radiating source 230B and the fourth radiating source 240B are only used to describe different locations of the radiating source 20B at different positions of the present invention, which does not refer to the order or the number of the radiating sources 20B.

Figure 13:
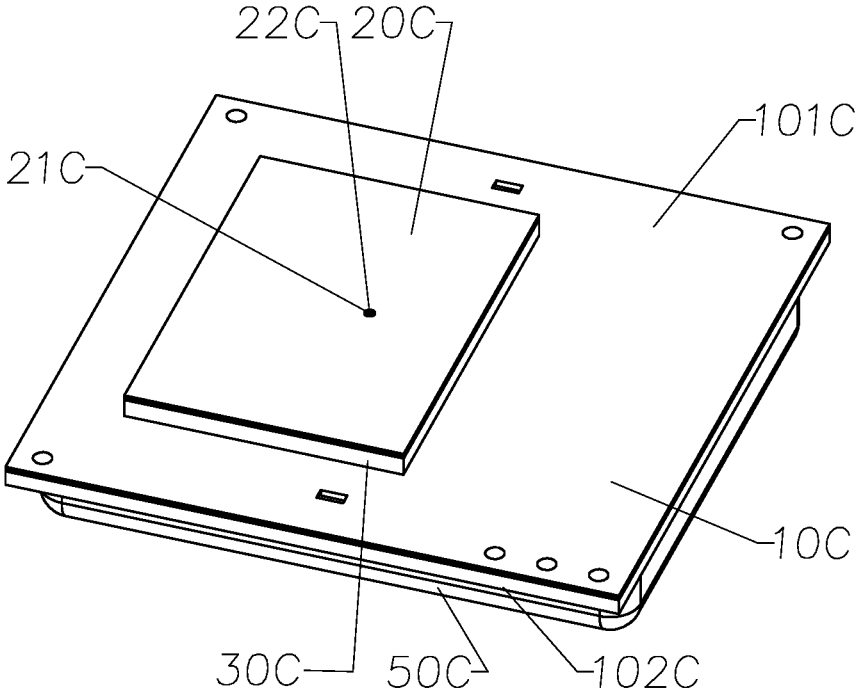
FIG. 13 is a perspective view of an antenna with an anti-interference arrangement according to a fourth preferred embodiment of the present invention.
Figure 14:
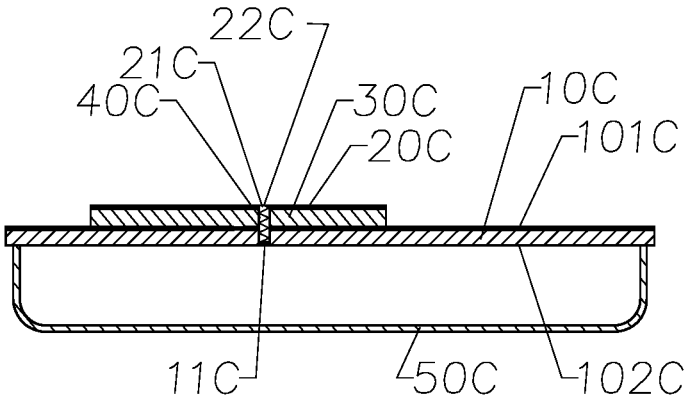
FIG. 14 is a sectional view of the antenna according to the above fourth preferred embodiment of the present invention.

FIGS. 13 and 14 illustrate the fourth embodiment of the present invention as another alternative mode thereof, wherein the antenna comprises a reference ground 10C and at least a radiating source 20C. The radiating source 20C is disposed adjacent to the reference ground 10C to define a radiating clearance 30C between the radiating source 20C and the reference ground 10C. Accordingly, at least one radiating source 20C is electrically connected to the reference ground 10C.

In particular, the reference ground 10C has a first side 101C and an opposed second side 102C, wherein the radiating source 20C is disposed at the first side 101C of the radiating source 20C.

As shown in FIGS. 13 and 14, the radiating source 20C has one radiating connection point 21C and a feed point 22C, wherein the radiating connection point 21C is overlapped with the feed point 22C. The reference ground 10C has at least one reference ground connection point 11C. The antenna further comprises at least an electrical connection element 40B, wherein the electrical connection element 40B preferably is an inductor. The electrical connection element 40C has two terminal ends electrically connecting with the radiating connection point 21C of the radiating source 20C and the reference ground connection point 11C of the reference ground 10C respectively, so as to electrically connect the radiating source 20C with the reference ground 10C via the electrical connection element 40C. For example, the electrical connection element 40C, can be, but not limited to, a curved connection type inductor or a threaded connection type inductor. After the excitation current is received at the feed point 22C of the radiating source 20C, the antenna is initialized at a polarization direction at the radiating source 20C to stably generate the radiate energy in a radial and outward direction. Since the radiating source 20C is electrically connected to the reference ground 10C by the electrical connection element 40C, the impedance of the antenna will be lowered after the excitation current is received at the feed point 22C of the radiating source 20C. Therefore, the bandwidth of the antenna will be narrowed down to prevent the electromagnetic wave signals received or generated by the antenna from being interfered by the nearby electromagnetic radiation frequency or the stray radiation frequency, so as to enhance the anti-interference ability of the antenna.

Figure 15:
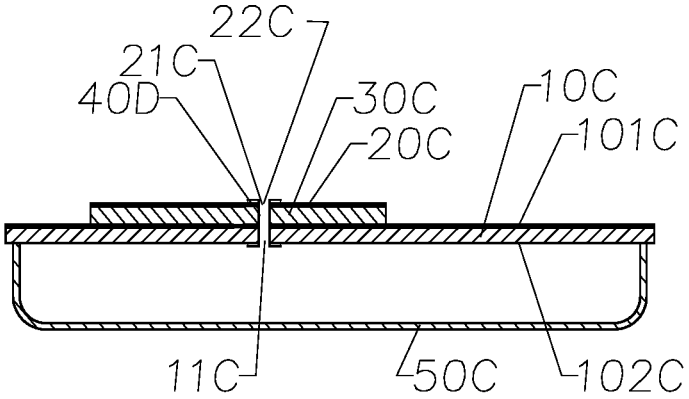
FIG. 15 illustrates an alternative mode of the antenna according to the above fourth preferred embodiment of the present invention.

Alternatively, the radiating source 20C and the reference ground 10C are electrically connected with each other via the electrical connection element 40D, wherein a slot is formed at the reference ground 10C and a metal layer is formed at a wall of the slot to form a metallization slot as the electrical connection element 40D to electrically connect the radiating source 20C with the reference ground 10C as shown in FIG. 15. It is worth mentioning that the feed point of the antenna is electrically connected to the oscillating circuit by the electrical connection element 40D.

According to the preferred embodiment, the present invention further comprises a method of manufacturing the antenna, which comprises the following steps.

(a) Form the radiating clearance 30 between the radiating source 20 and the reference ground 10, wherein the radiating source 20 is spacedly disposed at the first side 101 of the reference ground 10.

(b) Ground the radiating source 20 to form the antenna.

Accordingly, in the step (b), the radiating source 20 is electrically connected to the reference ground 10, such that the radiating source 20 is grounded.

It is worth mentioning that the step (b) can be performed prior to the step (a). In other words, the radiating source 20 is electrically connected to the reference ground 10 first and then the radiating source 20 is spacedly retain at the first side 101 of the reference ground 10.

In the step (a), a solid media is placed on the first side 101 of the reference ground 10, wherein the radiating source 20 is then disposed on the solid media to spacedly retain the radiating source 20 at the reference ground 10 so as to form the radiating clearance 30 between the radiating source 20 and the reference ground 10. Alternatively, the solid media can be placed at the radiating source 20, wherein the solid media is then disposed on the first side 101 of the reference ground 10 to spacedly retain the radiating source 20 at the reference ground 10 so as to form the radiating clearance 30 between the radiating source 20 and the reference ground 10.

The present invention further provides an anti-interference method for the antenna which comprises the steps of: grounding the radiating source 20 to reduce an internal impedance of the antenna; and receiving the excitation current at the feed point 22 of the radiating source 20 to narrow the bandwidth of the antenna, such that any interference of electromagnetic wave signals received or generated by the antenna of the present invention will be substantially reduced in response to the nearby electromagnetic radiation frequency or stray radiation frequency of the adjacent frequency bands.

Figure 16:
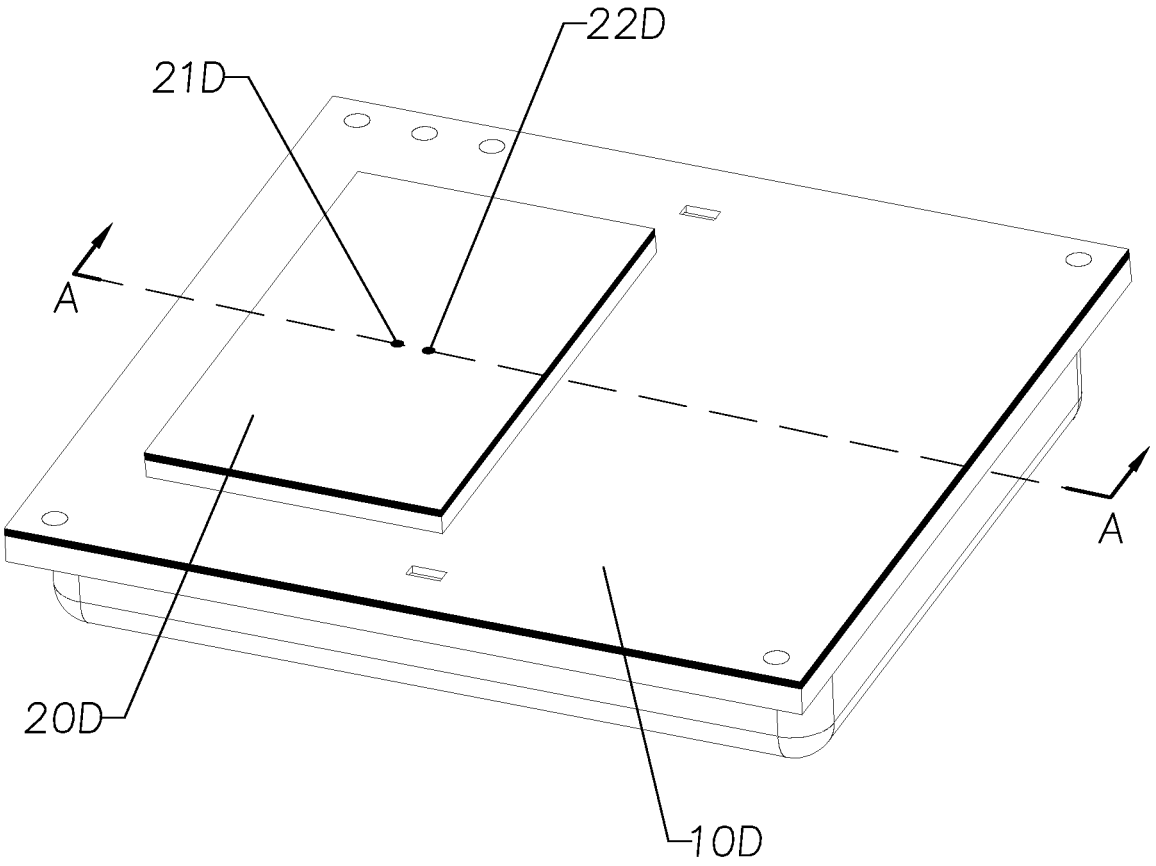
FIG. 16 is a perspective view of an antenna with a microwave driving circuit according to the preferred embodiment of the present invention.
Figure 17:
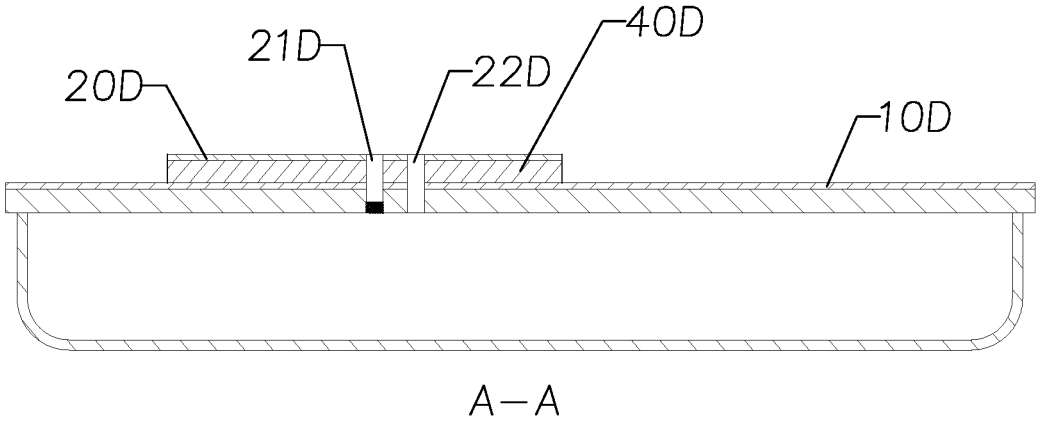
FIG. 17 is a sectional view of the antenna according to the above preferred embodiment of the present invention.

Referring to FIGS. 16 and 17 of the drawings, an antenna according to a preferred embodiment of the present invention is illustrated, wherein the antenna comprises a driving circuit to enhance the anti-interference ability of the antenna. The bandwidth of the antenna can be narrowed based on the reduction of emission power of the antenna to improve the anti-interference ability of the antenna. Accordingly, the antenna comprises a reference ground 10D, at least a radiating source 20D, and a microwave driving circuit 30D, wherein the radiating source 20D is spacedly disposed at the reference ground 10D to form an antenna body, wherein a space is formed between the reference ground 10D and the radiating source 20D as a radiating clearance 40D therebetween. The radiating source 20D is electrically grounded. The microwave driving circuit 30D is electrically connected to the radiating source 20D to supply a microwave excitation current and to obtain a detection signal by detecting a change of the microwave excitation current. Preferably, the microwave driving circuit 30D is set at the reference ground 10D by a printing process or an etching process.

It is worth mentioning that, as shown in FIGS. 16 and 17, the radiating source 20D is a plate-shaped radiation source, wherein the reference ground 10D and the radiating source 20D are parallel to each other for illustrative purpose and description, and the scope should be limited. For other examples, the radiating source 20D can be formed in cylindrical shape, and the radiating source 20D can be perpendicular to the reference ground 10D. In addition, when the radiating source 20D is implemented as a plate-shaped radiation source, the shape of the radiating source 20D may be, but not limited to, a square, a circle, an ellipse, or the like.

It is worth mentioning that, as shown in FIGS. 16 and 17, only one radiating source 20D is illustrated in the embodiment as an example for description to point out the features of the radiating source 20D. It should be understood that the number of radiating source 20D should not be limited and the scope of the antenna should not be limited by one radiating source 20D. For example, two or more radiating sources 20 could be provided in the antenna.

In addition, the radiating source 20D of the antenna is spaced apart from the reference ground 10D that a space is formed between the reference ground 10D and the radiating source 20D as a radiating clearance 40D therebetween. In other words, there is not direct contact between the reference ground 10D and the radiating source 20D. The radiating source 20D is set apart from the reference ground 10D to reserve the space therebetween as the radiating clearance 40D.

It should be understood that the radiating clearance 40D between the radiating source 20D and the reference ground 10D is a solid media. For example, a dielectric layer is formed between the reference ground 10D and the radiating source 20D and is connected between the reference ground 10D and the radiating source 20D, such that the radiating source 20D is disposed adjacent to the reference ground 10D to form the radiating clearance 40D via the dielectric layer.

As shown in FIGS. 16 and 17, the radiating source 20D is electrically connected to the reference ground 10D, wherein the radiating source 20D is electrically grounded, such that the impedance of the antenna will be greatly reduced to narrow the bandwidth of the antenna. In other words, the impedance of the antenna will be reduced and the bandwidth of the antenna will be narrowed down such that any interference of electromagnetic wave signals received or generated by the antenna of the present invention will be substantially reduced in response to the nearby electromagnetic radiation frequency or stray radiation frequency of the adjacent frequency bands.

Furthermore, the reference ground 10D has a reference ground connection point 11D and the radiating source 20D has a radiating connection point 21D, wherein the radiating connection point 21D of the radiating source 20D is electrically connected to the reference ground connection point 11D of the reference ground 10D to electrically connect the radiating source 20D with the reference ground 10D so as to ground the radiating source 20D. The connection method between the radiating connection point 21D of the radiating source 20D and the reference ground connection point 11D of the reference ground 10D is not limited. For example, the electrical connection can be formed by metallization via slot process to electrically connect the radiating connection point 21D of the radiating source 20D with the reference ground connection point 11D of the reference ground 10D.

The radiating source 20D further has a feed point 22D, wherein the microwave driving circuit 30D is electrically connected to the feed point 22D of the radiating source 20D to excite the microwave excitation current to the radiating source 20D through the microwave driving circuit 30D, so as to generate a microwave signal to the antenna.

When the microwave excitation current is supplied to the radiating source 20D through the feed point 22D thereof, the microwave antenna will generate an initial polarization direction and radiating energy outwardly from the radiating source 20D. The radiating connection point 21D of the radiating source 20D is electrically connected to the reference ground connection point 11D of the reference ground 10D to electrically ground the radiating source 20D. When the microwave excitation current is supplied to the radiating source 20D through the feed point 22D thereof, the electromagnetic wave signal will generate the inductance characteristics between the radiating connection point 21D and the feed point 22D of the radiating source 20D to have a predetermined impedance, such that the antenna can be excited to generate the initial polarization direction. In other words, the antenna can be energized to generate the initial polarization direction, such that the radiating energy is generated outwardly from the radiating source 20D to generate the microwave signal. At the same time, the electrical connection between the radiating connection point 21D of the radiating source 20D and the reference ground connection point 11D of the reference ground 10D is formed to lower the impedance due to the inductance characteristics, so as to narrow down the bandwidth of the antenna, such that any interference of electromagnetic wave signals received or generated by the antenna of the present invention will be substantially reduced in response to the nearby electromagnetic radiation frequency or stray radiation frequency of the adjacent frequency bands.

Preferably, a distance between the radiating connection point 21D and the feed point 22D of the radiating source 20D is greater than or equal to $\frac{1}{64}\lambda$, where $\lambda$ is the wavelength of the electromagnetic wave signal received or generated by the antenna. Under the excitation of the excitation electrical signal, the electromagnetic wave signal will generate the inductance characteristics between the radiating connection point 21D and the feed point 22D of the radiating source 20D. Since the feed point 22D of the radiating source 20D is deviated from the physical center point thereof, the intensity required for the microwave excitation current of the antenna to the electromagnetic wave signal will be substantially reduced. As a result, once the excitation current is received by the feed point 22D of the radiating source 20D, the antenna is easily initialized at a polarization direction. The microwave driving circuit 30D is a low impedance circuit to match with the low impedance of the antenna, such that the microwave driving circuit 30D can further lower the impedance of the antenna to lower the power emission requirement of the antenna. When the microwave driving circuit 30D, having the low impedance, supplies the microwave excitation current to the radiating source 20D through the feed point 22D thereof, the antenna is able to generate the initial polarization direction. As the low impedance of the antenna, the bandwidth of the antenna will be narrowed down, such that any interference of electromagnetic wave signals received or generated by the antenna of the present invention will be substantially reduced in response to the nearby electromagnetic radiation frequency or stray radiation frequency of the adjacent frequency bands.

Figure 18:
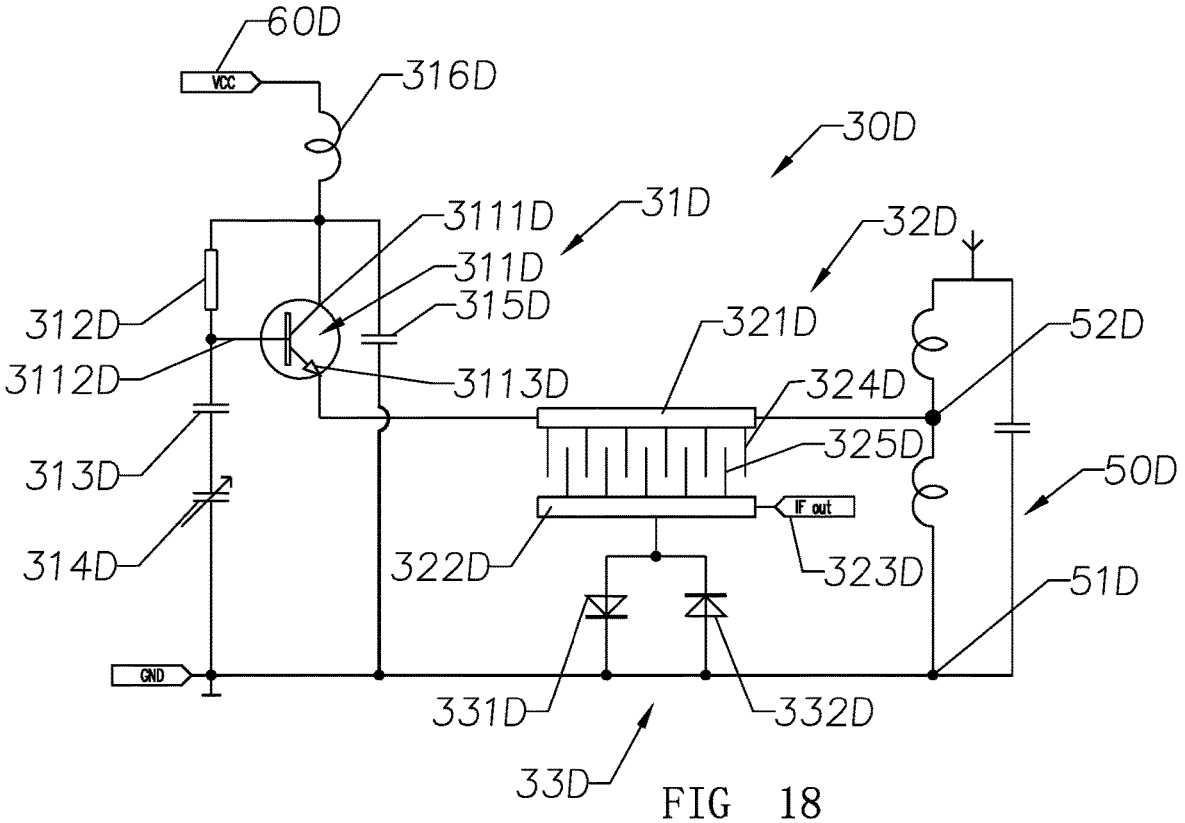
FIG. 18 is a circuit diagram of the microwave driving circuit according to the preferred embodiment of the present invention.

Particularly, the antenna further comprises an analog circuit 50D as shown in FIG. 18. Under the excitation of the excitation electrical signal, the analog circuit 50D is electrically connected to the reference ground connection point 11D of the reference ground 10D and the radiating connection point 21D of the radiating source 20D when the microwave excitation current is supplied the microwave driving circuit 30D. Accordingly, the analog circuit 50D comprises a first analog point 51D analogously representing to the radiating connection point 21D of the radiating source 20D and a second analog point 52D analogously representing to the feed point 22D of the radiating source 20D. The microwave driving circuit 30D is electrically connected to the second analog point 52D of the analog circuit 50D. In other words, the microwave driving circuit 30D supplies the microwave excitation current to the analog circuit 50D from the second analog point 52D thereof.

It is worth mentioning that the radiating source 20D is electrically connected to the reference ground 10D to ground the radiating source 20D, wherein the high frequency microwave excitation current passes to the reference ground 10D and the feed point 22D of the radiating source 20D will equivalent to that to the analog circuit 50D.

Accordingly, the structure between the reference ground 10D and the radiating source 20D can be varied as long as the structural configuration thereof satisfies the requirement of the high frequency microwave excitation current to the feed point 22D of the radiating source 20D being equivalent to that to the analog circuit 50D. In other words, the microwave driving circuit of the present invention will match with the configuration of the high frequency microwave excitation current to the feed point 22D of the radiating source 20D being equivalent to that to the analog circuit 50D.

Accordingly, the microwave driving circuit 30D is embodied as the anti-interference circuit 60. As shown in FIG. 18, the microwave driving circuit 30D comprises an oscillation circuit module 31D, a coupler 32D and a mixing detection circuit module 33D which is embodied as the mixing detection circuit module 62. The coupler 32D comprises a first coupling member 321D and a second coupling member 322D being inducted and coupled to the first coupling member 321D. One end of the first coupling member 321D is electrically connected to the oscillation circuit module 31D while another end of the first coupling member 321D is electrically connected to the feed point 22D of the radiating source 20D. Accordingly, the oscillation circuit module 31D is electrically grounded. The mixing detection circuit module 33D is electrically connected to the second coupling member 322D. As shown in FIG. 18, one end of the first coupling member 321D of the coupler 32D is electrically connected to the second analog point 52D of the analog circuit 50D.

The oscillation circuit module 31D can be electrically connected to a power source 60D, wherein the current of the power source 60D is oscillated to form the microwave excitation current. The oscillation circuit module 31D is able to supply the microwave excitation current directly to the radiating source 20D via the feed point 22D thereof through the first coupling member 321D of the coupler 32D. The microwave signal is generated by the connection between the radiating source 20D and the reference ground 10D. The second coupling member 322D is inducted and coupled to the first coupling member 321D to obtain the variation of the microwave excitation current to the radiating source 20D through the first coupling member 321D. Then, the mixing detection circuit module 33D and the second coupling member 322D will cooperate with each other to obtain the detection signal.

As an example of the embodiment, the current provided from the power source 60D will firstly pass through the oscillation circuit module 31D to be oscillated by the oscillation circuit module 31D so as to form the microwave excitation current. Then, the oscillation circuit module 31D will guide the current to the radiating source 20D via the feed point 22D thereof through the first coupling member 321D of the coupler 32D, such that the radiating source 20D will cooperate with the reference ground 10D to generate the microwave signal so as to form a detection zone. When an object, such as a user, enters into the detection zone to cause a change of the microwave signal, the microwave excitation current will be changed when it passes to the radiating source 20D via the feed point 22D thereof through the first coupling member 321D of the coupler 32D. Then, the change of the microwave excitation current to the radiating source 20D will be obtained by inducting and coupling the second coupling member 322D to the first coupling member 321D. Subsequently, the mixing detection circuit module 33D and the second coupling member 322D will cooperate with each other to obtain the detection signal so as to detect the status of the user in the detection zone. For example, the antenna of the present invention is able to detach the user movement within the detection zone.

As shown in FIG. 18, the mixing detection circuit module 33D has a signal output terminal 323D, wherein the signal output terminal 323D is set and extended out from the second coupling member 322D for outputting the detection signal. The type of the signal output terminal 323D should not be limited as long as it can output the detection signal.

As shown in FIG. 18, the oscillation circuit module 31D comprises a triode circuit processor 311D, a bias resistor 312D, a first capacitor 313D, a second capacitor 314D, and a third capacitor 315D. The triode circuit processor 311D has a first connection terminal 3111D, a second connection terminal 3112D, and a third connection terminal 3113D, wherein the first connection terminal 3111D of the triode circuit processor 311D is electrically connected to the power source 60D. Two ends of the bias resistor 312D are electrically connected to the first and second connection terminals 3111D, 3112D of the triode circuit processor 311D respectively. Two ends of the first capacitor 313D are electrically connected to the second connection terminal 3112D of the triode circuit processor 311D and one end of the second capacitor 314D respectively. Another end of the second capacitor 314D is electrically grounded as a grounded end thereof. Two ends of the third capacitor 315D are electrically connected to the first connection terminal 3111D of the triode circuit processor 311D and the grounded end of the second capacitor 314D. The third connection terminal 3113D of the triode circuit processor 311D is electrically connected to the first coupling member 321D of the coupler 32D.

In other words, the bias resistor 312D is set at the first connection terminal 3111D and the second connection terminal 3112D to electrically connect to the triode circuit processor 311D in a parallel connection, such that the second connection terminal 3112D of the triode circuit processor 311D provides a bias current to the first connection terminal 3111D. It can be understood that the bias resistor 312D is in form of resistance, as shown in the drawings, wherein the bias resistor 312D can be a plurality of resistors connected in series connection or in parallel connection, such that the bias resistor 312D is set at the first connection terminal 3111D and the second connection terminal 3112D to electrically connect to the triode circuit processor 311D in a parallel connection. The electrical and physical properties of the bias resistor 312D should not be limited in the present invention.

It is worth mentioning that the first capacitor 313D and the third capacitor 315D, as shown in the drawings, are in form of capacitance, wherein each of the first capacitor 313D and the third capacitor 315D can be a capacitor component or a distributed capacitor being connected to the reference ground 10D via a micro-strip line. The electrical and physical properties of each of the first capacitor 313D and the third capacitor 315D should not be limited in the present invention.

In addition, the oscillation circuit module 31D further comprises an inductor 316D, wherein one end of the inductor 316D is electrically connected to the first connection terminal 3111D of the triode circuit processor 311D, while another end of the inductor 316D is electrically connected to the power source 60D.

According to the preferred embodiment, the triode circuit processor 311D is embodied as a semiconductor MOS transistor, wherein the third connection terminal 3113D of the triode circuit processor 311D is a source terminal of the semiconductor MOS transistor. In other words, the source terminal of the semiconductor MOS transistor as the oscillation circuit module 31D is electrically connected to one end of the first coupling member 321D of the coupler 32D. Therefore, the oscillation circuit module 31D will oscillate the current supplied from the power source 60D to form the microwave excitation current, such that the microwave excitation current will flow from the source terminal of the semiconductor MOS transistor to the first coupling member 321D and then to the radiating source 20D from the feed point 22D thereof.

In another embodiment, the triode circuit processor 311D is embodied as a semiconductor transistor, wherein the third connection terminal 3113D of the triode circuit processor 311D is an emitter of the semiconductor transistor. In other words, the emitter of the semiconductor transistor as the oscillation circuit module 31D is electrically connected to one end of the first coupling member 321D of the coupler 32D. Therefore, the oscillation circuit module 31D will oscillate the current supplied from the power source 60D to form the microwave excitation current, such that the microwave excitation current will flow from the emitter of the semiconductor transistor to the first coupling member 321D and then to the radiating source 20D from the feed point 22D thereof.

In other words, the third connection terminal 3113D forms a junction terminal of the triode circuit processor 311D as a port for collectively merging the current, such that the triode circuit processor 311D is able to provide a relatively large microwave excitation current to match with the low impedance of the antenna so as to lower the power emission requirement of the antenna. Unlike the above embodiment, the third connection terminal 3113D is directly connected to the feed point 22D without connecting through any capacitor. In other words, the current output to the feed point 22D without any induction of the capacitor in order to obtain a larger excitation current, so as to lower the impedance of the oscillation circuit. At the same time, through the electric field and/or magnetic field induction of the coupler 32D, the mixing detection circuit module 33D will output the current change signal.

It is worth mentioning that there is a difference between the oscillation circuit module 31D of the present invention and the conventional oscillation circuit for providing the excitation current for the antenna. The oscillation circuit module 31D of the present invention is configured that the junction terminal of the triode circuit processor 311D forms an output terminal of the microwave excitation current to obtain a relatively large current output. Other than the triode circuit processor 311D, the electrical configuration of the oscillation circuit module 31D should not be limited in the present invention. The oscillation circuit module 31D can be a three-point circuit structure while the junction terminal of the triode circuit processor 311D forms the output terminal of the microwave excitation current.

As shown in FIG. 18, the mixing detection circuit module 33D comprises a first diode 331D and a second diode 332D, wherein one end of the first diode 331D and one end of the second diode 332D are electrically connected to the second coupling member 322D of the coupler 32D. Another end of the first diode 331D is electrically connected to another end of the second diode 332D. FIG. 18 illustrates the preferred circuit diagram of the microwave driving circuit 30D. Preferably, one end of the first diode 331D and one end of the second diode 332D are electrically connected to the second coupling member 322D of the coupler 32D as a common end thereof. Preferably, the direction of the first diode 331D is different from that of the second diode 332D. Through this configuration, the second coupling member 322D can induce the change of the microwave excitation current when passing through the first coupling member 321D. The first and second diodes 331D, 332D of the mixing detection circuit module 33D can convert the change of the microwave excitation current into a detection signal. Then, the detection signal can be sent out through the output terminal 323 from the second coupling member 322D.

As shown in FIG. 18, the first coupling member 321D and the second coupling member 322D of the coupler 32D are impedance lines respectively. The first coupling member 321D and the second coupling member 322D of the coupler 32D are set adjacent with each other and parallel with each other, such that the first coupling member 321D and the second coupling member 322D are inducted and coupled with each other. As a result, the second coupling member 322D can induce the change of the microwave excitation current when passing through the first coupling member 321D. It is worth mentioning that, as shown in FIG. 18 of the microwave driving circuit 30D, the first coupling member 321D and the second coupling member 322D are coupled with each other via an electromagnetic coupling connection, such that the second coupling member 322D can induce the change of the microwave excitation current when passing through the first coupling member 321D.

It is worth mentioning that the first coupling member 321D and the second coupling member 322D are electronic components having impedance properties under the microwave excitation current. For example, each of the first coupling member 321D and the second coupling member 322D can be one of a resistor element, an inductor element, and capacitor element. In particular to the FIG. 18 of the microwave driving circuit 30D, the first coupling member 321D and the second coupling member 322D are impedance lines that the impedance lines of the first coupling member 321D and the second coupling member 322D are configured adjacent to each other and are extended parallel with each other. In other words, the first coupling member 321D and the second coupling member 322D are connected in an induction manner.

Furthermore, the coupler 32D further comprises a plurality of first row extending micro-strip lines 324D and a plurality of second row extending micro-strip lines 325D. Each of the first row extending micro-strip lines 324D is electrically connected to the first coupling member 321D and is extended at a direction from the first coupling member 321D to the second coupling member 322D. Each of the second row extending micro-strip lines 325D is electrically connected to the second coupling member 322D and is extended at a direction from the second coupling member 322D to the first coupling member 321D. The first row extending micro-strip lines 324D and the second row extending micro-strip lines 325D are intersected with each other that the first row extending micro-strip lines 324D and the second row extending micro-strip lines 325D are inducted and connected with each other. Through this configuration, the induction between the first row extending micro-strip lines 324D and the second row extending micro-strip lines 325D will be enhanced. Preferably, at least one of the first row extending micro-strip lines 324D is disposed and retained between any two of the adjacent second row extending micro-strip lines 325D. At least one of the second row extending micro-strip lines 325D is disposed and retained between any two of the adjacent first row extending micro-strip lines 324D, correspondingly. Preferably, the number of the first row extending micro-strip lines 324D is more than the number of the second row extending micro-strip lines 325D, such that at least one of the second row extending micro-strip lines 325D is disposed and retained between two of the adjacent first row extending micro-strip lines 324D.

As shown in FIG. 18, the first row extending micro-strip lines 324D are extended from the first coupling member 321D toward the second coupling member 322D to form a micro strip configuration. Correspondingly, the second row extending micro-strip lines 325D are extended from the second coupling member 322D toward the first coupling member 321D to form a micro strip configuration.

Figure 19:
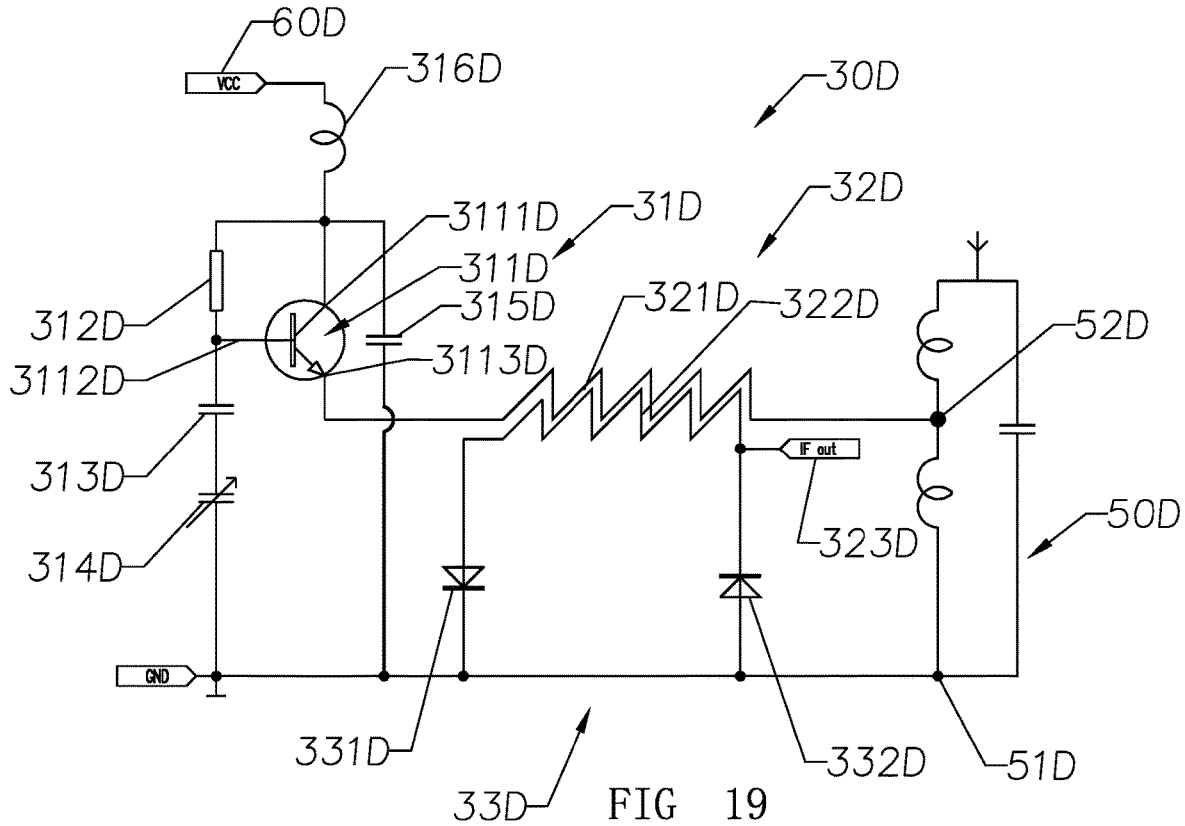
FIG. 19 is a circuit diagram illustrating a first alternative mode of the microwave driving circuit according to the preferred embodiment of the present invention.
Figure 20:
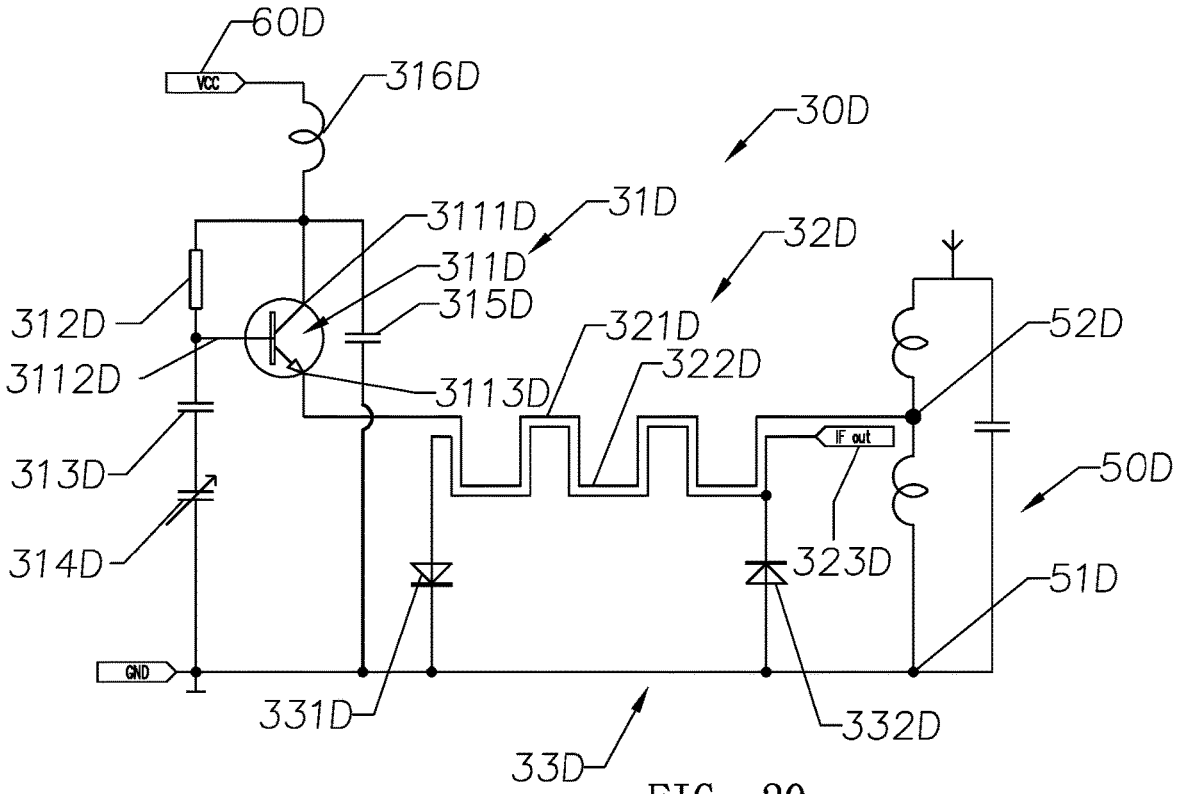
FIG. 20 is a circuit diagram illustrating a second alternative mode of the microwave driving circuit according to the preferred embodiment of the present invention.

FIGS. 19 and 20 illustrate first and second alternative modes of the microwave driving circuit 30D. The difference of the microwave driving circuit 30D in FIGS. 18 to 20 is that the first coupling member 32 and the second coupling member 322D in FIGS. 19 and 20 are embodied as bent micro-strip lines respectively, wherein the first coupling member 321D and the second coupling member 322D are positioned adjacent to each other and are extended parallel to each other, so as to enable the first coupling member 321D and the second coupling member 322D being inducted and coupled with each other. Therefore, the second coupling member 322D can induce the change of the microwave excitation current when passing through the first coupling member 321D. Correspondingly, as shown in FIG. 19, the induction connection between the first coupling member 321D and the second coupling member 322D is an electromagnetic coupling connection, such that the second coupling member 322D can induce the change of the microwave excitation current when passing through the first coupling member 321D.

Furthermore, one end of the first diode 331D and one end of the second diode 332D are electrically connected to two ends of the second coupling portion 322, respectively, wherein the direction of the first diode 331D is different from that of the second diode 332D, such that the second coupling member 322D can induce the change of the microwave excitation current when passing through the first coupling member 321D. The first diode 331D and the second diode 332D of the mixing detection circuit module 33D are able to process and convert a change in microwave excitation current into the detection signal. Then, the detection signal can be sent out through the output terminal 323 from the second coupling member 322D.

It is important that there is a difference of the microwave driving circuit 30D in FIGS. 19 and 20. In FIG. 19, the first coupling member 321D and the second coupling member 322D are embodied as saw-tooth micro-strip lines respectively. In other words, the saw-tooth micro-strip line of each of the first coupling member 321D and the second coupling member 322D is formed by a plurality of saw-tooth line segments, wherein an angle between two adjacent saw-tooth line segments is an acute angle. In FIG. 20, first coupling member 321D and the second coupling member 322D are embodied as square micro-strip lines respectively. In other words, the square micro-strip line of each of the first coupling member 321D and the second coupling member 322D is formed by a plurality of line segments, wherein an angle between two adjacent line segments is formed at 90°.

Figure 21:
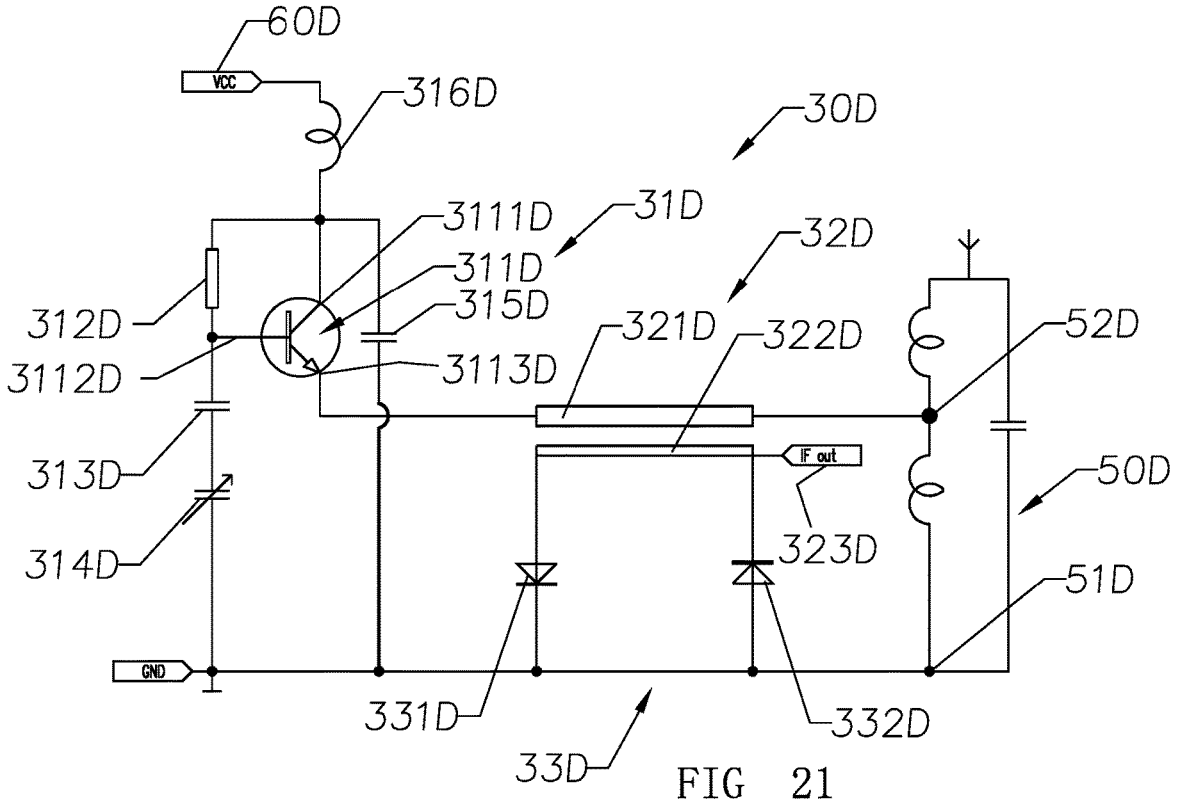
FIG. 21 is a circuit diagram illustrating a third alternative mode of the microwave driving circuit according to the preferred embodiment of the present invention.

FIG. 21 illustrates a third alternative mode of the microwave driving circuit 30D which is a modified circuit in FIG. 18. As shown in FIG. 21, the coupler 32D does not set with the first row extending micro-strip lines 324D and the second row extending micro-strip lines 325D. The induction connection between the first coupling member 321D and the second coupling member 322D is formed by reducing a distance between the first coupling member 321D and the second coupling member 322D, such that the second coupling member 322D can induce the change of the microwave excitation current when passing through the first coupling member 321D. Correspondingly, as shown in FIG. 21, the first coupling member 321D and the second coupling member 322D are connected in an electromagnetic coupling manner, such that the second coupling member 322D can induce the change of the microwave excitation current when passing through the first coupling member 321D.

In addition, one end of the first diode 331D and one end of the second diode 332D are electrically connected to two ends of the second coupling portion 322, respectively, wherein a direction of the first diode 331D is different from that of the second diode 332D, such that the second coupling member 322D can induce the change of the microwave excitation current when passing through the first coupling member 321D. The first diode 331D and the second diode 332D of the mixing detection circuit module 33D are able to process and convert a change in microwave excitation current into the detection signal. Then, the detection signal can be sent out through the output terminal 323 from the second coupling member 322D.

Figure 22:
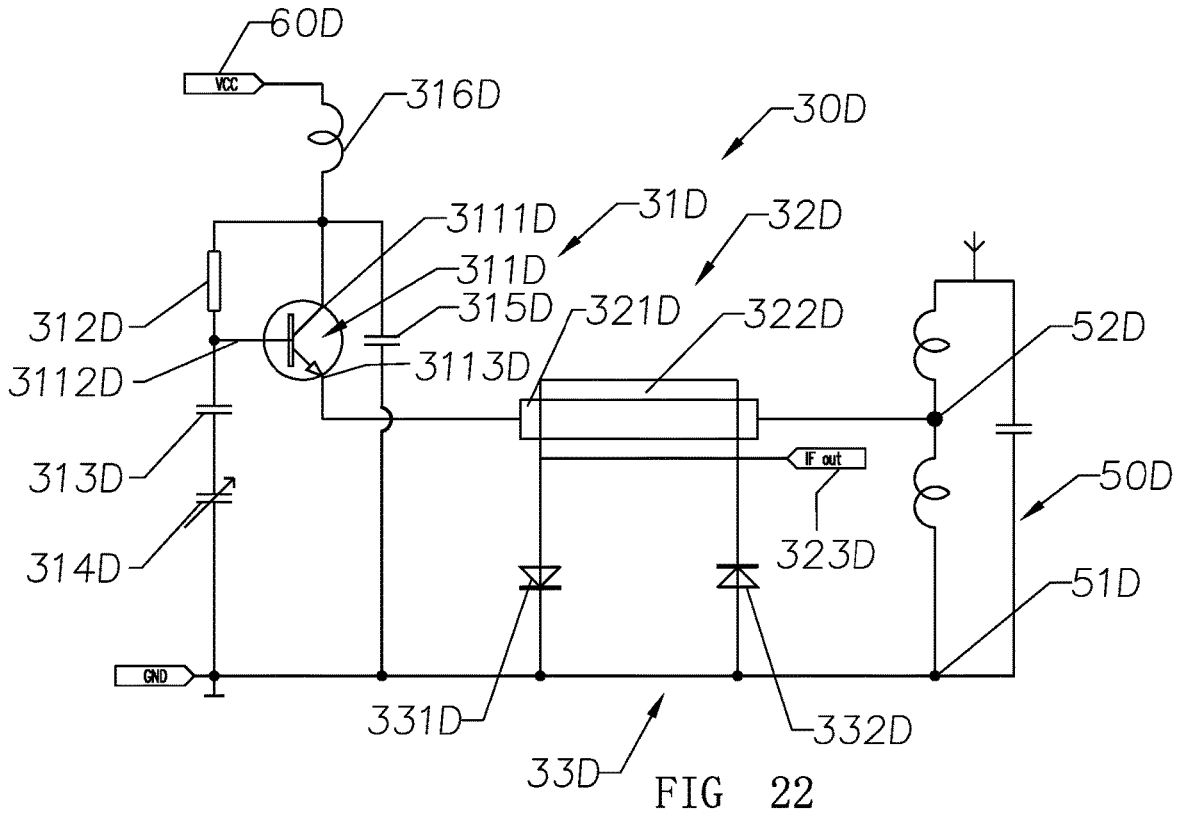
FIG. 22 is a circuit diagram illustrating a fourth alternative mode of the microwave driving circuit according to the preferred embodiment of the present invention.

FIG. 22 illustrates a fourth alternative mode of the microwave driving circuit 30D which is a modified circuit in FIG. 21. As shown in FIG. 22, the first coupling member 321D is an impedance line, such as a micro-strip line formed on a circuit board, while the second coupling member 322D is a metal foil that surrounds a half circumference of the first coupling member 321D. For example, the second coupling member 322D can be, but not limited to, copper foil. Through this configuration, the second coupling member 322D can be inducted and connected to the first coupling member 321D.

Figure 23:
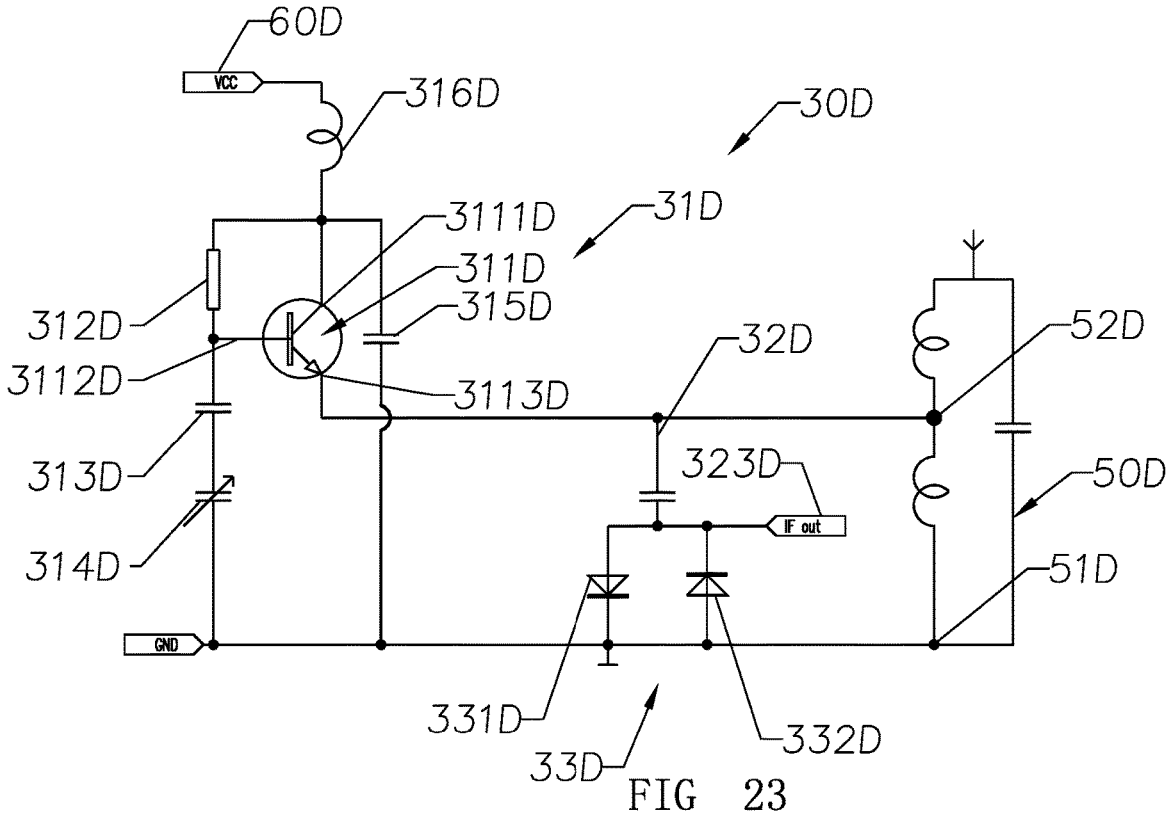
FIG. 23 is a circuit diagram of the microwave driving circuit according to a second preferred embodiment of the present invention.

As shown in FIG. 23, the microwave driving circuit 30D according to an another embodiment illustrates another alternative mode thereof, wherein the microwave driving circuit 30D comprises an oscillation circuit module 31D, a coupler 32D and a mixing detection circuit module 33D. The oscillation circuit module 31D is electrically connected to the feed point 22D of the radiating source 20D. One end of the coupler 32D is electrically connected to the oscillation circuit module 31D and the feed point 22D of the radiating source 20D while another end of the coupler 32D is electrically connected to the mixing detection circuit module 33D. As shown in FIG. 23, the coupler 32D is electrically connected to the second analog point 52D of the analog circuit 50D.

The oscillation circuit module 31D can be electrically connected to the power source 60D, wherein the current of the power source 60D is oscillated when passing through the oscillation circuit module 31D to form the microwave excitation current. The oscillation circuit module 31D is able to supply the microwave excitation current directly to the radiating source 20D via the feed point 22D thereof, so as to enable the radiating source 20D cooperating with the reference ground 10D to generate the microwave signal. The coupler 32D is able to obtain a change in the microwave excitation current supplied from the oscillation circuit module 31D to the radiating source 20D, so that the mixing detection circuit module 33D and the coupler 32D will cooperate with each other to obtain the detection signal.

As an example of the embodiment, the current provided from the power source 60D will firstly pass through the oscillation circuit module 31D to be oscillated by the oscillation circuit module 31D so as to form the microwave excitation current. Then, the oscillation circuit module 31D will guide the current to the radiating source 20D via the feed point 22D thereof, such that the radiating source 20D will cooperate with the reference ground 10D to generate the microwave signal so as to form a detection zone. When an object, such as a user, enters into the detection zone to cause a change of the microwave signal, the microwave excitation current will be changed when it passes to the radiating source 20D via the feed point 22D thereof. Then, the change of the microwave excitation current to the radiating source 20D will be obtained by the coupler 32D. Subsequently, the mixing detection circuit module 33D and the coupler 32D will cooperate with each other to obtain the detection signal so as to detect the status of the user in the detection zone. For example, the antenna of the present invention is able to detach the user movement within the detection zone.

As shown in FIG. 23, the coupler 32D is preferably a capacitor, such that the coupler 32D is embodied as a capacitive coupler. Accordingly, the mixing detection circuit module 33D has a signal output terminal 323D for outputting the detection signal. The type of the signal output terminal 323D should not be limited as long as it can output the detection signal.

As shown in FIG. 23, the oscillation circuit module 31D comprises a triode circuit processor 311D, a bias resistor 312D, a first capacitor 313D, a second capacitor 314D, and a third capacitor 315D. The triode circuit processor 311D has a first connection terminal 3111D, a second connection terminal 3112D, and a third connection terminal 3113D, wherein the first connection terminal 3111D of the triode circuit processor 311D is electrically connected to the power source 60D. Two ends of the bias resistor 312D are electrically connected to the first and second connection terminals 3111D, 3112D of the triode circuit processor 311D respectively. Two ends of the first capacitor 313D are electrically connected to the second connection terminal 3112D of the triode circuit processor 311D and one end of the second capacitor 314D respectively. Another end of the second capacitor 314D is electrically grounded as a grounded end thereof. Two ends of the third capacitor 315D are electrically connected to the first connection terminal 3111D of the triode circuit processor 311D and the grounded end of the second capacitor 314D. The third connection terminal 3113D of the triode circuit processor 311D is electrically connected to the feed point 22D of the radiating source 20D.

In addition, the oscillation circuit module 31D further comprises an inductor 316D, wherein one end of the inductor 316D is electrically connected to the first connection terminal 3111D of the triode circuit processor 311D, while another end of the inductor 316D is electrically connected to the power source 60D.

According to the preferred embodiment, the triode circuit processor 311D is embodied as a semiconductor MOS transistor, wherein the third connection terminal 3113D of the triode circuit processor 311D is a source terminal of the semiconductor MOS transistor. In other words, the source terminal of the semiconductor MOS transistor as the oscillation circuit module 31D is electrically connected to the feed point 22D of the radiating source 20D. Therefore, the oscillation circuit module 31D will oscillate the current supplied from the power source 60D to form the microwave excitation current, such that the microwave excitation current will flow from the source terminal of the semiconductor MOS transistor to the radiating source 20D.

In another embodiment, the triode circuit processor 311D is embodied as a semiconductor transistor, wherein the third connection terminal 3113D of the triode circuit processor 311D is an emitter of the semiconductor transistor. In other words, the emitter of the semiconductor transistor as the oscillation circuit module 31D is electrically connected to the feed point 22D of the radiating source 20D. Therefore, the oscillation circuit module 31D will oscillate the current supplied from the power source 60D to form the microwave excitation current, such that the microwave excitation current will flow from the emitter of the semiconductor transistor to the radiating source 20D.

As shown in FIG. 23, the mixing detection circuit module 33D comprises a first diode 331D and a second diode 332D, wherein one end of the first diode 331D and one end of the second diode 332D are electrically connected to the second coupling member 322D of the coupler 32D. Preferably, a direction of the first diode 331D is different from that of the second diode 332D. Through this configuration, after the coupler 32D can obtain the change of the microwave excitation current, the first and second diodes 331, 332 of the mixing detection circuit module 33D can convert the change of the microwave excitation current into the detection signal. Then, the detection signal can be sent out through the output terminal 323.

Figure 24:
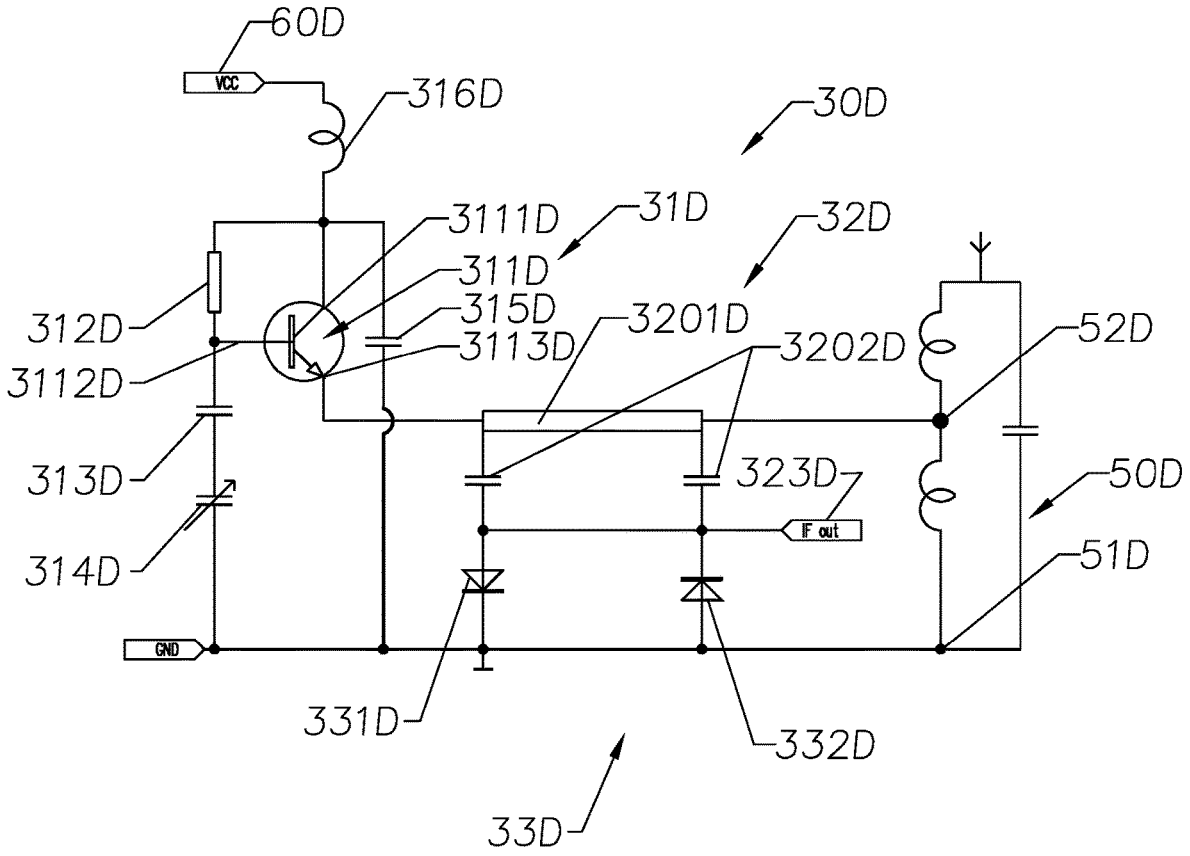
FIG. 24 is a circuit diagram of the microwave driving circuit according to a third preferred embodiment of the present invention.
Figure 25:
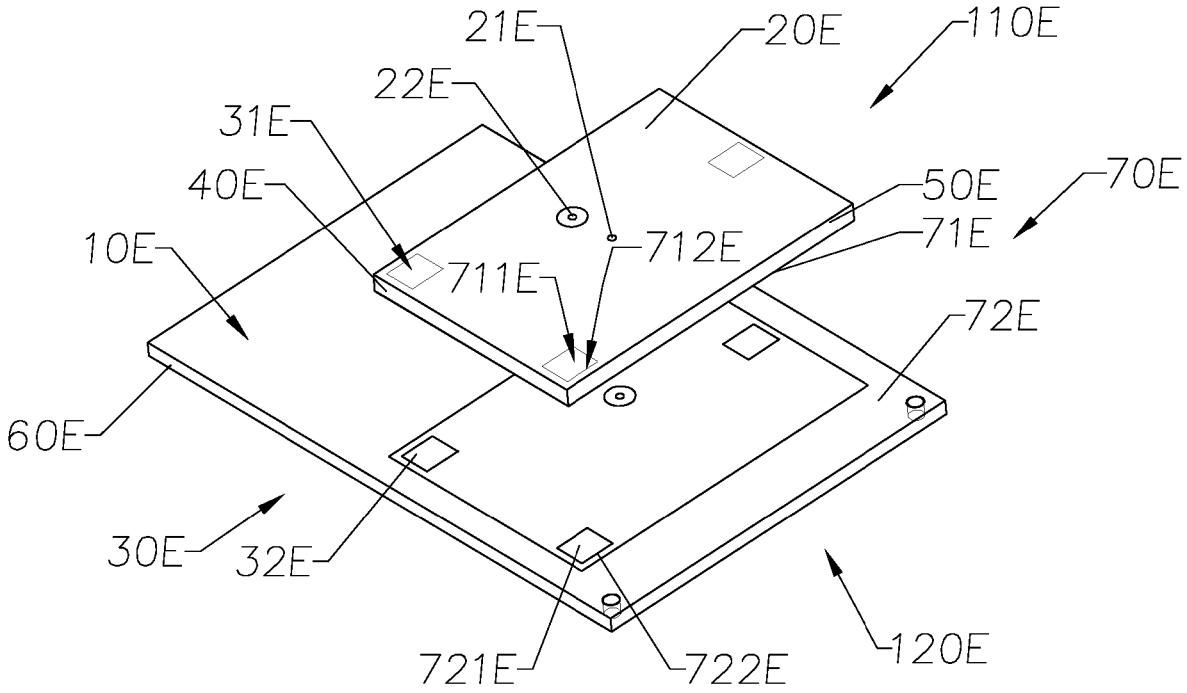
FIG. 25 is an exploded perspective view of an antenna according to the preferred embodiment of the present invention.
Figure 26:
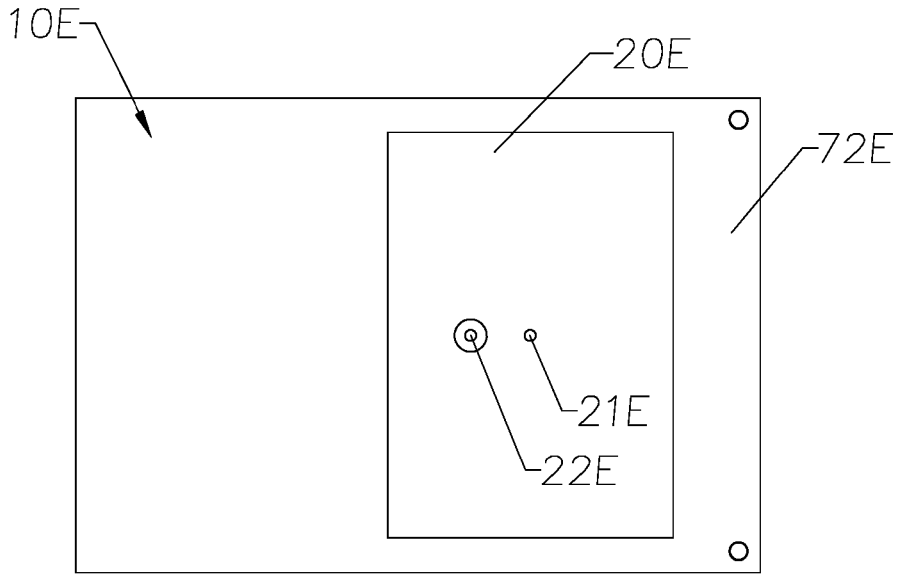
FIG. 26 is a top view of the antenna according to the above preferred embodiment of the present invention.
Figure 27A:
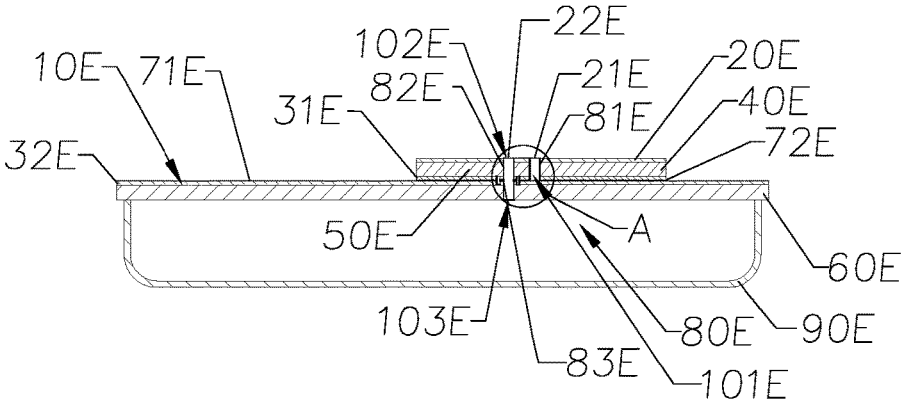
FIG. 27A is a sectional view of the antenna according to the above preferred embodiment of the present invention.
Figure 27B:
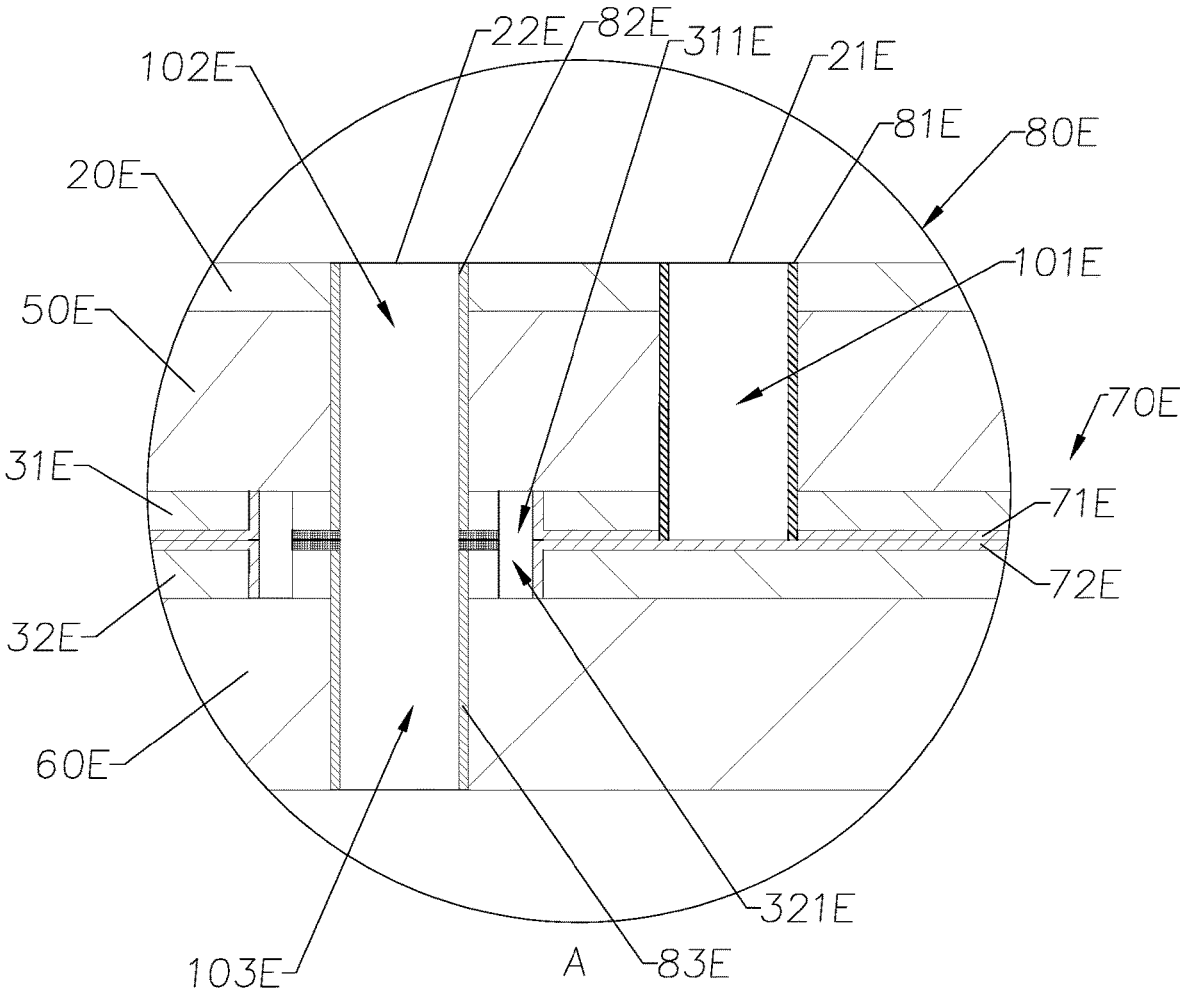
FIG. 27B is a partially sectional view of the antenna according to the above preferred embodiment of the present invention.
Figure 28:
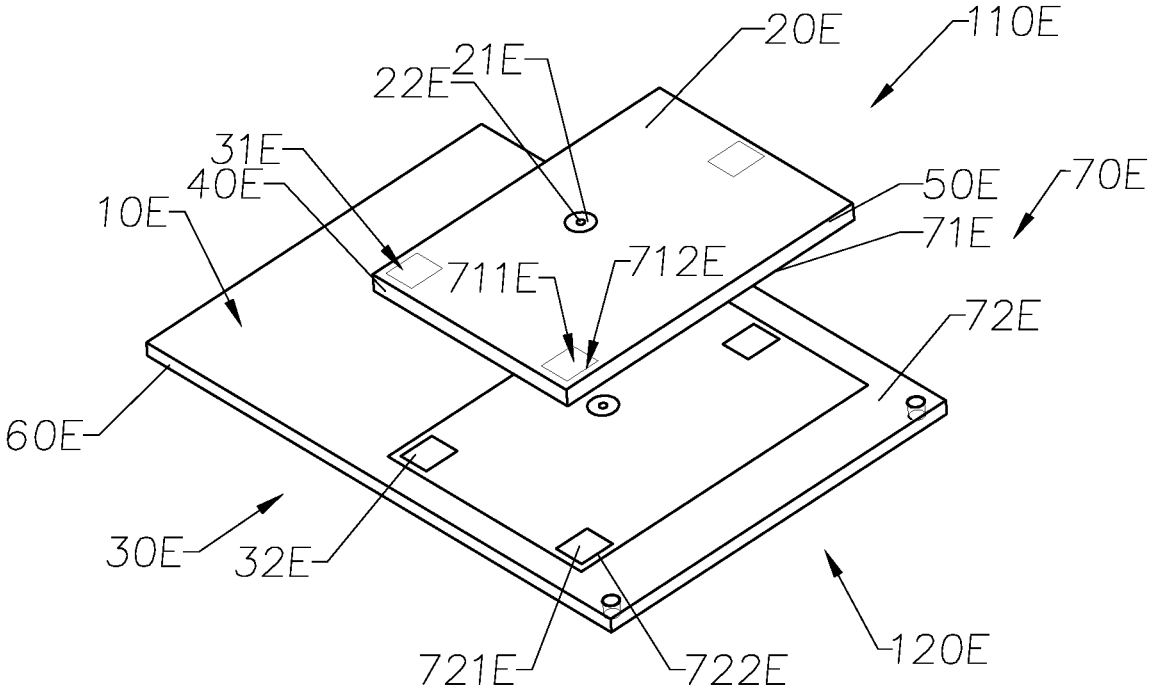
FIG. 28 is an exploded perspective view of an antenna according to a second preferred embodiment of the present invention.
Figure 29:
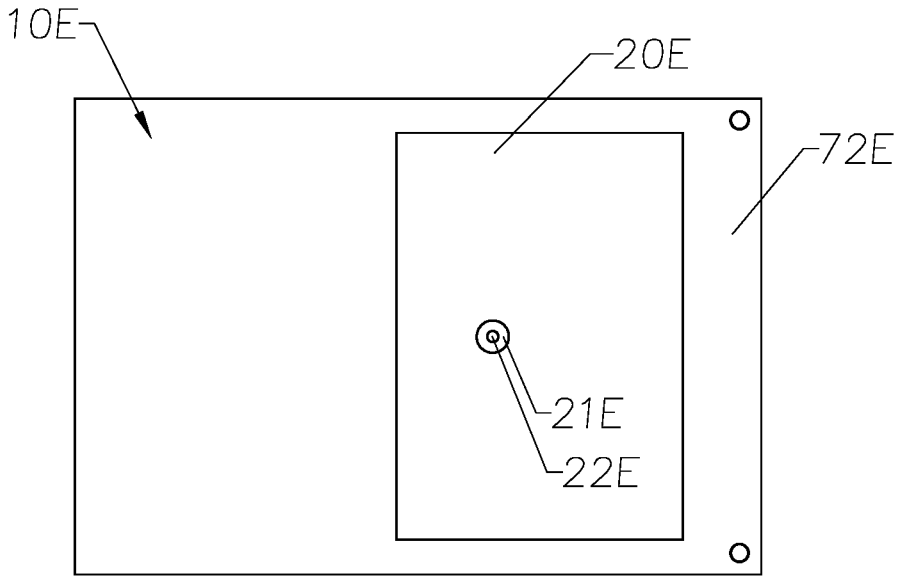
FIG. 29 is a top view of the antenna according to the above second embodiment of the present invention.
Figure 30A:
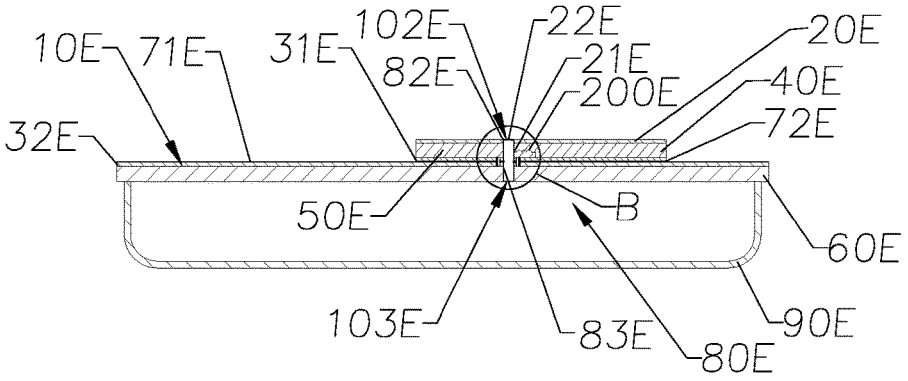
FIG. 30A is a sectional view of the antenna according to the above second embodiment of the present invention.
Figure 30B:
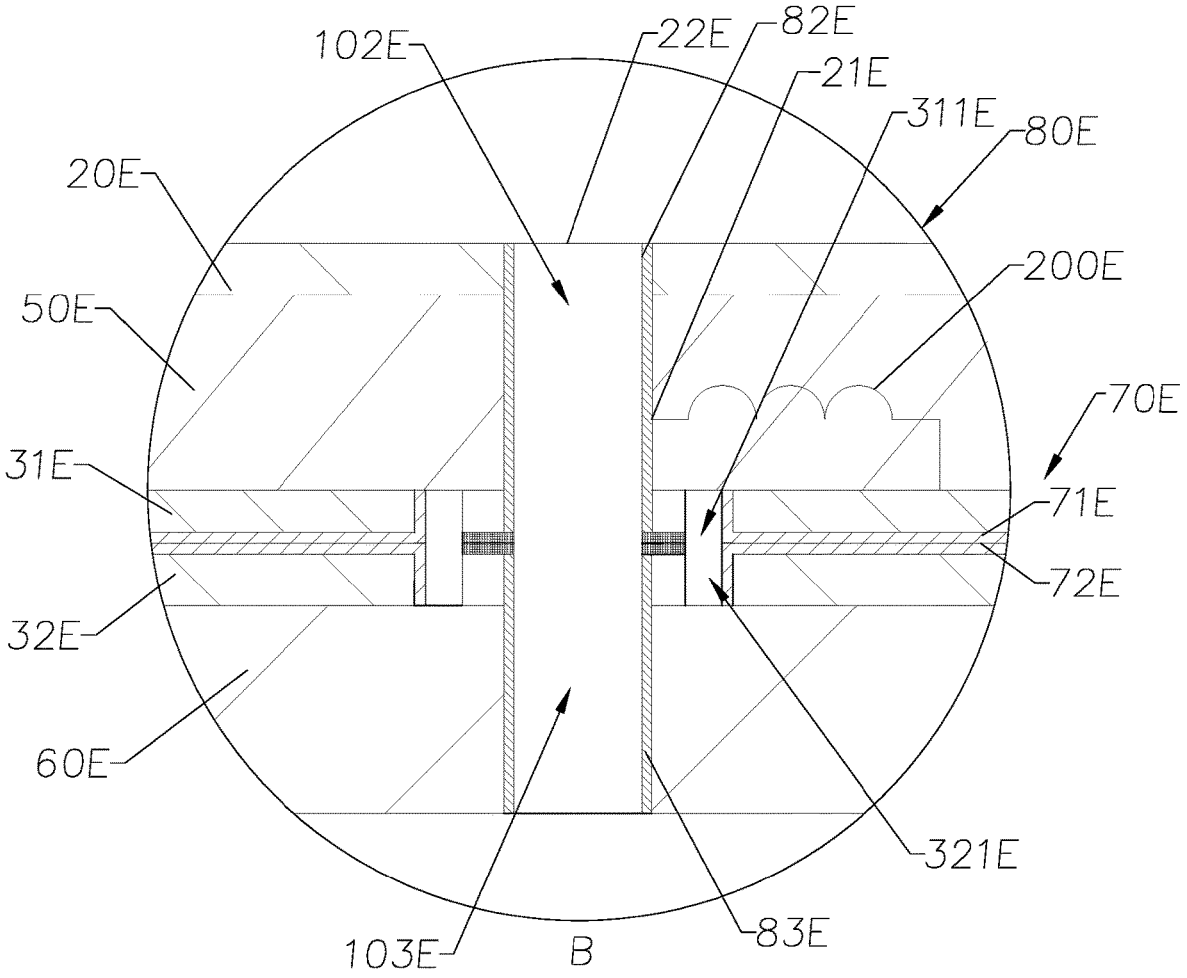
FIG. 30B is a partially sectional view of the antenna according to the above second embodiment of the present invention.

As shown in FIG. 24, the microwave driving circuit 30D according to an another embodiment further illustrates another alternative mode thereof, wherein the microwave driving circuit 30D comprises an oscillation circuit module 31D, a coupler 32D and a mixing detection circuit module 33D. The coupler 32D comprises a coupling member 3201D and two capacitors 3202D, wherein one end of the coupling member 3201D is electrically connected to the oscillation circuit module 31D while another end of the coupling member 32 is electrically connected to the feed point 22D of the radiating source 20D. Two ends of the coupling member 3201D are electrically connected to one end of one of the capacitors 3202D and one end of another capacitor 3202D respectively. In other words, two ends of the capacitors 3202D are respectively connected to two ends of the coupling member 3201D, wherein other two ends of the two capacitors 3202D are electrically connected to the mixing detection circuit module 33D. As shown in FIG. 24, one end of the coupling member 3201D is electrically connected to the second analog point 52D of the analog circuit 50D.

The oscillation circuit module 31D can be electrically connected to a power source 60D, wherein the current of the power source 60D is oscillated when passing through the oscillation circuit module 31D to form the microwave excitation current. Then, the oscillation circuit module 31D is able to directly supply the microwave excitation current to the radiating source 20D via the feed point 22D thereof through the coupling member 3201D, such that the radiating source 20D will cooperate with the reference ground 10D to generate the microwave signal. Each of the capacitors 3202D obtains a change in microwave excitation current supplied to the radiating source 20D when passing through two ends of the coupling member 3201D. Subsequently, the mixing detection circuit module 33D and the coupling member 3201D will cooperate with each other to obtain the detection signal.

As an example of the embodiment, the current provided from the power source 60D will firstly pass through the oscillation circuit module 31D to be oscillated by the oscillation circuit module 31D so as to form the microwave excitation current. Then, the oscillation circuit module 31D will guide the current to the radiating source 20D via the feed point 22D thereof through the coupling member 3201D, such that the radiating source 20D will cooperate with the reference ground 10D to generate the microwave signal so as to form a detection zone. When an object, such as a user, enters into the detection zone to cause a change of the microwave signal, the microwave excitation current will be changed when it passes to the radiating source 20D via the feed point 22D thereof. Each of the capacitors 3202D is able to obtain the microwave excitation current when passing to the two ends of the coupling member 3201D, so as to obtain the change of the microwave excitation current to the radiating source 20D. Subsequently, the mixing detection circuit module 33D and the coupler 32D will cooperate with each other to obtain the detection signal so as to detect the status of the user in the detection zone. For example, the antenna of the present invention is able to detach the user movement within the detection zone.

As shown in FIG. 24, the coupling member 3201D is preferably an impedance line, wherein each end of the impedance line is electrically connected to the capacitor 3202D, such that the ends of the impedance line are electrically connected to the capacitors 3202D respectively. Accordingly, the mixing detection circuit module 33D has a signal output terminal 323D for outputting the detection signal. The type of the signal output terminal 323D should not be limited as long as it can output the detection signal. Preferably, the signal output terminal 323D is set between the coupler 32D and any one of the capacitors 3202D. Preferably, the ends of the two capacitors 3202D are electrically connected to the mixing detection circuit module 33D and are electrically connected to each other.

As shown in FIG. 24, the oscillation circuit module 31D comprises a triode circuit processor 311D, a bias resistor 312D, a first capacitor 313D, a second capacitor 314D, and a third capacitor 315D. The triode circuit processor 311D has a first connection terminal 3111D, a second connection terminal 3112D, and a third connection terminal 3113D, wherein the first connection terminal 3111D of the triode circuit processor 311D is electrically connected to the power source 60D. Two ends of the bias resistor 312D are electrically connected to the first and second connection terminals 3111, 3112 of the triode circuit processor 311D respectively. Two ends of the first capacitor 313D are electrically connected to the second connection terminal 3112D of the triode circuit processor 311D and one end of the second capacitor 314D respectively. Another end of the second capacitor 314D is electrically grounded as a grounded end thereof, such that the second connection terminal 3112D is electrically grounded. Two ends of the third capacitor 315D are electrically connected to the first connection terminal 3111D of the triode circuit processor 311D and the grounded end of the second capacitor 314D. The third connection terminal 3113D of the triode circuit processor 311D is electrically connected to one end of the coupling member 3201D.

In addition, the oscillation circuit module 31D further comprises an inductor 316D, wherein one end of the inductor 316D is electrically connected to the first connection terminal 3111D of the triode circuit processor 311D, while another end of the inductor 316D is electrically connected to the power source 60D.

It is appreciated that in the above embodiments and their alternatives, the inductor 316D electrically connected between the power source 60D and the first connection terminal 3111 can be replaced by a resistor. Therefore, during the operation of the antenna, the resistor functions as the inductor 316D, such that it should not be limited in the present invention.

According to the preferred embodiment, the triode circuit processor 311D is embodied as a semiconductor MOS transistor, wherein the third connection terminal 3113D of the triode circuit processor 311D is a source terminal of the semiconductor MOS transistor. In other words, the source terminal of the semiconductor MOS transistor as the oscillation circuit module 31D is electrically connected to the coupling member 3201D in order to electrically connect to the feed point 22D of the radiating source 20D. Therefore, the oscillation circuit module 31D will oscillate the current supplied from the power source 60D through the coupling member 3201D to form the microwave excitation current, such that the microwave excitation current will flow from the source terminal of the semiconductor MOS transistor to the radiating source 20D through the coupling member 3201D.

In another embodiment, the triode circuit processor 311D is embodied as a semiconductor transistor, wherein the third connection terminal 3113D of the triode circuit processor 311D is an emitter of the semiconductor transistor. In other words, the emitter of the semiconductor transistor as the oscillation circuit module 31D is electrically connected to the coupling member 3201D in order to electrically connect to the feed point 22D of the radiating source 20D. Therefore, the oscillation circuit module 31D will oscillate the current supplied from the power source 60D to form the microwave excitation current, such that the microwave excitation current will flow from the emitter of the semiconductor transistor to the radiating source 20D through the coupling member 3201D.

As shown in FIG. 24, the mixing detection circuit module 33D comprises a first diode 331D and a second diode 332D, wherein one end of the first diode 331D and one end of the second diode 332D are electrically connected to the capacitors 3202D respectively. Preferably, a direction of the first diode 331D is different from that of the second diode 332D. Through this configuration, each of the capacitors 3202D can obtain respectively the change of the microwave excitation current at each end of the coupling member 3201D when passing therethrough. The first and second diodes 331, 332 of the mixing detection circuit module 33D can convert the change of the microwave excitation current into the detection signal. Then, the detection signal can be sent out through the output terminal 323.

The present invention further provides a method of supplying the microwave excitation current to the antenna and detecting a change in the microwave excitation current, wherein the method comprises the following steps.

(a) Directly supply the microwave excitation current to the radiating source 20D from the feed point 22D thereof, wherein the radiating source 20D and the reference ground 10D cooperate with each other to radially and outwardly radiate the microwave signal.

(b) Detect a change in the microwave excitation current supplied to the radiating source 20D through an induction coupling manner.

Particularly, in the step (a), the microwave excitation current is configured to be emitted from the third connection terminal 3113D of the triode circuit processor 311D to the feed point 22D of the radiating source 20D through the first coupling member 321D. Therefore, in the step (b), the change of the microwave excitation current will be detected by the induction between the first coupling member 321D and the second coupling member 322D.

As shown in FIGS. 18 and 21, the first coupling member 321D and the second coupling member 322D of the coupler 32D are impedance lines respectively. As shown in FIGS. 19 and 20, the first coupling member 321D and the second coupling member 322D of the coupler 32D are bent microstrips respectively. As shown in FIG. 22, the first coupling member 321D is an impedance line and the second coupling member 322D a metal foil that surrounds a half circumference of the first coupling member 321D.

As shown in FIG. 23, in the step (a), the microwave excitation current is configured to be emitted from the third connection terminal 3113D of the triode circuit processor 311D directly to the feed point 22D of the radiating source 20D. Therefore, in the step (b), the change of the microwave excitation current will be detected by the coupler 32D which is embodied as a capacitor.

As shown in FIG. 24, in the step (a), the microwave excitation current is configured to be emitted from the third connection terminal 3113D of the triode circuit processor 311D to the feed point 22D of the radiating source 20D through the coupling member 3201D. Therefore, in the step (b), the change of the microwave excitation current will be detected by the induction between the first coupling member 321D and the second coupling member 322D. Therefore, in the step (b), the change of the microwave excitation current will be detected via the capacitors 3202D by detecting the microwave excitation current passing through the two ends of the coupling member 3201D when the capacitors 3202D are electrically connected thereat respectively.

It is appreciated that the first coupling member 321D and the second coupling member 322D are inducted with each other and have impedance properties through the microwave excitation current. For example, the first coupling member 321D and the second coupling member 322D can be resistive element, inductive element, and/or capacitive element. Preferably, the first coupling member 321D is embodied as an impedance line having resistive and/or inductive characteristics, such as a micro-strip line, such that the microwave excitation current generated by the oscillation circuit module 31D which is electrically connected to the first coupling member 321D, is able to flow to the feed point 22D through the first coupling member 321D.

It is worth mentioning that the above description of electrically connecting one end of a first component to one end of a second component can be implied as the end of the first component being directly connected to the end of the second component or can be implied as the end of the first component being indirectly connected to the end of the second component via a conductive wire. For example, the two ends of the bias resistor 312D are electrically connected to the first connection terminal 3111D and the second connection terminal 3112D of the triode circuit processor 311D respectively, wherein it may be implied as the two ends of the bias resistor 312D are indirectly connected to the first connection terminal 3111D and the second connection terminal 3112D of the triode circuit processor 311D via the conductive wires. For another example, the third connection terminal 3113D of the triode circuit processor 311D is electrically connected to one end of the first coupling portion 321, wherein it may be implied as the third connection terminal 3113D of the triode circuit processor 311D is indirectly connected to one end of the first coupling portion 321 by the conductive wire. The third connection terminal 3113D of the triode circuit processor 311D is electrically connected to the feed point 22D of the radiating source 20D, wherein it may be implied as that third connection terminal 3113D of the triode circuit processor 311D is indirectly connected to the feed point 22D of the radiating source 20D by the conductive wire.

Referring to FIGS. 25 to 27B of the drawings, an antenna according to a preferred embodiment of the present invention is illustrated, wherein the antenna having an improved anti-interference ability is able to stably generate and receive electromagnetic waves, and effectively minimize the interference of the electromagnetic waves in response to the nearby electromagnetic radiation frequency. Particularly, the antenna comprises a reference ground 10E, at least a radiating source 20E, and a connection module 30E. Through the connection module 30E, the radiating source 20E is spacedly retained at one side of the reference ground 10E, wherein a space is formed between the reference ground 10E and the radiating source 20E as a radiating clearance 40E therebetween. The radiating source 20E is electrically grounded, such that the impedance of the antenna will be greatly reduced to reduce the resistance of the antenna so as to narrow the bandwidth of the antenna. Therefore, the antenna of the present invention is able to prevent any interference of electromagnetic wave signals received or generated by the antenna of the present invention in response to the nearby electromagnetic radiation frequency by narrowing the bandwidth of the antenna to improve the anti-interference ability thereof. In addition, the connection module 30E is able to electrically connect to the reference ground 10E and the radiating source 20E so as to electrically connect the radiating source 20E to the reference ground 10E in an indirect manner. In other words, the radiating source 20E is retained at one side of the reference ground 10E via the connection module 30E and, at the same time, the radiating source 20E is electrically grounded. Through this configuration, the anti-interference ability of the antenna can be improved and the stabilization of the antenna can be enhanced.

As shown in FIGS. 25 to 27B, the radiating source 20E has at least a ground point 21E and a feed point 22E, wherein the ground point 21E and the feed point 22E are set space apart from each other. The microwave excitation current is input to the feed point 22E of the radiating source 20E. After the microwave excitation current is input to the radiating source 20E through the feed point 22E thereof, the antenna will radiate the electromagnetic wave outwardly from the feed point 22E. In addition, the ground point 21E of the radiating source 20E is electrically connected to the connection module 30E, wherein the connection module 30E is electrically connected to the reference ground 10E. When the radiating source 20E is retained at one side of the reference ground 10E via the connection module 30E, the ground point 21E of the radiating source 20E is electrically connected to the reference ground 10E. Furthermore, when the microwave excitation current is input to the radiating source 20E through the feed point 22E thereof, the feed point 22E and the ground point 21E of the radiating source 20E are inducted with each other to provide a predetermined impedance. Therefore, the bandwidth of the antenna is narrowed down to prevent any interference of electromagnetic wave signals received or generated by the antenna of the present invention in response to the nearby electromagnetic radiation frequency. Since the ground point 21E of the radiating source 20E is electrically connected to reference ground 10E in a stable manner, the stabilization of the antenna can be enhanced.

Furthermore, the connection module 30E comprises a first connecting member 31E and a second connecting member 32E. The ground point 21E of the radiating source 20E is electrically connected to the first connecting member 31E. The second connecting member 32E is electrically grounded. At least a portion of the first connecting member 31E is electrically connected to at least a portion of the second connecting member 32E, such that the ground point 21E of the radiating source 20E is electrically grounded via the first connecting member 31E.

Specifically, the antenna further comprises a first substrate 50E and a second substrate 60E. The radiating source 20E and the first connecting member 31E are coupled, preferably by adhering, at two sides of the first substrate 50E respectively to form a first antenna assembly 110E. The second connecting member 32E is coupled, preferably by adhering, to one side of the second substrate 60E to form a second antenna assembly 120E. The first substrate 50E is retained at one side of the second substrate 60E via the first connecting member 31E facing toward the second connecting member 32E. The radiating source 20E of the first antenna assembly 110E is electrically connected to the first connecting member 31E. The first connecting member 31E is electrically connected to the second connecting member 32E of the second antenna assembly 120E to retain the first antenna assembly 110E at the second antenna assembly 120E and, at the same time, to electrically connect the first connecting member 31E and the radiating source 20E of the first antenna assembly 110E with the second connecting member 32E, so as to electrically ground the radiating source 20E. In one embodiment, the second connecting member 32E integrally forms with the reference ground 10E, wherein the first substrate 50E forms as the radiating clearance 40E.

It is worth mentioning that the radiating source 20E, the first connecting member 31E and the second connecting member 32E have good electrical conductivity. The conductive material of each of the radiating source 20E, the first connecting member 31E and the second connecting member 32E should not be limited in the present invention. For example, the radiating source 20E, the first connecting member 31E and the second connecting member 32E can be made of, but not limited to, copper, copper alloy, silver, gold, or other metals.

Preferably, each of the first connecting member 31E and the second connecting member 32E has a flat surface, wherein an electrical connection portion between the first connecting member 31E and the second connecting member 32E is a flat portion to ensure the stable connection therebetween. For example, each of the first connecting member 31E and the second connecting member 32E is a flat metal panel having a flat outer surface. It should be appreciated that each of the first connecting member 31E and the second connecting member 32E may have a rugged or uneven structure. For example, at least a protrusion and at least an indention are formed at the first connecting member 31E and the second connecting member 32E, wherein the protrusion is engaged with the indention to electrically connect the first connecting member 31E and the second connecting member 32E with each other, so as to electrically connect the first connecting member 31E and the feed point 22E of the radiating source 20E with the second connecting member 32E. Alternatively, the connecting portion of the first connecting member 31E for connecting to the second connecting member 32E is a protruded portion while the connecting portion of the second connecting member 32E for connecting to the first connecting member 31E is a flat portion. Alternatively, the connecting portion of the second connecting member 32E for connecting to the first connecting member 31E is a protruded portion while the connecting portion of the first connecting member 31E for connecting to the second connecting member 32E is a flat portion. Accordingly, the structural shape of the first connecting member 31E and the second connecting member 32E should not be limited in the present invention.

According to the preferred embodiment, the first connecting member 31E is coupled at the second connecting member 32E by press-fitting in order to electrically connect the first connecting member 31E with the second connecting member 32E, such that the ground point 21E of the radiating source 20E, which is electrically connected to the first connecting member 31E, is electrically connected with the second connecting member 32E. The radiating source 20E is electrically grounded.

According to the preferred embodiment, the antenna further comprises an insulating unit 70E which comprises a first insulating layer 71E and a second insulating layer 72E. The first insulating layer 71E and the second insulating layer 72E are covered by at least a portion of the first substrate 50E and at least a portion of the second substrate 60E respectively. The first connecting member 31E is positioned between the first substrate 50 and the first insulating layer 71E. The second connecting member 32E is positioned between the second substrate 60 and the second insulating layer 72E. The uncovered portion of the first substrate 50E is electrically connected to the uncovered portion of the second substrate 60E, such that the ground point 21E of the radiating source 20E, which is electrically connected to the first connecting member 31E, is electrically connected with the second connecting member 32E. The radiating source 20E is electrically grounded.

Preferably, the first insulating layer 71E has at least a first indention 711E, wherein the first insulating layer 71E is covered, preferably by adhering, on the bottom side of the first connecting member 31E, wherein a bottom side of the first insulating layer 71E faces toward the second connecting member 32E. A portion of the first connecting member 31E corresponding to the first indention 711E is electrically connected to the second connecting member 32E. A first receiving cavity 712E is formed between the portion of the first connecting member 31E corresponding to the first indention 711E and the first insulating layer 71E. A conductive material for electrically conducting between the first connecting member 31E and the second connecting member 32E is received in the first receiving cavity 712E, wherein the conductive material can be a soldering material. Preferably, the first insulating layer 71E can be made of insulating material such as plastic, rubber, or the like. Preferably, an area of the first insulating layer 71E is smaller than an area of the bottom side of the first connecting member 31E. When the first insulating layer 71E is coupled at the bottom side of the first connecting member 31E, the first receiving cavity 712E is formed between the first insulating layer 71E and the first connecting member 31E, such that at least a portion of the first connecting member 31E can be electrically connected to the second connecting member 32E.

Preferably, the first insulating layer 71E can be applied, by spraying or coating the insulating material, entirely on the bottom side of the first connecting member 31E, wherein the first indention 711E is formed by removing at least a portion of the insulating material of the first insulating layer 71E on the bottom side of the first connecting member 31E, so as to form the first receiving cavity 712E. For example, the first indention 711E on the first insulating layer 71E is formed by scraping or etching the insulating material on the bottom side of the first connecting member 31E. Therefore, an uncovered portion of the bottom side of the first connecting member 31E is formed to electrically connect to the second connecting member 32E. Alternatively, the insulating material is applied, by spraying or coating, at a predetermined area of the bottom side of the first connecting member 31E to define the uncovered area thereof and to form the first receiving cavity 712E between the first insulating layer 71E and the first connecting member 31E, such that at least a portion of the first connecting member 31E is electrically connected to the second connecting member 32E.

Preferably, the second insulating layer 72E has a second indention 721E, wherein the second insulating layer 72E is covered, preferably by adhering, on an upper side of the second connecting member 32E, wherein a portion of the second connecting member 32E corresponding to the second indention 721E is electrically connected to the first connecting member 31E. A second receiving cavity 722E is formed between the portion of the second connecting member 32E corresponding to the second indention 721E and second insulating layer 72E. A conductive material for electrically conducting between the first connecting member 31E and the second connecting member 32E is received in the second receiving cavity 722E, wherein the conductive material can be a soldering material. Preferably, the second insulating layer 72E can be made of insulating material such as plastic, rubber, or the like. Preferably, an area of the second insulating layer 72E is smaller than an area of the upper side of the second connecting member 32E. When the second insulating layer 72E is coupled at the upper side of the second connecting member 32E, the second receiving cavity 722E is formed between the second insulating layer 72E and the second connecting member 32E, such that at least a portion of the second connecting member 32E can be electrically connected to the first connecting member 31E.

Preferably, the second insulating layer 72E can be applied, by spraying or coating the insulating material, entirely on the upper side of the second connecting member 32E, wherein the second indention 721E is formed by removing at least a portion of the insulating material of the second insulating layer 72E on the upper side of the second connecting member 32E, so as to form the second receiving cavity 722E. For example, the second indention 721E on the second insulating layer 72E is formed by scraping or etching the insulating material on the upper side of the second connecting member 32E. Therefore, an uncovered portion of the upper side of the second connecting member 32E is formed to electrically connect to the first connecting member 31E. Alternatively, the insulating material is applied, by spraying or coating, at a predetermined area of the upper side of the second connecting member 32E to define the uncovered area thereof and to form the second receiving cavity 722E between the second insulating layer 72E and the second connecting member 32E, such that at least a portion of the second connecting member 32E is electrically connected to the first connecting member 31E.

It should be appreciated that the number of the first indention 711E and the second indention 721E should not be limited, wherein the number of the first indention 711E and the second indention 721E can be one, two, three or even more. In addition, the shape of each of the first indention 711E and the second indention 721E should not be limited. In other words, the shape of the connecting portion between the first connecting member 31E and the second connecting member 32E should not be limited. Each of the first indention 711E and the second indention 721E can be configured as polygon, circular, or elliptical shape. The corresponding positions of the first indention 711E and the second indention 721E should not be limited. Preferably, the first indention 711E and the second indention 721E are formed at two sides of the first insulating layer 71E and the second insulating layer 72E. When the first insulating layer 71E and the second insulating layer 72E are respectively provided on the first connecting member 31E and the second connecting member 32E, the first receiving cavity 712E and the second receiving cavity 722E are respectively formed at two sides of the first connecting member 31E and the second connecting member 32E to ensure the stable connection between the first connecting member 31E and the second connecting member 32E.

Preferably, the first connecting member 31E is welded to the second connecting member 32E. Particularly, the conductive medium, such as a soldering material, for soldering the first connecting member 31E and the second connecting member 32E is received at the first receiving cavity 712E and/or the second receiving cavity 722E. The first insulating layer 71E is coupled to the second insulating layer 72E at a corresponding position between the first indention 711E and the second indention 712E, wherein the first indention 711E and the second indention 712E are communicated with each other. The conductive medium is received in the first indention 711E and the second indention 712E to electrically connect between the first connecting member 31E and the second connecting member 32E. For example, the conductive medium is melted to be received in the first indention 711E and the second indention 712E through a heating process, wherein the first connecting member 31E is electrically connected to the second connecting member 32E via the conductive medium when the conductive medium is solidified. It is worth mentioning that each of the first connecting member 31E and the second connecting member 32E has a flat connecting surface to be overlapped with each other when the conductive medium is received in the first indention 711E and the second indention 712E to form the flat connecting surfaces respectively, so as to maintain a flat surface connection between the first connecting member 31E and the second connecting member 32E. It should be understood that if the volume of the conductive medium is larger than the volumes of the first indention 711E and the second indention 712E, the conductive medium may split out of the first indention 711E and the second indention 712E. The splitting portion of the conductive medium is formed between the first insulating layer 71E and the second insulating layer 72E to prevent the affect the stable circuit operation, so as to prevent any interference of electromagnetic wave signals received or generated by the antenna.

It is worth mentioning that the connection module 30E is indirectly connected between the ground point 21E of the radiating source 20E and the reference ground 10E in an electrical connection. Since the first connecting member 31E and the second connecting member 32E of the connection module 30E have enlarged contacting areas to allow the operator to easily and rapidly connect the radiating source 20E with the reference ground 10E so as to facilitate the manufacturing process of the antenna and to enhance the manufacturing efficiency of the antenna. In addition, the enlarged contacting area of each of the first connecting member 31E and the second connecting member 32E can enhance the electrical connection area to enhance the connectively stabilization of the antenna and to ensure the antenna stably generating and receiving the output electromagnetic waves.

Furthermore, the antenna further comprises a conductive module 80E which comprises a first conductive member 81E, wherein two ends of the first conductive member 81E are electrically connected to the ground point 21E of the radiating source 20E and the first connecting member 31E. Preferably, the first conductive member 81E is formed by the metallization slot process to electrically connected to the ground point 21E of the radiating source 20E and the first connecting member 31E. Particularly, a first through slot 101E is correspondingly formed at each of the radiating source 20E, the first substrate 50E, and the first connecting member 31E, wherein the first through slots 101E at the radiating source 20E, the first substrate 50E, and the first connecting member 31E are aligned and communicated with each other. The first through slot 101E is correspondingly formed at the ground point 21E of the radiating source 20E. Through the chemical plating or electroplating, a conductive metal layer is formed at inner slot walls of the first through slots 101E of the radiating source 20E, the first substrate 50E and the first connecting member 31E. In other words, the first conductive member 81E is formed at the radiating source 20E, the first substrate 50E, and the first connecting member 31E, wherein the first conductive member 81E is extended from the radiating source 20E to the first connecting member 31E in order to electrically connect the ground point 21E of the radiating source 20E to the first connecting member 31E. When the first connecting member 31E is electrically connected to the reference ground 10E, the ground point 21E of the radiating source 20E, the ground point 21E of the radiating source 20E is electrically grounded.

The conductive module 80E further comprises a second conductive member 82E electrically connected to the feed point 22E of the radiating source 20E, wherein the second conductive member 82E is also electrically connected to an oscillation circuit, so as to electrically connect the feed point 22E of the radiating source 20E to the oscillation circuit. In addition, the second conductive member 82E and the first connecting member 31E are positioned spaced apart from each other, such that the radiating source 20E and the first connecting member 31E are not electrically connected.

According to the preferred embodiment, the second conductive member 82E is extended from the feed point 22E of the radiating source 20E to the bottom side of the first connecting member 31E, wherein the electrical connecting portion between the first connecting member 31E and the second connecting member 32E is not electrically connected to the second conductive member 82E. Particularly, through the metallization slot process, a second through slot 102E is formed at each of the radiating source 20E, the first substrate 50E and the first connecting member 31E, wherein the second through slots 102E at the radiating source 20E, the first substrate 50E, and the first connecting member 31E are aligned and communicated with each other. Through the chemical plating or electroplating, a conductive metal layer is formed at inner slot walls of the second through slots 102E of the radiating source 20E, the first substrate 50E and the first connecting member 31E. In other words, the second conductive member 82E is formed at the radiating source 20E, the first substrate 50E, and the first connecting member 31E, wherein the second conductive member 82E is extended from the radiating source 20E to bottom side of the first connecting member 31E. In addition, the first connecting member 31E has a first insulating notch 311E, wherein the first insulating notch 311E is extended through the first connecting member 31E. The first insulating notch 311E is extended to encirclingly surround the second conductive member 82E. Preferably, after the second conductive member 82E is formed, a portion of the first connecting member 31E encircles around the second conductive member 82E to form the first insulating notch 311E by etching or corrosion, such that an electrical connecting portion between the first connecting member 31E and the second connecting member 32E is not electrically connected to the second conductive member 82E. Furthermore, according to the preferred embodiment, the second through slot 102E is formed at the first insulating layer 71E corresponding to the second conductive member 82E. The first insulating layer 71E is coupled to the first connecting member 31E with respect to the second through slot 102E corresponding to the second conductive member 82E, such that the second conductive member 82E is extended through the first insulating layer 71E through the second through slot 102E. A portion of the first insulating layer 71E corresponding to the first insulating notch 311E of the first connecting member 31E is inwardly indented and is couple at the first substrate 50E and an inner wall of the first insulating notch 311E of the first connecting member 31E.

In one embodiment, the second conductive member 82E is extended from the feed point 22E of the radiating source 20E to the bottom side of the first insulating layer 71E. Particular, the second through slot 102E is formed at each of the radiating source 20E, the first substrate 50E and the first insulating layer 71E, wherein the second through slots 102E at the radiating source 20E, the first substrate 50E, and the first insulating layer are aligned and communicated with each other. In addition, the first connecting member 31E has a first insulating notch 311E, wherein the first insulating notch 311E is extended to communicate with the second through slot 102E of the radiating source 20E, the second through slot 201 of the first substrate 50E, and the second through slot 102E of the first insulating layer 71E. The second through slot 102E of the radiating source 20E, the second through slot 102E of the first substrate 50E, the second through slot 102E of the first insulating layer 71E, and the first insulating notch 311E of the first connecting member 31E are set corresponding to the feed point 22E of the radiating source 20E. A size of the first insulating notch 311E of the first connecting member 31E is larger than a size of each of the second through slot 102E of the first substrate 50E, the second through slot 102E of the first insulating layer 71E, and the second through slot 102E of the radiating source 20E. When the first insulating layer 71E is coupled at the first connecting member 31E at a position that the second through slot 102E of the first insulating layer 71E corresponds to the first insulating notch 311E of the first connecting member 31E. The first insulating layer 71E is able to cover a portion of the first insulating notch 311E of the first connecting member 31E. A portion of the first insulating layer 71E corresponding to the first insulating notch 311E of the first connecting member 31E is inwardly indented and is coupled to the first substrate 50E. Through the chemical plating or electroplating, a conductive metal layer is formed at inner slot walls of the second through slot 102E of the radiating source 20E, the second through slot 102E of the first substrate 50E and the second through slot 102E of the first insulating layer 71E. In other words, the second conductive member 82E is formed at the radiating source 20E, the first substrate 50E, and the first insulating layer 71E, wherein the second conductive member 82E is extended from the radiating source 20E to the first substrate 50E while the first connecting member 31E is extended to the first insulating layer 71E. According to the preferred embodiment, the second conductive member 82E and the first connecting member 31E are positioned apart from each other, wherein the second conductive member 82E is only connected to the radiating source 20E, the first substrate 50E and the first insulating layer 71E, so as to prevent the feed point 22E of the radiating source 20E being electrically connected to the first connecting member 31E.

In one embodiment, the first insulating layer 71E is applied on the first connecting member 31E preferably by spraying an insulating material thereon. The first connecting member 31E is disposed at a bottom side of the first substrate 50E, wherein the insulating material is sprayed on the bottom side of the first connecting member 31E, an inner wall of the first insulating notch 311E of the first connecting member 31E and a portion of the first connecting member 31E facing toward the bottom side of the first substrate 50E in order to form the second through slot 102E of the first insulating layer 71E. Through the chemical plating or electroplating, the second conductive member 82E is formed at inner slot walls of the second through slot 102E of the radiating source 20E and the second through slot 102E of the first insulating layer 71E. The second conductive member 82E is extended from the feed point 22E of the radiating source 20E to the first insulating layer 71E to separate the second conductive member 82E from the first connecting member 31E, so as to prevent the feed point 22E of the radiating source 20E being electrically connected to the first connecting member 31E. In other words, the feed point 22E of the radiating source 20E is not electrically connected to the first connecting member 31E.

Furthermore, the antenna further comprises an oscillation circuit, wherein the feed point 22E of the radiating source 20E is electrically connected to the oscillation circuit to obtain the electromagnetic excitation signal. Preferably, the second substrate 60E is embodied as a circuit board, wherein the oscillation circuit is integrated with the second substrate 60E of the antenna.

The conductive module 80E further comprises a third conductive member 83E, wherein two ends of the third conductive member 83E are electrically connected to the second conductive member 82E and the oscillation circuit respectively, so as to electrically connect the feed point 22E of the radiating source 20E with the oscillation circuit. Accordingly, when the feed point 22E of the radiating source 20E is connected to the oscillation circuit to obtain the electromagnetic excitation signal, the feed point 22E and the ground point 21E of the radiating source 20E are inducted with each other to provide a predetermined impedance. Therefore, the bandwidth of the antenna is narrowed down to prevent any interference of electromagnetic wave signals received or generated by the antenna of the present invention in response to the nearby electromagnetic radiation frequency. Thus, the ground point 21E of the radiating source 20E is able to electrically connected to the reference ground 10E in a stable manner, so as to enhance the stability of the antenna.

According to the preferred embodiment, the third conductive member 83E is extended from the second substrate 60E to the second connecting member 32E, wherein an electrical connecting portion between the second connecting member 32E and the first connecting member 31E is not electrically connected to the third conductive member 83E. Particularly, the third conductive member 83E is formed by the metallization slot process, wherein a third through slot 103E is formed at each of the second substrate 60E and the second connecting member 32E. The third through slots 103E at the second substrate 60E and the second connecting member 32E are aligned and communicated with each other. Through the chemical plating or electroplating, a conductive metal layer is formed at inner slot walls of the third through slot 103E at the second substrate 60E and the third through slot 103E at the second connecting member 32E. In other words, the third conductive member 83E is formed between the second substrate 60E and the second connecting member 32E, wherein the third conductive member 83E is extended from the second substrate 60E to the second connecting member 32E. In one embodiment, the second connecting member 32E has a second insulating notch 321E, wherein the second insulating notch 321E is extended through the second connecting member 32E. The second insulating notch 321E is extended to encirclingly surround the third conductive member 83E. Preferably, after the third conductive member 83E is formed, a portion of the second connecting member 32E encircles around the third conductive member 83E to form the second insulating notch 321E by etching or corrosion, such that an electrical connecting portion between the second connecting member 32E and the first connecting member 31E is not electrically connected to the third conductive member 83E.

Furthermore, according to the preferred embodiment, the third through slot 103E is formed at the second insulating layer 72E corresponding to the third conductive member 83E. The second insulating layer 72E is coupled to the second connecting member 32E with respect to the second through slot 102E corresponding to the third conductive member 83E, such that the third conductive member 83E is extended through the second insulating layer 72E through the third through slot 103E. A portion of the second insulating layer 72E corresponding to the second insulating notch 321E of the second connecting member 32E is inwardly indented and is couple at the second substrate 60E and an inner wall of the second insulating notch 321E of the second connecting member 32E.

In one embodiment, the third conductive member 83E is extended from the second substrate 60E to the upper side of the second insulating layer 72E, the third through slot 103E is formed at each of the second substrate 60E and the second insulating layer 71. The third through slot 103E at the second substrate 60E and the third through slot 103E at the second insulating layer 71 are aligned and communicated with each other. The second connecting member 32E has a second insulating notch 321E, wherein the second insulating notch 321E of the second connecting member 32E is communicatively connected to the third through slot 103E of the second substrate 60E and the third through slot 103E of the second insulating layer 72E. Preferably, a size of the second insulating notch 321E of the second connecting member 32E is larger than a size of each of the third through slot 103E of the second substrate 60E and the third through slot 103E of the second insulating layer 72E. Through the chemical plating or electroplating, a conductive metal layer is formed at inner slot walls of the third through slot 103E at the second substrate 60E and the third through slot 103E at the second insulating layer 72E. In other words, the third conductive member 83E is formed between the second substrate 60E and the second insulating layer 72E, wherein the third conductive member 83E is extended from the second substrate 60E to the second insulating layer 72E. For example, the second insulating layer 72E is coupled to the second connecting member 32E at a position that the third through slot 103E of the second insulating layer 72E corresponds to the second insulating notch 321E of the second connecting member 32E. The second insulating layer 72E is able to cover a portion of the second insulating notch 321E of the second connecting member 32E. A portion of the second insulating layer 72E corresponding to the second insulating notch 321E of the second connecting member 32E is inwardly indented and is coupled to the second substrate 60E. Therefore, the third conductive member 83E is only electrically connected to the second substrate 60E and the second insulating layer 72E to prevent the third conductive member 83E being electrically connected to the second conductive member 82E. In other words, the third conductive member 83E is not electrically connected to the second conductive member 82E. The feed point 22E of the radiating source 20E is electrically connected to the second connecting member 32E.

It should be understood that, in one embodiment, the second insulating layer 72E is formed by applying, preferably by spraying, the insulating material on the second connecting member 32E, wherein the insulating material is able to cover an inner slot wall of the second insulating notch 321E of the second connecting member 32E and a portion of the first insulating notch 311E facing toward the bottom side of the second substrate 60E, so as to form the third through slot 103E at the second insulating layer 72E. Through the chemical plating or electroplating, the third conductive member 83E is formed at inner slot walls of the third through slot 103E of the second substrate 60E and the third through slot 103E of the second insulating layer 72E, such that the third conductive member 83E and the second connecting member 32E are positioned spacedly apart from each other so as to prevent the third conductive member 83E being electrically connected to the second conductive member 32. In other words, the third conductive member 83E is not electrically connected to the second conductive member 32. The feed point 22E of the radiating source 20E is electrically connected to the second connecting member 32E.

Preferably, the third conductive member 83E, which is electrically connected to the oscillation circuit, is welded to the second conductive member 82E in order to electrically connect the feed point 22E of the radiating source 20E with the oscillation circuit. According to the preferred embodiment, the second substrate 60E is embodied as a circuit board that the oscillation circuit is integrated with the second substrate 60E of the antenna.

Preferably, a horizontal distance between a left side edge of the radiating source 20E and a left side edge of the reference ground 10E is greater than $1/64\ \lambda$. A horizontal distance between the left side edge of the radiating source 20E and the left side edge of the reference ground 10E is smaller than $\lambda$. A horizontal distance between a right side edge of the radiating source 20E and a right side edge of the reference ground 10E is greater than $1/64\ \lambda$. A horizontal distance between the right side edge of the radiating source 20E and the right side edge of the reference ground 10E is smaller than $1/4\ \lambda$. Accordingly, $\lambda$ is a wavelength of the electromagnetic wave generated or received by the antenna. It is worth mentioning that the size ratio in the drawings is for illustrative purpose, wherein the size of each component of the antenna should not be limited.

Preferably, as shown in FIGS. 25 to 27B, the ground point 21E of the radiating source 20E is embodied as a physical center point. In other words, by connecting to the physical center point of the radiating source 20E, the antenna is able to generate an initial polarization direction in order to enable the radiating source 20E to radiate electromagnetic waves stably.

It is worth mentioning that the number and position of the ground point 21E should not be limited. The number of the ground point 21E of the radiating source 20E can be one, two, or more. It should be understood by the skilled in the art that the number and position of the ground points 21E of the radiating source 20E shown in the drawings and description of the present invention are for illustrative purpose and should not be limited in the present invention.

Figure 31:
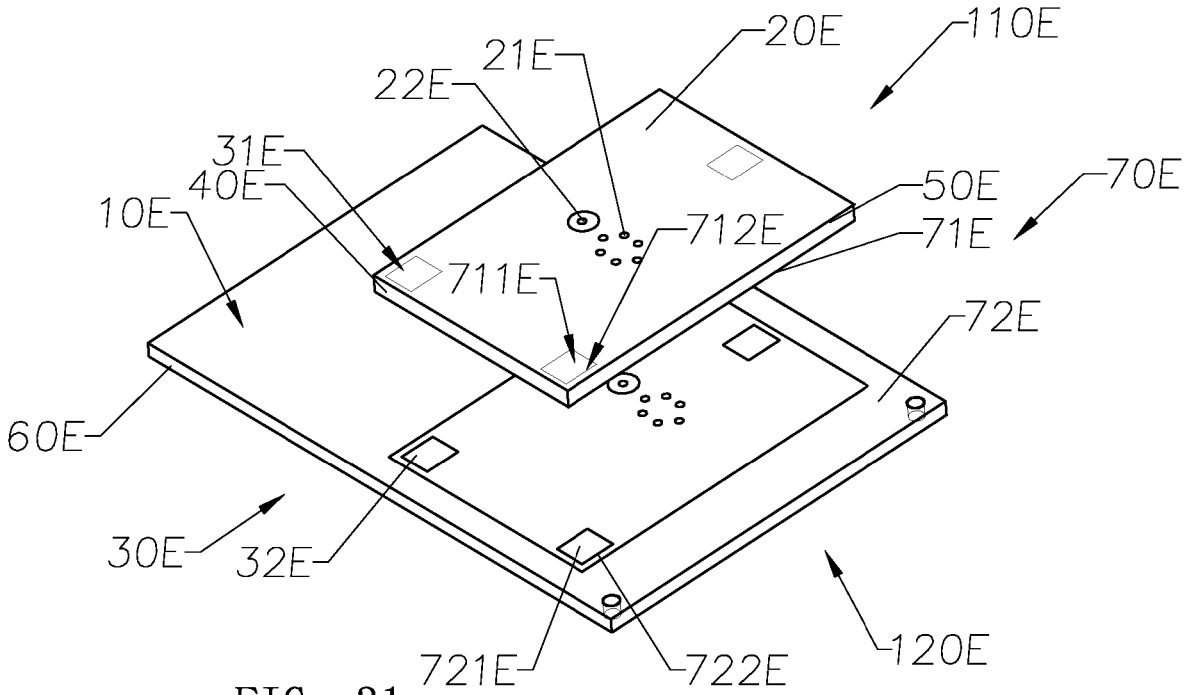
FIG. 31 is an exploded perspective view of an antenna according to a third preferred embodiment of the present invention.
Figure 32:
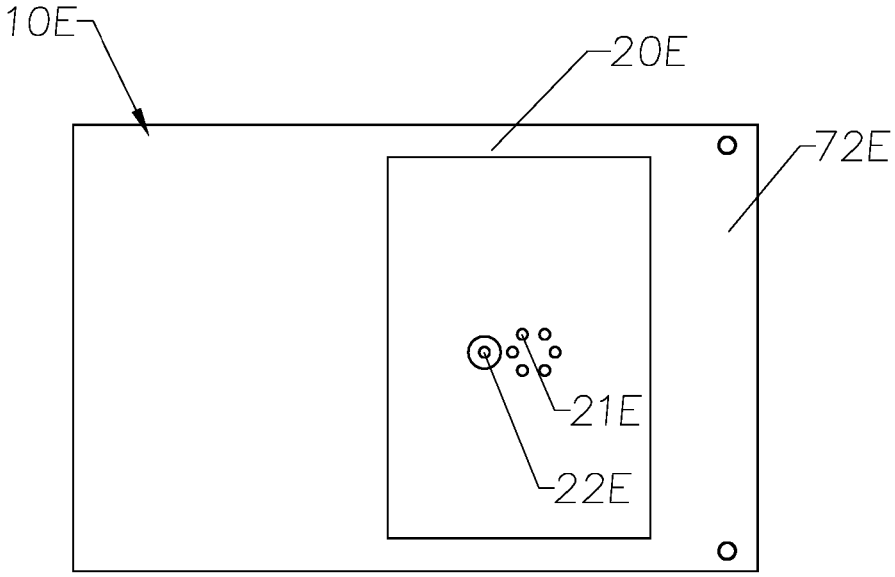
FIG. 32 is a top view of the antenna according to the above third embodiment of the present invention.
Figure 33:
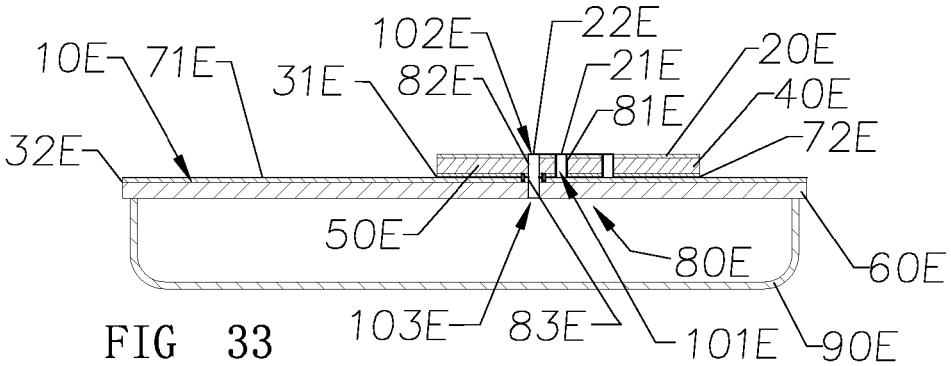
FIG. 33 is a sectional view of the antenna according to the above third embodiment of the present invention.

Preferably, as shown in FIGS. 31 to 33, there are six ground points 21E of the radiating source 20E as an example, wherein the size ground points 21E are spaced apart each other and surround the physical center point of the radiating source 20E. Each of the ground points 21E is electrically connected to the first connecting member 31E. When the first connecting member 31E is electrically connected to the second connecting member 32E, the ground points 21E are electrically connected to the second connecting member 32E. Furthermore, the ground points 21E of the radiating source 20E are electrically connected to the reference ground 10E. Preferably, the distances between the ground points 21E and the physical center point are the same. Thus, a distance between each of the ground points 21E and the edge of the radiating source 20E has a predetermined interval, such that after the feed point 22E of the radiating source 20E is electrically connected to the oscillation circuit, the feed point 22E and each ground point 21E of the radiating source 20E are inducted with each other to provide a predetermined impedance. Therefore, the bandwidth of the antenna is narrowed down to prevent any interference of electromagnetic wave signals received or generated by the antenna of the present invention in response to the nearby electromagnetic radiation frequency.

Furthermore, the feed point 22E of the radiating source 20E is offset from the physical center point thereof to lower the intensity requirement of the antenna for the excitation current of the electromagnetic wave excitation signal. Preferably, the distance between the ground point 21E and the feed point 22E of the radiating source 20E is greater than or equal to $1/64\ \lambda$, such that the feed point 22E and each ground point 21E of the radiating source 20E are inducted with each other to provide a predetermined impedance.

Furthermore, the antenna further comprises a shield member 90E, wherein the shield member 90E is coupled at the second substrate 60E. The second connecting member 32E and the shield member 90E are respectively coupled at two opposite sides of the second substrate 60E. The shield member 90E has good electrical conductivity. It should be understood that the material of the shield member 90E should not be limited. For example, the shield member 90E can be made of, but not limited to, copper, copper alloy, silver, gold, or other metals to minimize the interference of electromagnetic wave signals received or generated by the antenna.

The difference between the embodiment shown in FIGS. 28 to 30B and the embodiment shown in FIGS. 25 to 27B is that the ground point 21E and the feed point 22E of the radiating source 20E are coincide and overlapped with each other as shown in FIGS. 28 to 30B. Particularly, the antenna further comprises an impedance element 200E, wherein one end of the impedance element 200E is electrically connected to the ground point 21E of the radiating source 20E while another end of the impedance element 200E is electrically connected to the first connecting member 31E. Preferably, the impedance element 200E can be, but not limited to, an inductor, an impedance line, or the like.

As shown in FIGS. 34 to 45, the conductive module 80E of the antenna further comprises at least a fourth conductive member 84E and at least a fifth conductive member 85E, wherein the fourth conductive member 84E is electrically connected to the fifth conductive member 85E. The fourth conductive member 84E is electrically connected to the first connecting member 31E while the fifth conductive member 85E is electrically connected to the second connecting member 32E. The ground point 21E of the radiating source 20E, which is electrically connected to the first connecting member 31E, is electrically connected to the reference ground 10E, such that the radiating source 20E is electrically grounded. Preferably, the fourth conductive member 84E and the fifth conductive member 85E are formed by the metallization slot process. Particularly, a fourth through slot 104E is formed at each of the first substrate 50E, the first connecting member 31E, the first insulating layer 71E, the second insulating layer 72E, the second connecting member 32E and the second substrate 60E. The fourth through slots 104E at the first substrate 50E, the first connecting member 31E, the first insulating layer 71E, the second insulating layer 72E, the second connecting member 32E and the second substrate 60E are aligned and communicated with each other. Through the chemical plating or electroplating, a conductive metal layer is formed at inner slot walls of the fourth through slot 104E of the first substrate 50E, the fourth through slot 104E of the first connecting member 31E, and the fourth through slot 104E of the first insulating layer 71E. Thus, the fourth conductive member 84E is formed at the first substrate 50E, the first connecting member 31E, and the first insulating layer 71E. In other words, the fourth conductive member 84E is extended from the first substrate 50E to the first insulating layer 71E, wherein the fourth conductive member 84E is electrically connected to the first connecting member 31E. Likewise, through the chemical plating or electroplating, a conductive metal layer is formed at inner slot walls of the fourth through slot 104E of the second insulating layer 72E, the fourth through slot 104E of the second connecting member 32E and the fourth through slot 104E of the second substrate 60E. Thus, the fifth conductive member 85E is formed at the second insulating layer 72E, the second connecting member 32E and the second substrate 60E. The fifth conductive member 85E is extended from the second insulating layer 72E to the second substrate 60E, wherein the fifth conductive member 85E is electrically connected to the second connecting member 32E. Furthermore, the fourth conductive member 84E is electrically connected to the fifth conductive member 85E, wherein, at the same time, the first substrate 50E is stably coupled at one side of the second substrate 60E, so as to ensure the radiating source 20E at the first substrate 50E being stably retained at one side of the reference ground 10E. As a result, the antenna is able to stably generate and receive the outward electromagnetic waves. Preferably, the fourth conductive member 84E is welded to the fifth conductive member 85E, such that the fourth conductive member 84E is electrically connected to the fifth conductive member 85E. For example, the soldering material in solid-liquid mixed state is filled into the fourth through slots 104E of the first substrate 50E, the first connecting member 31E, the first insulating layer 71E, the second insulating layer 72E, the second connecting member 32E, and the second substrate 60E. Once the soldering material is solidified, the fourth conductive member 84E is electrically connected to the fifth conductive member 85E and, at the same time, the radiating source 20E at the first substrate 50E is stably retained at one side of the reference ground 10E.

Furthermore, an area of radiating source 20E which is disposed on the upper side of the first substrate 50E, is smaller than an area of the upper side of the first substrate 50E, such that the fourth conductive member 84E at the first substrate 50E is located spacedly apart from the radiating source 20E. In other words, the fourth conductive member 84E is electrically connected to the radiating source 20E. Preferably, through the etching or corrosion process, an area of the radiating source 20E is reduced from its peripheral edge to its center in order to reduce the area of the radiating source 20E covering the upper side of the first substrate 50E. It should be understood that, in other embodiments, the fourth conductive member 84E can be extended from the upper side of the radiating source 20E to the bottom side of the second substrate 60E.

It should be understood to the person who skilled in the art that the number of the fourth conductive member 84E and the fifth conductive member 85E should not be limited. The number of each of the fourth conductive member 84E and the fifth conductive member 85E can be one, two, three, or more. In addition, the position of each of the fourth conductive member 84E and the fifth conductive member 85E should not be limited. For example, two fourth conductive members 84 and two fifth conductive members 85 are respectively coupled at the left sides of the first substrate 50E and the second substrate 60E. Alternatively, two fourth conductive member 84E are respectively coupled at left and right sides of the first substrate 50E, while two fifth conductive member 85E are respectively coupled at the left and right sides of the second substrate 60E. Alternatively, one fourth conductive member 84E and one fifth conductive member 85E are respectively coupled at the left sides of the first substrate 50E and the second substrate 60E, while two fourth conductive members 84 and two fifth conductive members 85 are respectively coupled at the right sides of the first substrate 50E and the second substrate 60E.

It is worth mentioning that the shape of the radiating source 20E should not be limited. As shown in FIGS. 25 to 36B and FIGS. 40 to 42, the radiating source 20E is configured to have a rectangular shape. As shown in FIGS. 37 to 39 and FIGS. 43 to 45, the radiating source 20E is configured to have a circular shape. It is appreciated that the radiating source 20E can be configured to have other shapes, such as oval or square shape.

Figure 34:
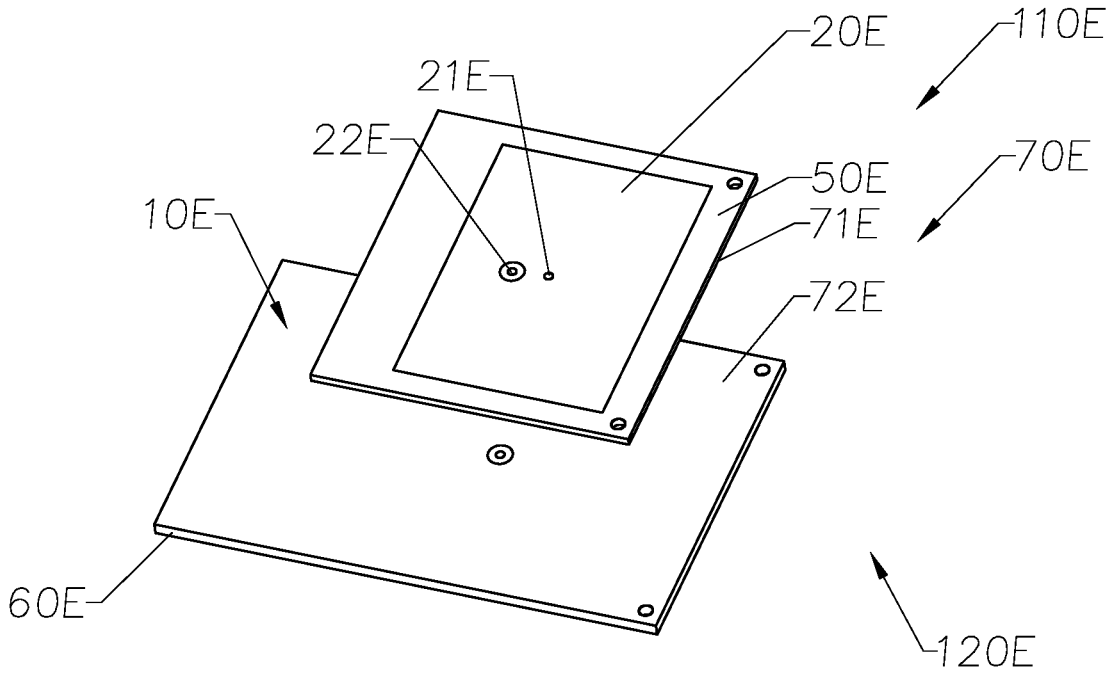
FIG. 34 is an exploded perspective view of an antenna according to a third preferred embodiment of the present invention.
Figure 35:
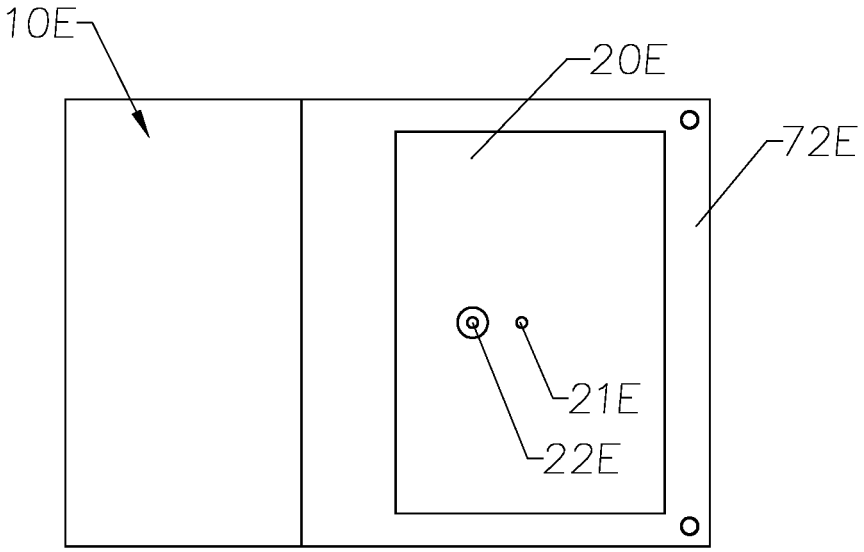
FIG. 35 is a top view of the antenna according to the above third embodiment of the present invention.
Figure 36A:
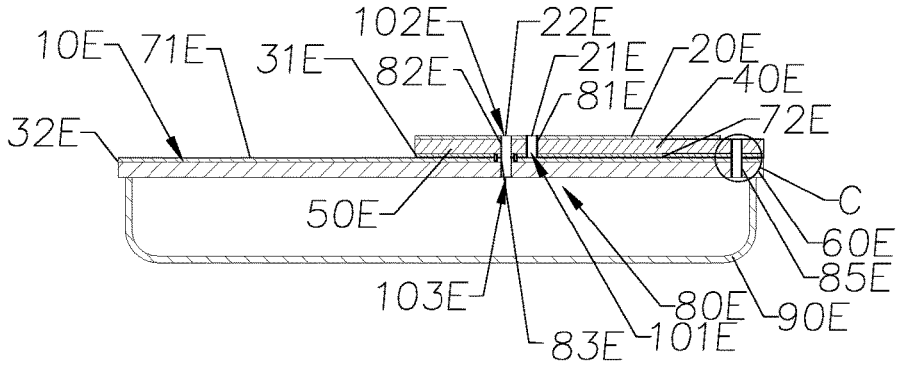
FIG. 36A is a sectional view of the antenna according to the above third embodiment of the present invention.
Figure 36B:
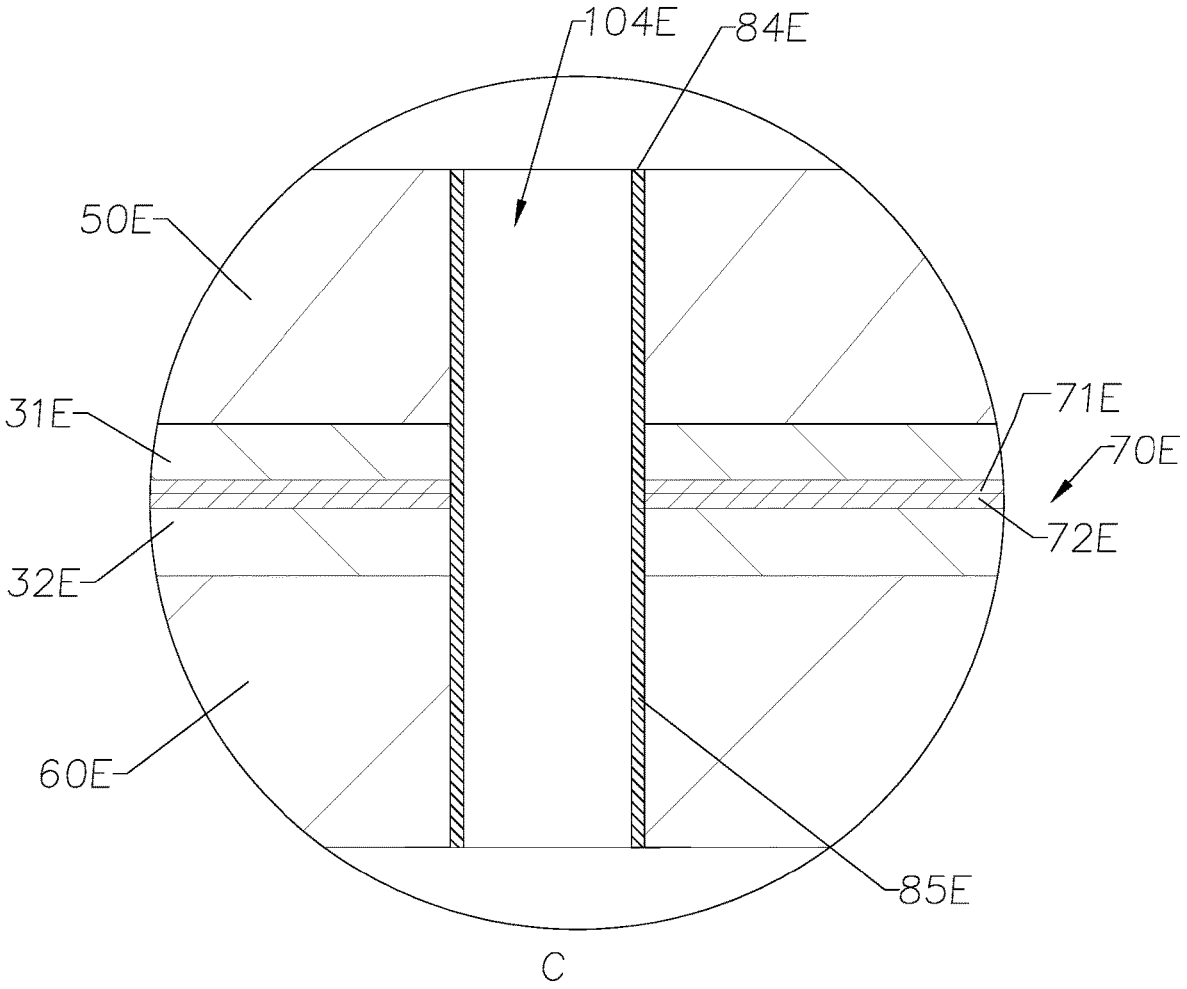
FIG. 36B is a partially sectional view of the antenna according to the above third embodiment of the present invention.
Figure 37:
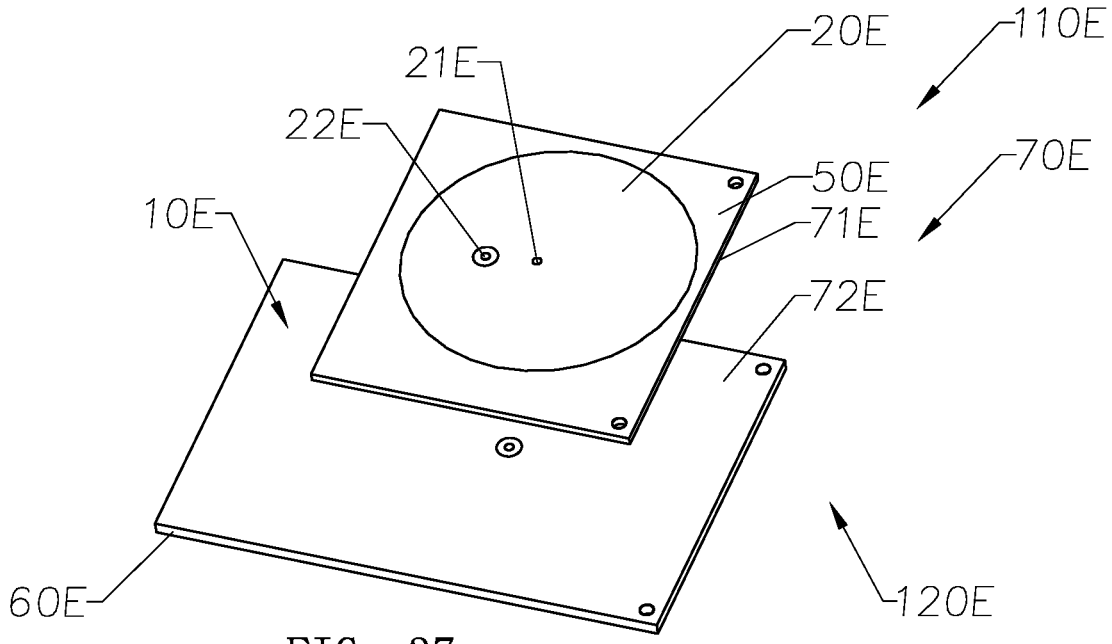
FIG. 37 is an exploded perspective view of an antenna according to a fourth preferred embodiment of the present invention.
Figure 38:
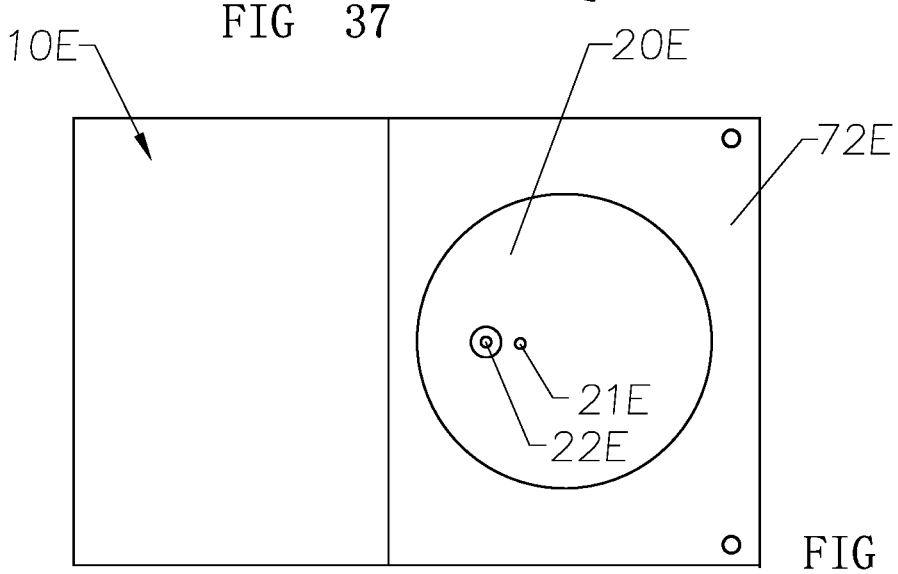
FIG. 38 is a top view of the antenna according to the above fourth embodiment of the present invention.
Figure 39:
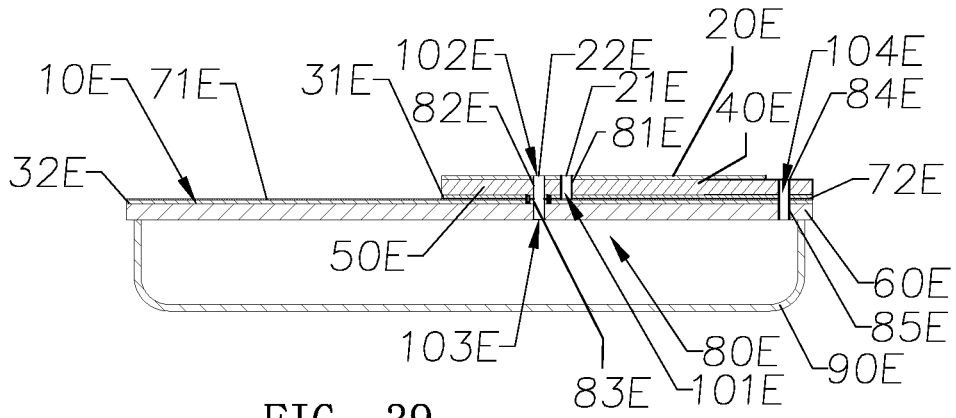
FIG. 39 is a sectional view of the antenna according to the above fourth embodiment of the present invention.
Figure 40:
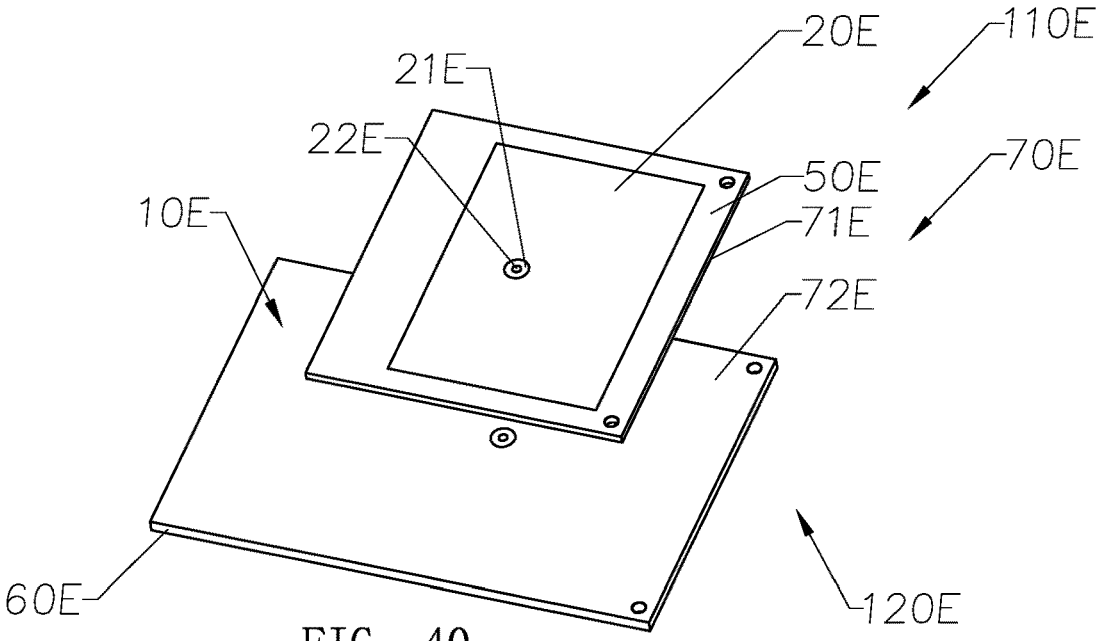
FIG. 40 is an exploded perspective view of an antenna according to a fifth preferred embodiment of the present invention.
Figure 41:
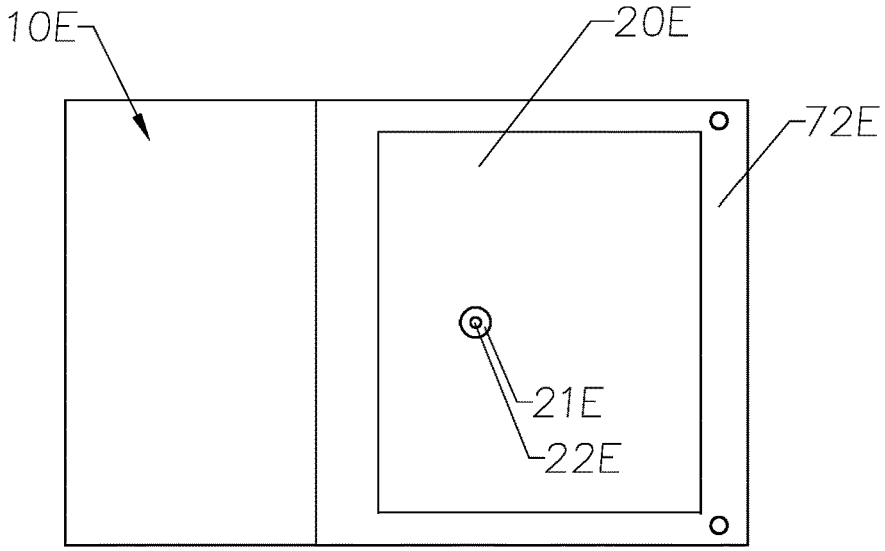
FIG. 41 is a top view of the antenna according to the above fifth embodiment of the present invention.
Figure 42:
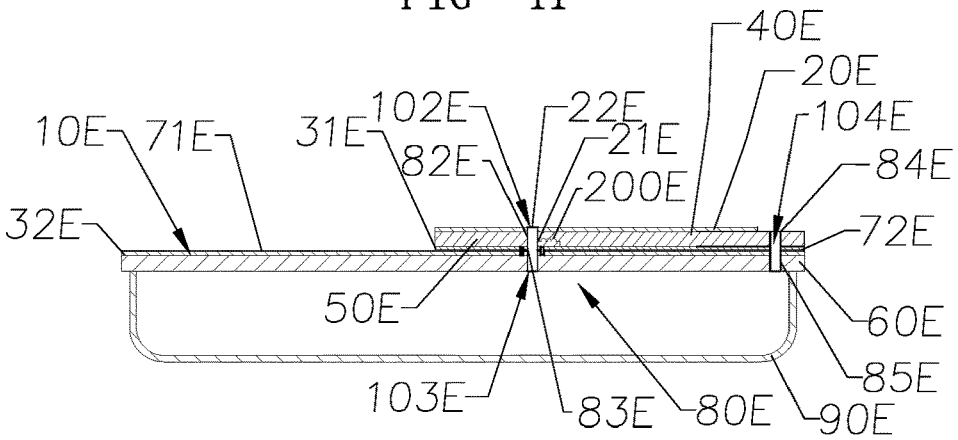
FIG. 42 is a sectional view of the antenna according to the above fifth embodiment of the present invention.
Figure 43:
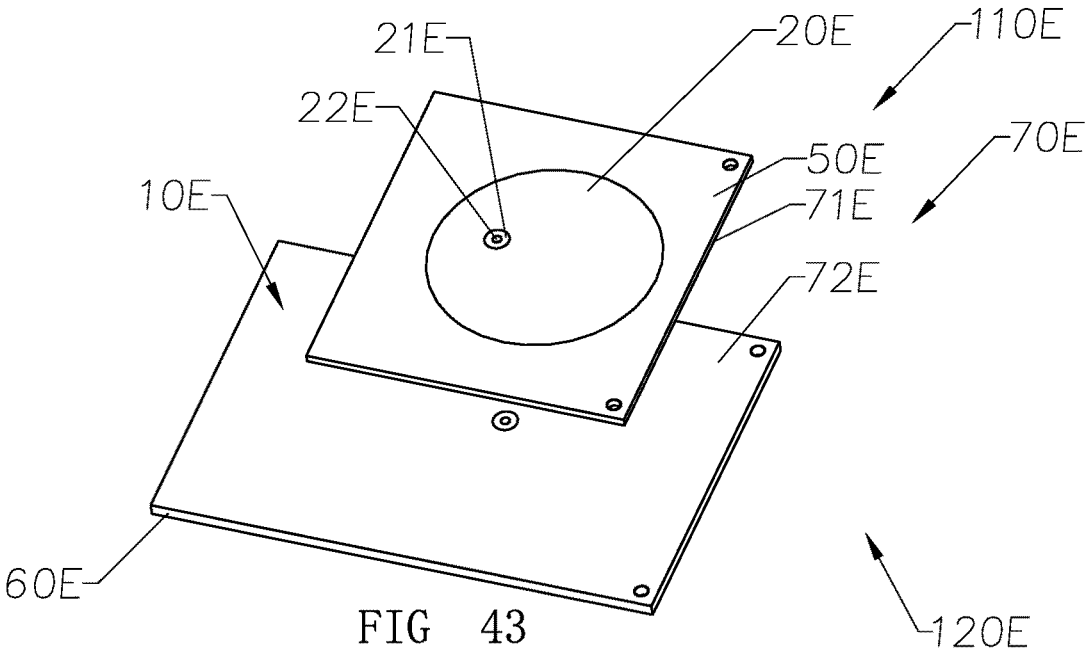
FIG. 43 is an exploded perspective view of an antenna according to a sixth preferred embodiment of the present invention.
Figure 44:
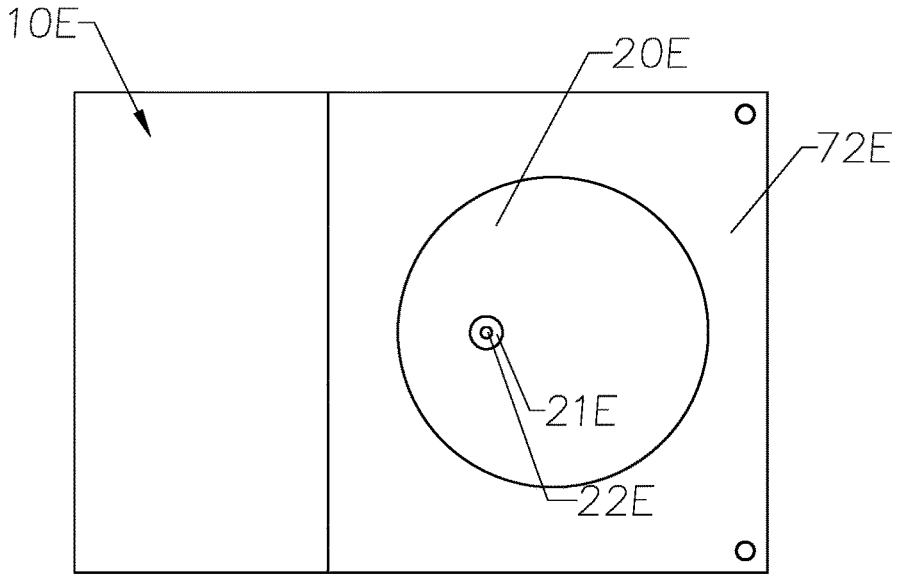
FIG. 44 is a top view of the antenna according to the above sixth embodiment of the present invention.
Figure 45:
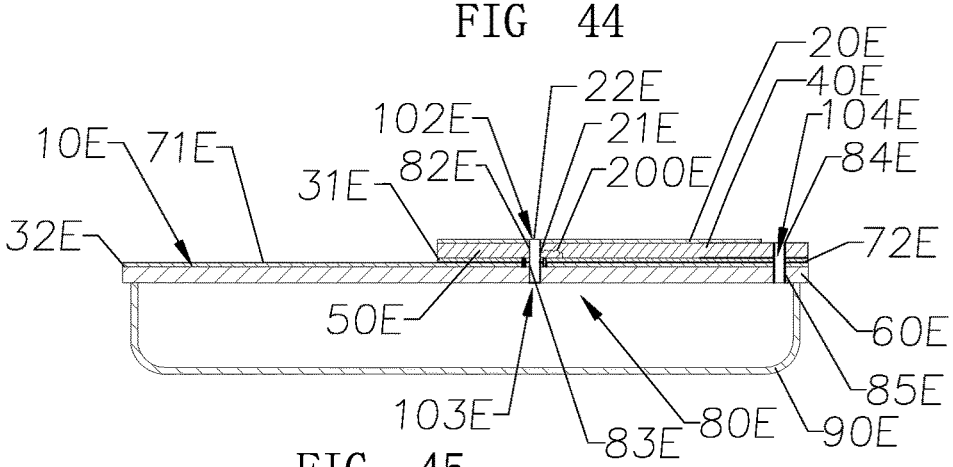
FIG. 45 is a sectional view of the antenna according to the above sixth embodiment of the present invention.
Figure 46:
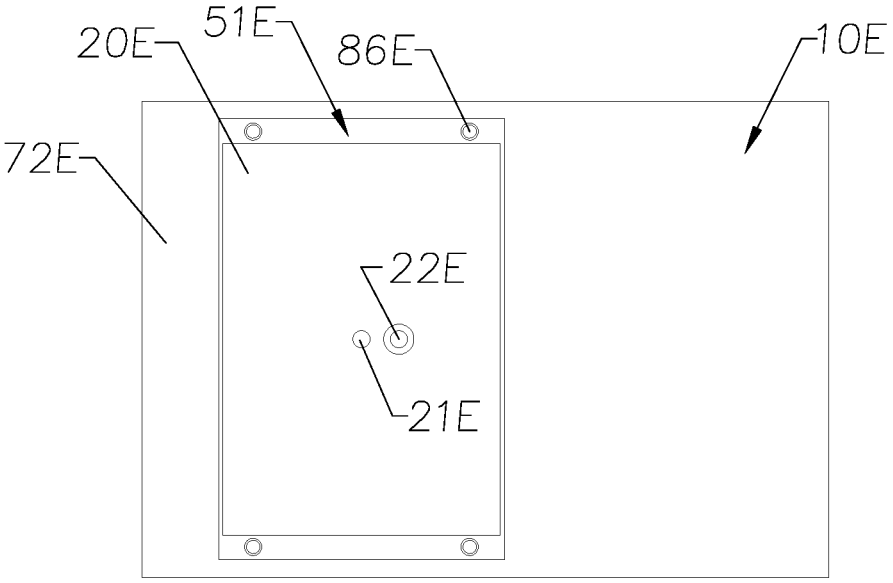
FIG. 46 is a top view of the antenna according to a seventh embodiment of the present invention.
Figure 47:
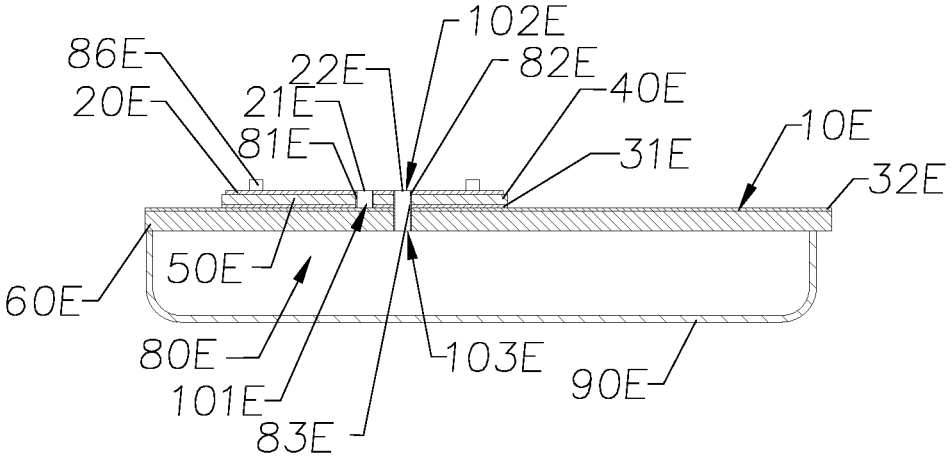
FIG. 47 is a sectional view of the antenna according to the above seventh embodiment of the present invention.
Figure 48A:
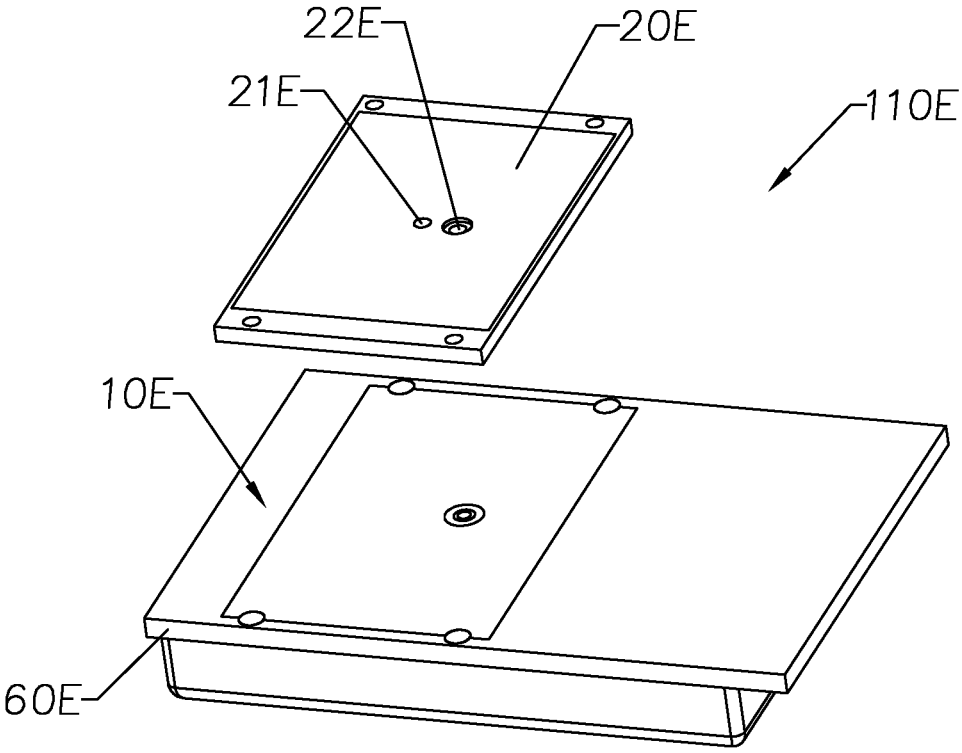
FIG. 48A illustrates a step of a manufacturing method of the antenna according to the seventh embodiment of the present invention.
Figure 48B:
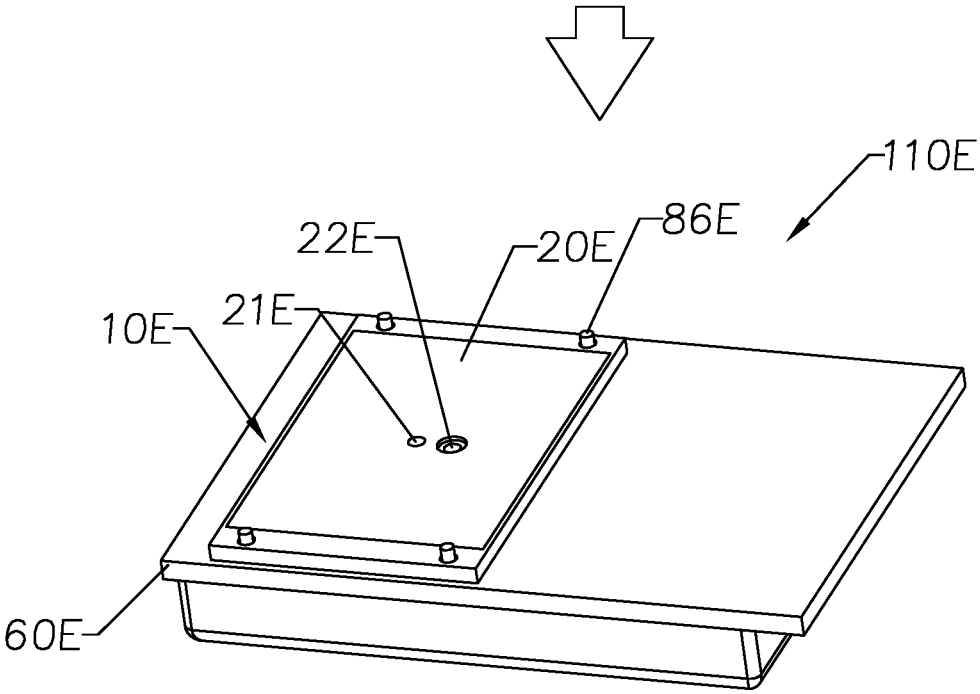
FIG. 48B illustrates another step of the manufacturing method of the antenna according to the seventh embodiment of the present invention.

The difference between the embodiment in FIGS. 46 to 48B and the embodiment in FIGS. 34 to 36B is that the first connecting member 31E is directly coupled at the second connecting member 32E as shown in FIGS. 34 and 36B, wherein the ground point 21E of the radiating source 20E, which is electrically connected to the first connecting member 31E, is electrically connected to the reference ground 10E, such that the radiating source 20E is electrically grounded. Furthermore, the antenna further comprises at least a retention member 86E, wherein the first substrate 50E is coupled at one side of the second substrate 60E via the retention member 86E, so as to stably connect the first connecting member 31E with the second connecting member 32E. Preferably, the retention member 86E is extended from the first substrate 50E to the second substrate in order to couple the first substrate 50E to the second substrate 60E by adhering the first connecting member 31E with the second connecting member 32E, so as to ensure the stability and consistency of the antenna. In other words, the difference between the embodiment in FIGS. 46 to 48B and the embodiment in FIGS. 34 to 36B is that there is no insulating unit 70E formed between the first connecting member 31E and the second connecting member 32E as shown in FIGS. 46 to 48B.

In addition, as shown in FIGS. 46 to 48B, the radiating source 20E has two long sides and two short sides, wherein a length of each long side of the radiating source 20E is longer than a length of each short side of the radiating source 20E. The feed point 22E of the radiating source 20E is offset from the physical center point thereof, wherein the feed point 22E of the radiating source 20E is located adjacent to one of the long sides thereof. When the microwave excitation signal is fed into the reference ground 10E from the feed point 22E of the radiating source 20E, the antenna can be easily generated an initial polarization direction. In addition, the area of the radiating source 20E is smaller than the area of the first substrate 50E, a retention area 51E is formed at outer sides of the short edges of the radiating source 20E corresponding to the first substrate 50E. In other words, the radiating source 20E is located between two retention areas 51, wherein the retention member 86E is coupled at the retention area 51E. The retention member 86E and the radiating source 20E are spaced apart from each other to prevent the retention member 86E being coupled to the radiating source 20E. In other words, the retention member 86E is not connected to the radiating source 20E.

As shown in FIGS. 46 to 48B, the fourth through slot 104E is formed at each of the first substrate 50E, the first connecting member 31E, the second substrate 60E, and the second connecting member 32E, wherein the fourth through slot 104E of the first substrate 50E and the fourth through slot 104E of the first connecting member 31E are communicated with each other, while the fourth through slot 104E of the second substrate 60E and the fourth through slot 104E of the second connecting member 32E are communicated with each other. Through the fourth through slot 104E of the first connecting member 31E corresponding to the fourth through slot 104E of the second connecting member 32E, the first connecting member 31E is coupled at the second connecting member 32E. The retention member 86E is coupled at the fourth through slots 104E of the first substrate 50E, the first connecting member 31E, the second substrate 60E, and the second connecting member 32E. The first substrate 50E is coupled at the second substrate 60E, wherein the first connecting member 31E is still coupled at the second connecting member 32E. In addition, the fourth through slot 104E of the first substrate 50E is located at the retention area 51E of the first substrate 50E to allow the retention member 86E retained at the retention area 51E of the first substrate 50E so as to prevent the retention member 86E being connected to the radiating source 20E. Preferably, two of the fourth through slots 104E are formed at each retention area 51E of the first substrate 50E. The number of the fourth through slot 104E of the first connecting member 31E, the second connecting member 32E, and the number of the fourth through slot 104E of the second substrate 60E should be the same as the number of the fourth through slot 104E of the first substrate 50E. It should be understood that the number of the fourth through slot 104E is for illustrative purpose and should not be limited in the present invention. Preferably, as shown in FIGS. 46 to 48B, the retention member 86E is made of soldering material to couple the first substrate 50E at the second substrate 60E so as to stably connect the first connecting member 31E to the second connecting member 32E. Particularly, the first substrate 60 is coupled at one side of the second substrate 60E through the connection between the first connecting member 31E and the second connecting member 32E. In addition, the fourth through slot 104E of the first substrate 50E, the fourth through slot 104E of the first connecting member 31E, the fourth through slot 104E of the second substrate 60E, the fourth through slot 104E of second connecting member 32E are communicated with each other. Accordingly, the soldering material in solid-liquid mixed state is filled into the fourth through slots 104E of the first substrate 50E, the first connecting member 31E, the second substrate 60E, and the second connecting member 32E. Once the soldering material is solidified, the retention member 86E is formed at the fourth through slots 104E to stably connect the first substrate 50E with the second substrate 60E, so as to ensure the first connecting member 31E being connected to the second connecting member 32E.

According to the preferred embodiment, two ends of the retention member 86E are extended and protruded out of the upper side of the first substrate 50E and the bottom side of the second substrate 60E respectively. Preferably, a cross sectional area of the first protruding portion of the retention member 86E protruded from the upper side of the first substrate 50E and a cross sectional of the second protruding portion of the retention member 86E protruded from the bottom side of the second substrate 60E must be larger than a diameter size of the fourth through slot 104E to enhance the stability of the antenna. According to the preferred embodiment, the fourth through slots 104E of the first connecting member 31E, the first substrate 50E, the second connecting member 32E and the second substrate 60E are through slots extended through the first connecting member 31E, the first substrate 50E, the second connecting member 32E and the second substrate 60E. The soldering material is able to fill into the fourth through slot 104E of the first substrate 50E and the fourth through slot 104E of the second substrate 60E at the same time. In another embodiment, the fourth through slots 104E of the first connecting member 31E, the second connecting member 32E and the first substrate 50E are through slots extended through the first connecting member 31E, the second connecting member 32E, and the first substrate 50E. The fourth through slot 104E of the second substrate 60E is a blind hole, i.e. not a through slot. It should be understood that the fourth through slot 104E may not provided at the first substrate 50E, the first connecting member 31E, the second connecting member 32E, and the second substrate 60E. The soldering material may be directly applied on the retention area 51E of the first substrate 50E and extended from the retention area 51E to the second connecting member 32E, so as to couple the first substrate 50E at one side of the second substrate 60E. Furthermore, the first connecting member 31E is coupled at the second connecting member 32E that the retention member 86E is extended from the first substrate 50E to the second connecting member 32E.

Figure 49A:
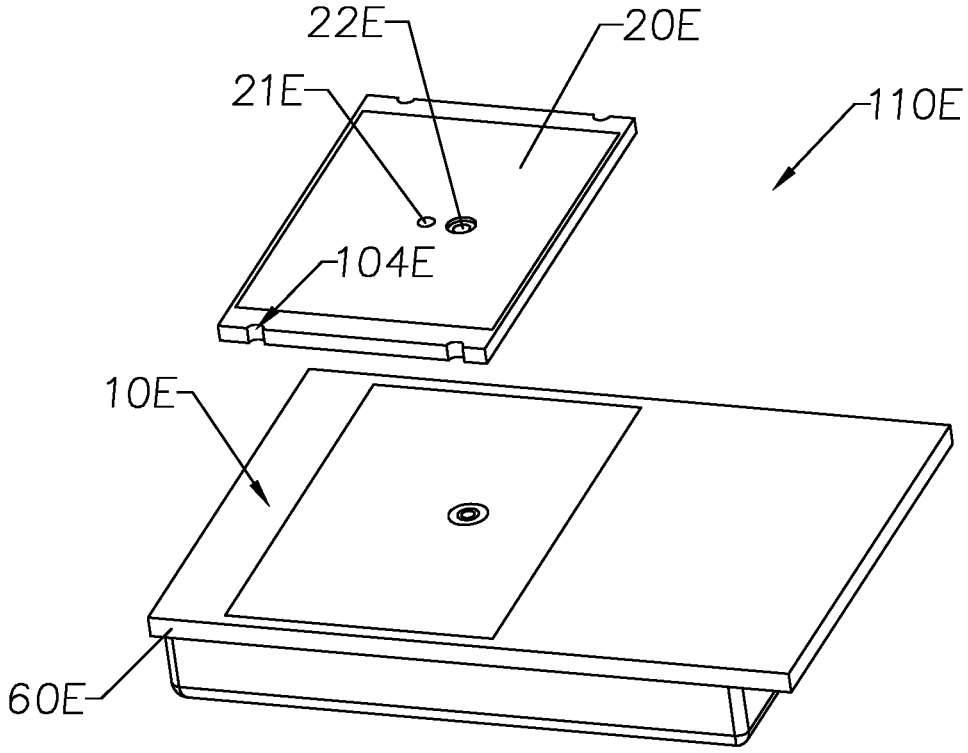
FIG. 49A illustrates a step of an alternative manufacturing method of the antenna according to the seventh embodiment of the present invention.
Figure 49B:
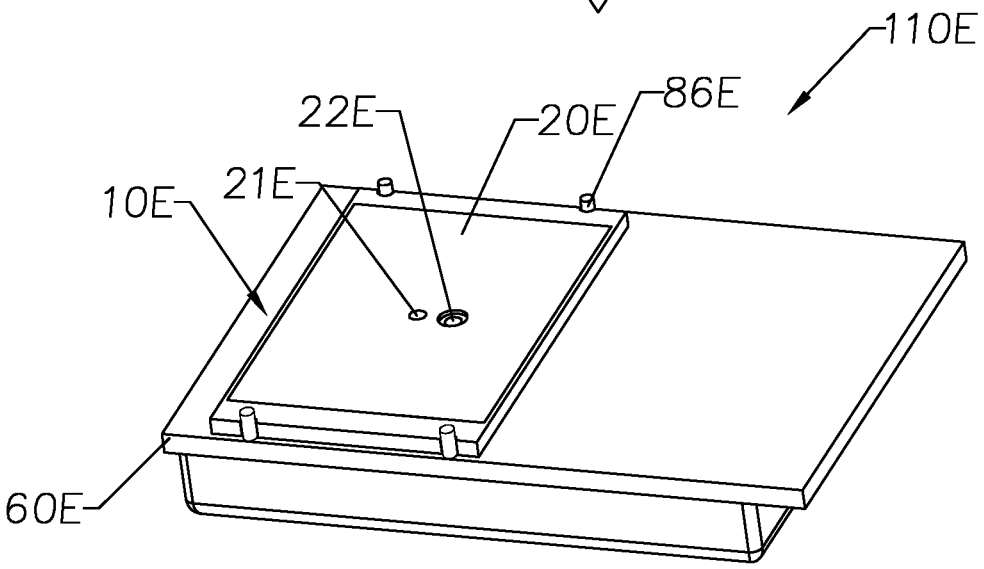
FIG. 49B illustrates another step of the alternative manufacturing method of the antenna according to the seventh embodiment of the present invention.
Figure 50:
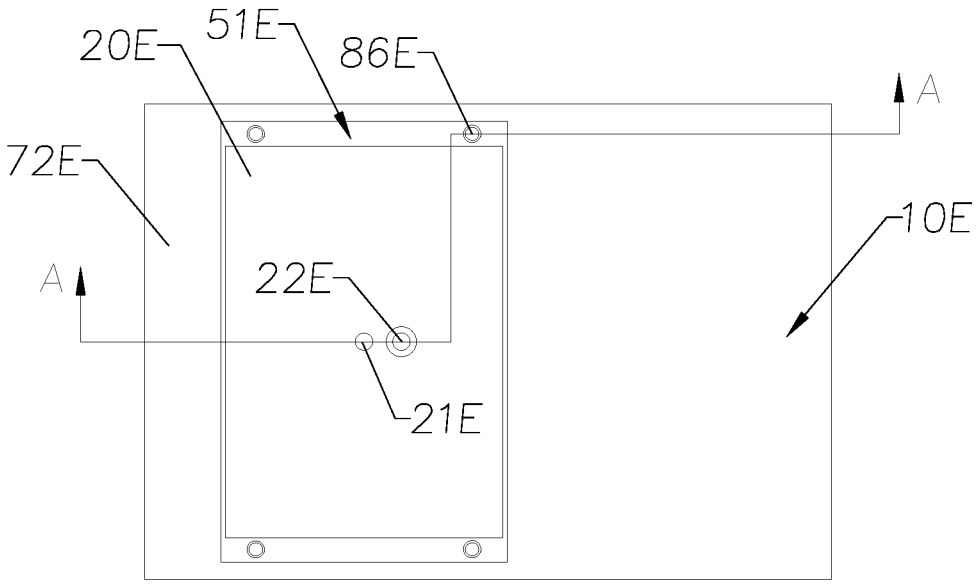
FIG. 50 is a top view of the antenna according to an eighth embodiment of the present invention.
Figure 51:
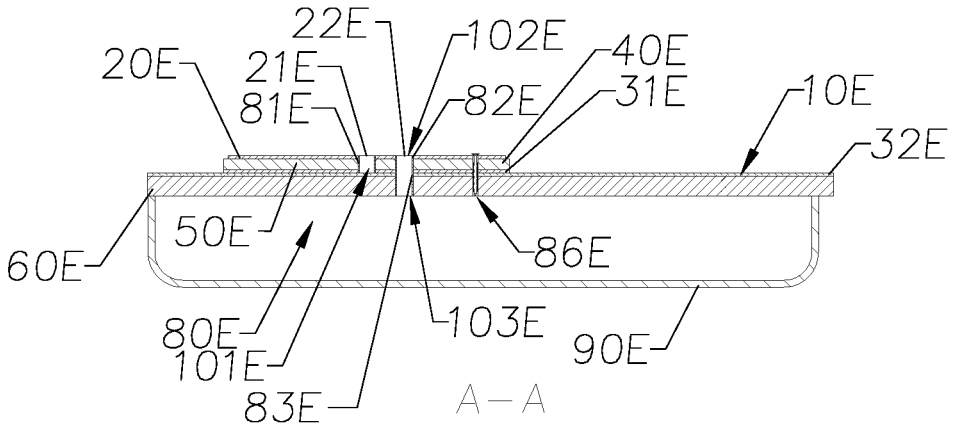
FIG. 51 is a sectional view of the antenna according to the above eighth embodiment of the present invention.
Figure 52A:
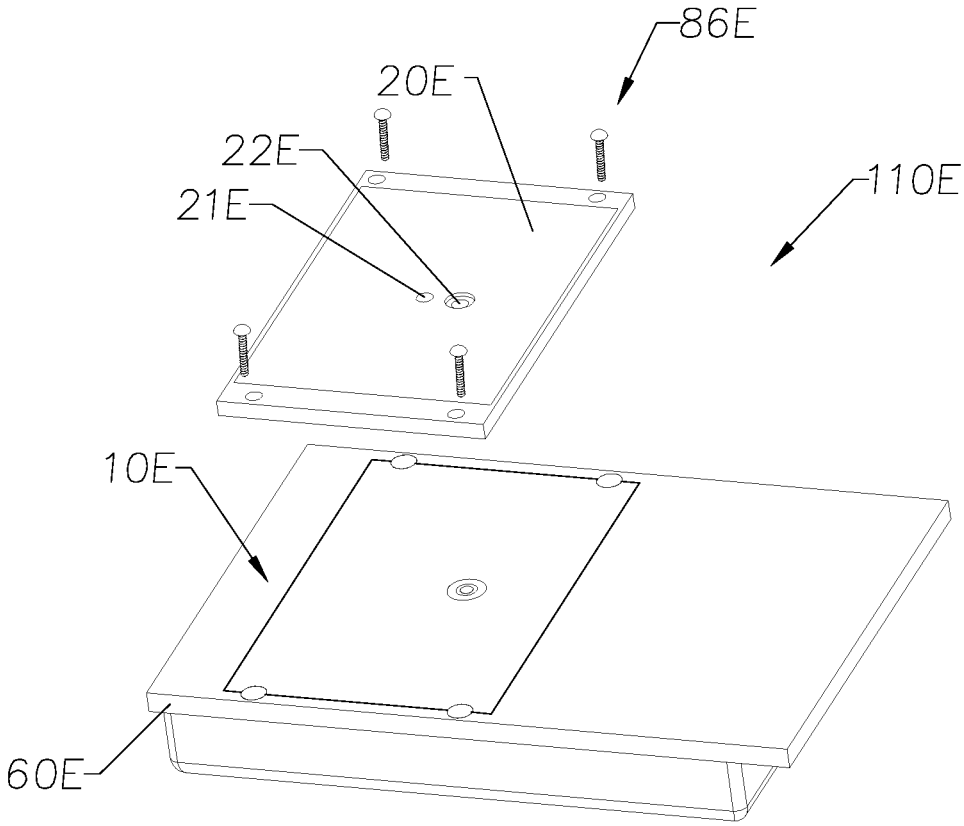
FIG. 52A illustrates a step of a manufacturing method of the antenna according to the eighth embodiment of the present invention.
Figure 52B:
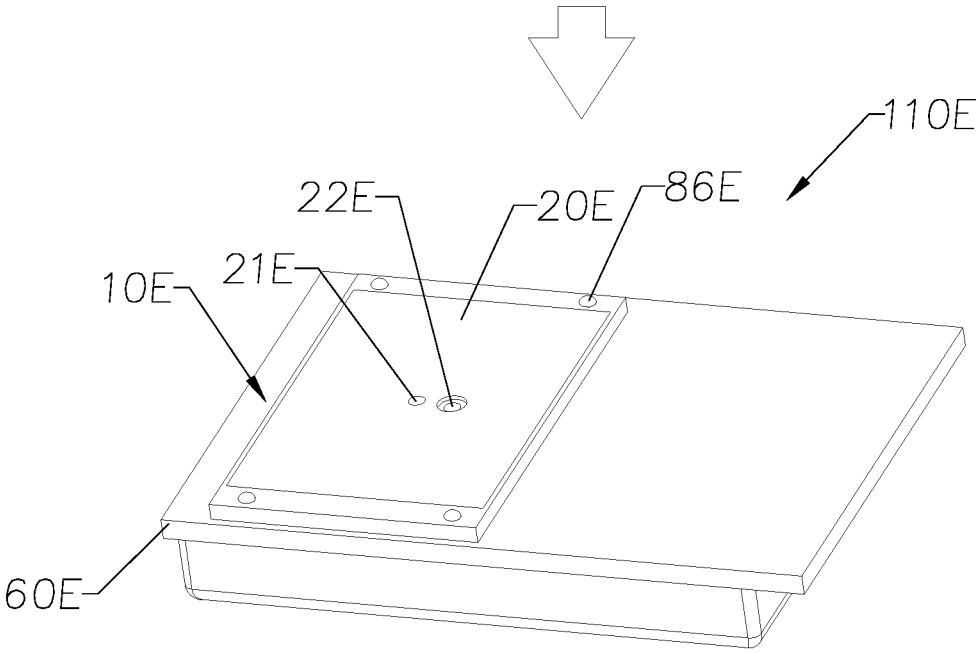
FIG. 52B illustrates another step of the manufacturing method of the antenna according to the eighth embodiment of the present invention.
Figure 53:
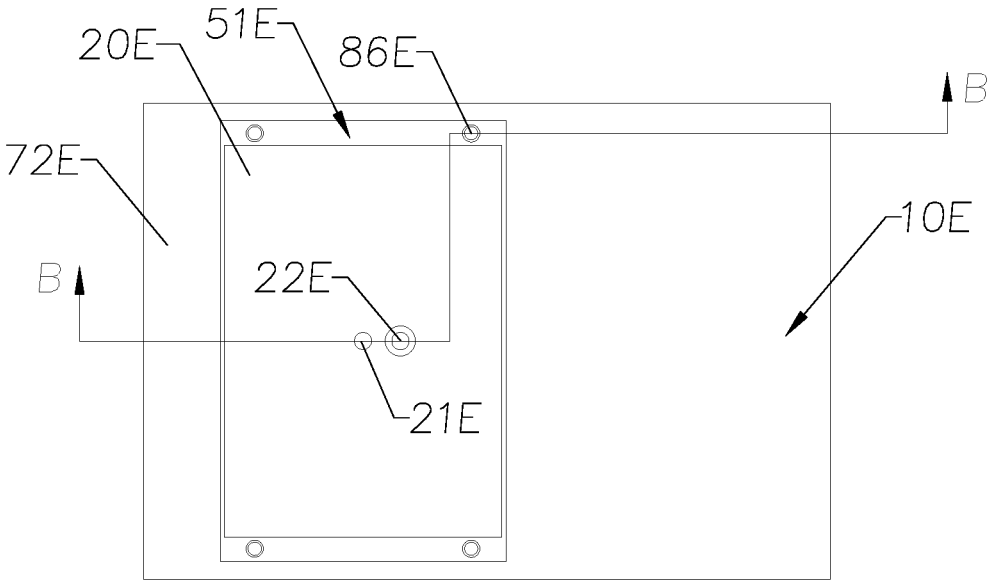
FIG. 53 is a top view of the antenna according to a ninth embodiment of the present invention.
Figure 54:
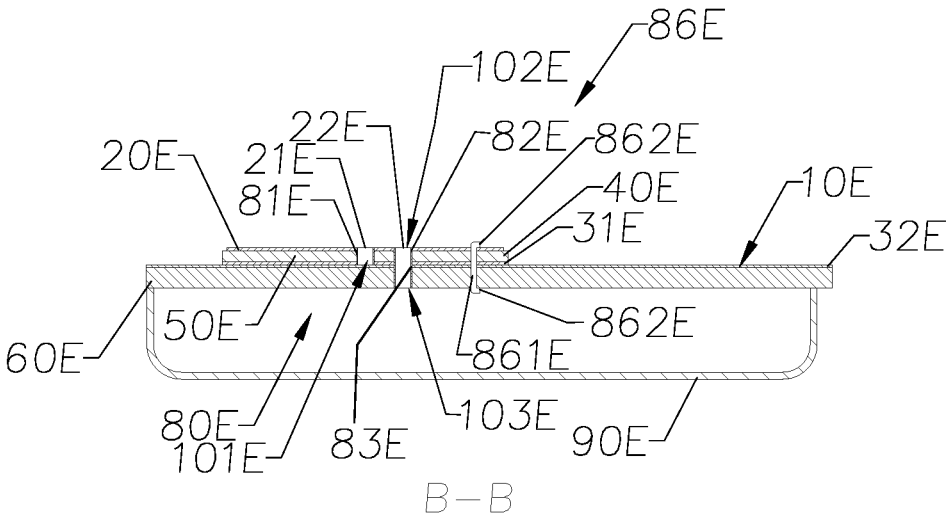
FIG. 54 is a sectional view of the antenna according to the above ninth embodiment of the present invention.
Figure 55A:
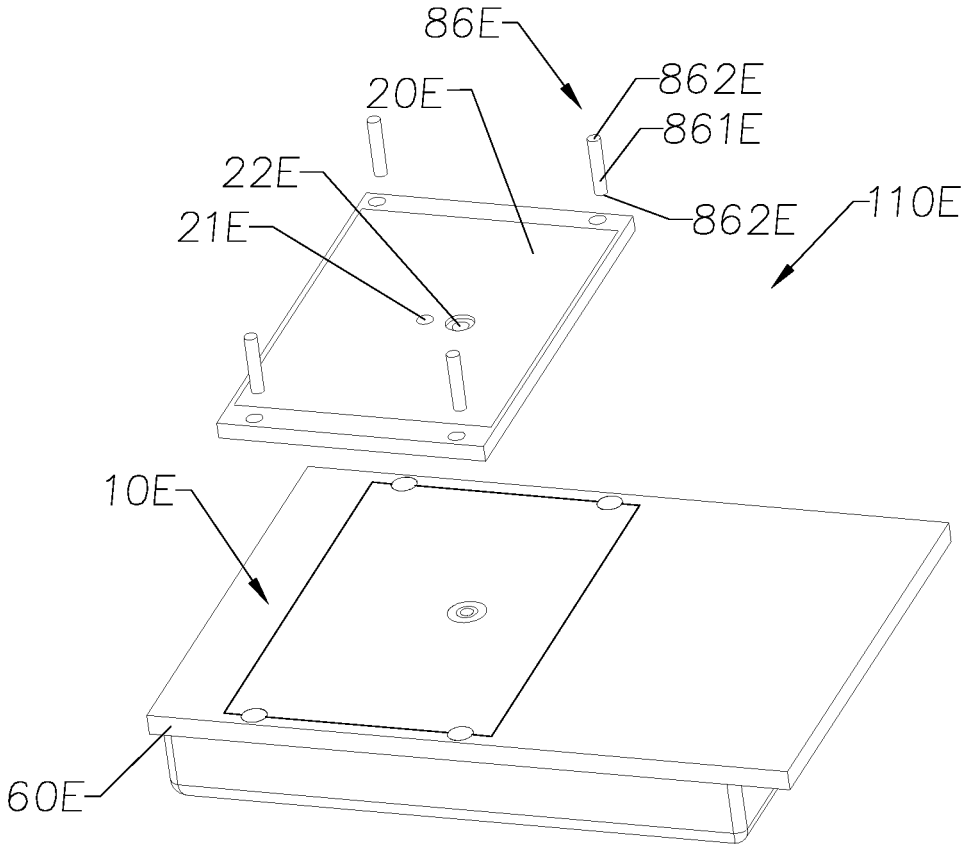
FIG. 55A illustrates a step of a manufacturing method of the antenna according to the ninth embodiment of the present invention.
Figure 55B:
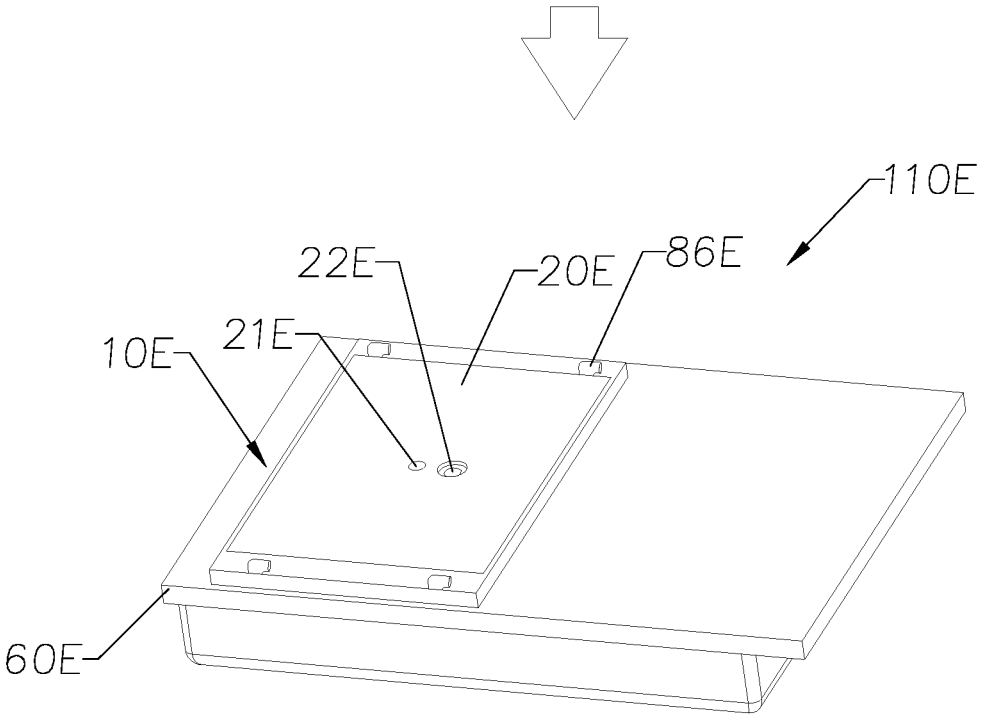
FIG. 55B illustrates another step of the manufacturing method of the antenna according to the ninth embodiment of the present invention.

Preferably, as shown in FIGS. 49A and 49B, the fourth through slot 104E of the first substrate 50E is a half hole. The difference between the embodiment in FIGS. 46 to 48B and the embodiment in FIGS. 49A and 49B is that there is no fourth through slot 104E formed at the second connecting member 32E or at the second substrate 60E to correspond with the fourth through slot 104E at the first substrate 50E as shown in FIGS. 49A and 49B. The retention member 86E is formed at the fourth through slot 104E of the first substrate 50E by soldering, wherein the second connecting member 32E are stably connected with the inner wall of the fourth through slot 104E of the first substrate 50E by the retention member 86E, such that the first connecting member 31E is coupled at the second connecting member 32E.

It is worth mentioning that since the fourth through slot 104E of the first substrate 50E can be a half hole to have a larger exposing angle, the retention member 86E can be formed at the fourth through slot 104E by automated soldering process in order to connect between the second connecting member 32E and the first substrate 50E, so as to simplify the manufacturing process and to enhance the consistency of the antenna.

Accordingly, the radiating source 20E forms at a circuit board which is a double-sided copper board, wherein copper element is covered on two sides of the circuit board. Particularly, copper element is covered on one side (first side) of the circuit board to form the radiating source 20, wherein the ground point 21E is formed by the metallization slot process. The ground point 21E of the radiating source 20E is electrically connected to the copper element covered at the opposed side (second side) of the circuit board in order to electrically connect to the reference ground 10E. Therefore, the ground point 21E is electrically grounded 20E. However, there will be an impedance between the ground point 21E and the reference ground 10E. Particularly, if the second side of the circuit board is soldered to the reference ground 10E, the impedance between the ground point 21 and the reference ground 10E will be increased and will difficult to control for good consistency. In other words, by directly and electrically connecting the second side of the circuit board to the reference ground 10E to lower the impedance to ground and to enhance the consistency. In addition, the retention member 86E is formed at the half hole of the circuit board as a soldering point, wherein the retention member 86E is not connected to the radiating source 20E. The half hole of the circuit board allows the retention member 86E being formed at the half hole by automated soldering process.

Preferably, as shown in FIGS. 50 to 52B, each of the fourth through slots 104E of the first substrate 50E, the first connecting member 31E, the second connecting member 32E, and the second substrate 60E has an inner threaded portion formed at the inner wall of the fourth through slot 104E, wherein the retention member 86E has an outer threaded portion correspondingly engaged with the inner threaded portions of the fourth through slots 104E. The first substrate 50E is affixedly coupled at one side of the second substrate 60E through the connection between the first connecting member 31E and the second connecting member 32E. The fourth through slots 104E of the first substrate 50E, the first connecting member 31E, the second substrate 60E, and the second connecting member 32E are communicated with each other. Through the matching the outer threaded portion of the retention member 86E with the inner threaded portions of the fourth through slots 104E, the retention member 86E is extended from the first substrate 50E to the second substrate 60E to affixedly couple the first substrate 50E with the second substrate 60E and to always connect the first connecting member 31E to the second connecting member 32E. It should be understood that the retention member 86E can be a screw, an expansion screw, or a combination of a bolt and a nut, etc.

Preferably, as shown in FIGS. 53 to 55B, the retention member 86E has an engaging portion 861E and two limiting portions 862E opposedly and integrally extended from two ends of the engaging portion 861E respectively. The retention member 86E is moved between an initial state and a limited state. At the initial state, the limiting portions 862E opposedly and alignedly extended from two ends of the engaging portion 861E respectively to form an elongated member, wherein the retention member 86E is extended through the fourth through slot 104E of the first substrate 50E and the fourth through slot 104E of the second substrate 60E. Particularly, the limiting portions 862E of the retention member 86E are extended above the first substrate 50E and below the second substrate 60E respectively. Each of the limiting portions 862E of the retention member 86E has a predetermined elasticity, wherein each limiting portion 862E is arranged to be deformed by an external force. At the limited state, when each of the limiting portions 862E is bent from the engaging portion 861E that the extension direction of the limiting portion 862 is changed, a retention cavity is formed between the limiting portions 862E and around the engaging portion 861E, such that the first substrate 50E, the first connecting member 31E, the second connecting member 32E and the second substrate 60E are pressed between the limiting portions 862E and are affixed and retained at the retention cavity. One of the limiting portions 862E is extended above the first substrate 50E and is coupled at the first substrate 50E. Another limiting portion 862E is extended below the second substrate 60E and is coupled at the second substrate 60E. Therefore, the first substrate 50E is affixedly coupled at one side of the second substrate 60E, wherein the first connecting member 31E is stably connected to and overlapped with the second connecting member 32E.

Accordingly, the present invention further comprises a method of manufacturing the antenna.

According to the manufacturing method, the first antenna assembly 110E is provided, wherein the first antenna assembly 110E is constructed to have the first substrate 50E, the radiating source 20E, and the first connecting member 31E. The first connecting member 31E and the radiating source 20E are respectively coupled at two sides of the first substrate 50E. The radiating source 20E and the first connecting member 31E have good electrical conductivity, wherein the radiating source 20E and the first connecting member 31E can be made of, but not limited to, copper, copper alloy, silver, gold or the like.

In the manufacturing method, the second antenna assembly 120E is constructed to have the second substrate 60E and the second connecting member 32E, wherein the second connecting member 32E is coupled at one side of the second substrate 60E. The second connecting member 32E forms the reference ground 10E. The second connecting member 32E has good electrical conductivity that the second connecting member 32E can be made of, but not limited to, copper, copper alloy, silver, gold or other metal materials.

In the manufacturing method, the ground point 21E of the radiating source 20E is electrically connected the first connecting member 31E via the first conductive member 81E. Preferably, the first conductive member 81E is formed by metallization slot process.

In the manufacturing method, the second conductive member 82E is electrically connected to the feed point 22E of the radiating source 20E. Preferably, the second conductive member 82E is formed by metallization slot process.

In the manufacturing method, the second conductive member 82E is encircled by the first insulating notch 311E of the first connecting member 31E. Preferably, the first insulating notch 311E of the first connecting member 31E is formed by scraping or etching process.

In the manufacturing method, the third conductive member 83E is electrically connected to the oscillation circuit 70E. Preferably, the third conductive member 83E is formed by metallization slot process.

In the manufacturing method, the third conductive member 83E is encircled by the second insulating notch 321E of the second connecting member 32E. Preferably, the second insulating notch 321E of the second connecting member 32E is formed by scraping or etching process.

In the manufacturing method, the second conductive member 82E is electrically connected to the third conductive member 83E. Preferably, the second conductive member 82E is connected to the third conductive member 83E by soldering in order to electrically connect the second conductive member 82E to the third conductive member 83E.

In the manufacturing method, at least a portion of the first connecting member 31E is electrically connected to at least a portion of the second connecting member 32E, wherein the ground point 21E of the radiating source 20E, which is electrically connected to the first connecting member 31E, is electrically connected to the second connecting member 32E.

In one embodiment, the first connecting member 31E is press-fitted to the second connecting member 32E in order to electrically connect the first connecting member 31E to the second connecting member 32E. For example, the first connecting member 31E is connected to the second connecting member 32E under a predetermined pressure and a predetermined high temperature, such that at least a portion of the first connecting member 31E is melted and fused with at least a portion of the second connecting member 32E to electrically connect the first connecting member 31E to the second connecting member 32E.

In one embodiment, the first insulating layer 71E is applied on the bottom side of the first connecting member 31E that at least a portion thereof is exposed without the first insulating layer 71E, such that the exposing portion of the first connecting member 31E is able to electrically connect to the second connecting member 32E. Preferably, at least one first insulating notch 311E is formed at the first connecting member 31E as the exposing portion thereof with respect to the first insulating layer 71E, such that at least a portion of the first connecting member 31E at the first insulating notch 311E is able to electrically connect to the second connecting member 32E. Preferably, an insulating material is applied, preferably by spraying, on a predetermined location of the first connecting member 31E to form the first insulating layer 71E, wherein at least a portion of the first connecting member 31E is exposed without the insulating material as the exposing portion thereof. Accordingly, the first insulating notch 311E is formed on the first insulating layer 71E by scraping or etching the insulating material on the bottom side of the first connecting member 31E to expose at least a portion of the first connecting member 31E as the exposing portion thereof.

In one embodiment, the second insulating layer 72E is applied on the upper side of the second connecting member 32E that at least a portion thereof is exposed without the second insulating layer 72E, such that the exposing portion of the second connecting member 32E is able to electrically connect to the first connecting member 31E. Preferably, at least one second insulating notch 321E is formed at the second connecting member 32E as the exposing portion thereof with respect to the second insulating layer 72E, such that at least a portion of the second connecting member 32E at the second insulating notch 321E is able to electrically connect to the first connecting member 31E. Preferably, the insulating material is applied, preferably by spraying, on a predetermined location of the second connecting member 32E to form the second insulating layer 72E, wherein at least a portion of the second connecting member 32E is exposed without the insulating material as the exposing portion thereof. Accordingly, the second insulating notch 321E is formed on the second insulating layer 72E by scraping or etching the insulating material on the upper side of the second connecting member 32E to expose at least a portion of the second connecting member 32E as the exposing portion thereof.

In one embodiment, through the electrical connection between the fourth conductive member 84E and the fifth conductive member 85E, the fourth conductive member 84E is electrically connected to the first connecting member 31E while the fifth conductive member 85E is electrically connected to the second connecting member 32E, such that the radiating source 20E is spaced apart from one side of the reference ground 10E. Preferably, the fourth conductive member 84E and the fifth conductive member 85E are formed by metallization slot process. Accordingly, the fourth conductive member 84E and the fifth conductive member 85E are electrically connected through the soldering process, so as to retain the first antenna assembly 110E at one side of the second antenna assembly 120E.

As shown in FIGS. 46 to 55B, the first antenna assembly 110E is coupled and retained at one side of the second antenna assembly 120E through the first connecting member of the first antenna assembly 110E electrically connecting to the second connecting member 32E of the second antenna assembly 120E. Furthermore, the retention member 86E is extended from the first antenna assembly 110E to the second antenna assembly 120E, wherein the first connecting member 31E is stably and directly connected to the second connecting member 32E in an electrical connection. Preferably, the fourth through slot 104E at the first substrate 50E is a half hole. Accordingly, the fourth through slot 104E is not provided at each of the second connecting member 32E and the second substrate 60E corresponding to the fourth through slot 104E of the first substrate 50E, such that the retention member 86E is formed at the fourth through slot 104E of the first substrate 50E by soldering. Preferably, the soldering material is filled into the fourth through slots 104E of the first substrate 50E, the first connecting member 31E, the second connecting member 32E, and the second substrate 60E, wherein the fourth through slots 104E of the first substrate 50E, the first connecting member 31E, the second connecting member 32E, and the second substrate 60E are communicated with each other, such that the retention member 86E is formed at the fourth through slots 104E. Preferably, the outer threaded portion of the retention member 86E is engaged with the inner threaded portions of the fourth through slots 104E, wherein the retention member 86E is extended from the first substrate 50E to the second substrate 60E to retain the first substrate 50E at the second substrate 60E, so as to ensure the first connecting member 31E being connected to the second connecting member 32E in a surface to surface contacting manner. Preferably, the two limiting portions 862E of the retention member 86E are extended above the first substrate 50E and below the second substrate 60E respectively, wherein the retention member 86E is extended through the fourth through slots 104E of the first substrate 50E, the first connecting member 31E, the second connecting member 32E, and the second substrate 60E. Therefore, when the two limiting portions 862E of the retention member 86E are deformed, such as bending, to coupled at the first substrate 50E and the second substrate 60E respectively, the first antenna assembly 110E is retained at one side of the second antenna assembly 120E.

It is worth mentioning that the first antenna assembly 110E is stably retained at one side of the second antenna assembly 120E via the connection between the first connecting member 31E and the second connecting member 32E. Through the configuration, the ground point 21E of the radiating source 20E, which is electrically connected to the first connecting member 31E, is electrically connected to the reference ground 10E. At the same time, through the configuration, the impedance to the ground between the ground point 21E and the reference ground 10E will be lowered to enhance the anti-interference ability of the antenna.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An antenna, comprising:

a reference ground;

a radiating source spacedly disposed at said reference ground to define a radiating clearance between said radiating source and said reference ground, wherein said radiating source has a feed point and a ground point; and a connection module which comprises at least a first connecting member electrically connected to said ground point of said radiating source and at least a second connecting member electrically connected to said reference ground, wherein at least a portion of said first connecting member is electrically connected to at least a portion of said second connecting member.

2. The antenna, as recited in claim 1, further comprising a first substrate and a second substrate coupled to said second connecting member, wherein said radiating source and said first connecting member are coupled at two sides of said first substrate respectively.

3. The antenna, as recited in claim 1, further comprising a first insulating layer coupled at said first connecting member, wherein at least a portion of said first connecting member is defined as a first exposing portion to electrically connect to said second connecting member.

4. The antenna, as recited in claim 3, wherein said first insulating layer has a first indention defining said first exposing portion thereat, wherein the first insulating layer is coupled at a bottom side of said first connecting member to form said first exposing portion thereon, wherein an area of said first insulating layer is smaller than an area of said bottom side of the first connecting member.

5. The antenna, as recited in claim 4, further comprising a second insulating layer coupled at said second connecting member, wherein at least a portion of said second connecting member is defined as a second exposing portion to electrically connect to said first exposing portion of said first connecting member.

6. The antenna, as recited in claim 5, wherein said second insulating layer has a second indention defining said second exposing portion thereat, wherein second first insulating layer is coupled at an upper side of said second connecting member to form said second exposing portion thereon, wherein an area of said second insulating layer is smaller than an area of said upper side of the second connecting member.

7. The antenna, as recited in claim 1, further comprising a first substrate and a second substrate coupled to said second connecting member, wherein said radiating source and said first connecting member are coupled at two sides of said first substrate respectively.

8. The antenna, as recited in claim 7, further comprising a first insulating layer and a second insulating layer, wherein said first connecting member is positioned between said first substrate and said first insulating layer, wherein said second connecting member is positioned between said second substrate and said second insulating layer.

9. The antenna, as recited in claim 8, further comprising a first conductive member, wherein two ends of said first conductive member are electrically connected to said ground point of said radiating source and said first connecting member.

10. The antenna, as recited in claim 9, further comprising a first through slot formed at each of said radiating source, said first substrate, said first connecting member and said insulating layer, wherein said first through slots of said radiating source, said first substrate, said first connecting member and said insulating layer are communicated with each other, wherein said first conductive member is formed at inner slot walls of said first through slots of said radiating source, said first substrate, said first connecting member and said insulating layer.

11. The antenna, as recited in claim 10, further comprising a second conductive member and an oscillation circuit, wherein said second conductive member is extended from said feed point of the radiating source to a bottom side of said first insulating layer and is electrically connected to said oscillation circuit.

12. The antenna, as recited in claim 11, further comprising a third conductive member is electrically connected to said oscillation circuit, wherein said third conductive member is extended from said oscillation circuit to an upper side of said second insulating layer while said third conductive member is electrically connected to said second conductive member.

13. The antenna, as recited in claim 12, wherein said first connecting member has a first insulating notch and said second connecting member has a second insulating notch, wherein said first insulating notch and said second insulating notch are through notches extended through said first connecting member and said second connecting member respectively, wherein said first insulating notch and said second insulating notch are extended to encirclingly surround said second conductive member and said third conductive member respectively.

14. The antenna, as recited in claim 13, further comprising at least a fourth conductive member and at least a fifth conductive member is electrically connected to said fourth conductive member, wherein said fourth conductive member is electrically connected to said first connecting member while said fifth conductive member is electrically connected to said second connecting member, wherein said fourth conductive member is extended through said first substrate and said first insulating layer, wherein said fifth conductive member is extended through said second insulating layer, said second connecting member and said second substrate.

15. The antenna, as recited in claim 14, further comprising a fourth through slot formed at each of said first substrate, said first connecting member, said first insulating layer, said second insulating layer, said second connecting member, and said second substrate, wherein said fourth conductive member is formed at said fourth through slot of said first substrate, and inner slot walls of said fourth through slots of said first connecting member and said first insulating layer, wherein said fifth conductive member is formed at said fourth through slot of said second substrate, and inner slot walls of said fourth through slots of said second connecting member and said second insulating layer.

16. The antenna, as recited in claim 15, further comprising a retention member engaged with said fourth through slots in order to couple said first substrate to said second substrate.

17. The antenna, as recited in claim 16, wherein said retention member has an outer threaded portion, wherein each of said through slots has an inner threaded portion to engage with said outer threaded portion of said retention member to couple said first substrate to said second substrate.

18. The antenna, as recited in claim 7, further comprising a retention member extended from said first substrate to said second substrate in order to couple said first substrate to said second substrate.

19. The antenna, as recited in claim 18, wherein said retention member has an engaging portion and two deformable limiting portions opposedly extended from said engaging portion, wherein said limiting portions are extended above said first substrate and below said second substrate respectively, such that when said limiting portions are deformed, said first substrate and said second substrate are pressed between said limiting portions to couple said first substrate to said second substrate.

* * * * *